US006024203A

United States Patent [19]

Amdahl et al.

[11] Patent Number: 6,024,203

[45] Date of Patent: Feb. 15, 2000

[54] CART MANAGEMENT SYSTEM AND METHOD

[75] Inventors: Keith L. Amdahl, Fridley; Christopher J. Rogney, Hugo; Mark G. Bussey, Mound, all of Minn.

[73] Assignee: Smarte Carte, Inc., St. Paul, Minn.

[21] Appl. No.: 08/934,422

[22] Filed: Sep. 19, 1997

Related U.S. Application Data

[63] Continuation-in-part of application No. 08/531,953, Sep. 21, 1995, Pat. No. 5,921,373, which is a continuation-in-part of application No. 08/306,638, Sep. 15, 1994, Pat. No. 5,526,916.

[51] Int. Cl.[7] ..... G07F 7/00

[52] U.S. Cl. ..... 194/213; 194/905; 340/568.5

[58] Field of Search ..... 194/905, 205, 194/213, 210, 211; 340/568.5, 572.1

[56] References Cited

U.S. PATENT DOCUMENTS

| | | | |
|---|---|---|---|
| 2,818,955 | 1/1958 | Stackhouse | 194/905 X |
| 3,165,189 | 1/1965 | Easterday | 194/212 |
| 3,194,377 | 7/1965 | Fischbach et al. | 194/211 |
| 3,897,863 | 8/1975 | Peggs | 194/212 |
| 3,938,638 | 2/1976 | Moule | 194/211 |
| 3,978,959 | 9/1976 | Muellner | 194/211 |
| 4,424,893 | 1/1984 | Gillett | 186/62 X |
| 4,450,968 | 5/1984 | Muellner | 211/7 |
| 4,470,495 | 9/1984 | Unger | 194/905 X |
| 4,518,073 | 5/1985 | Pastien | 186/27 X |
| 4,549,182 | 10/1985 | Gillet | 340/942 |
| 4,572,347 | 2/1986 | Eisermann | 194/205 |
| 4,576,274 | 3/1986 | Thorsen | 194/210 |
| 5,072,543 | 12/1991 | Tetherton | 49/47 |
| 5,119,087 | 6/1992 | Lucas | 194/211 |

FOREIGN PATENT DOCUMENTS

| | | | |
|---|---|---|---|
| 0 141 285 A1 | 5/1985 | European Pat. Off. . | |
| 0 360 264 A2 | 3/1990 | European Pat. Off. . | |
| 0 565 468 A1 | 10/1993 | European Pat. Off. . | |
| 2458969 | 6/1975 | Germany | 194/905 X |
| 2941732 A1 | 4/1981 | Germany | 194/905 X |
| 2950784 | 7/1981 | Germany | 194/905 X |
| 31 30 543 A1 | 2/1983 | Germany . | |
| 42 02 969 A1 | 6/1993 | Germany . | |
| 2 122 792 A | 1/1984 | United Kingdom . | |
| WO 90/12378 | 4/1990 | WIPO . | |
| WO 96/08796 | 3/1996 | WIPO . | |
| WO 97/11441 | 3/1997 | WIPO . | |

OTHER PUBLICATIONS

"Electronically Controlled Baggage Trolley Systems," *Expresso Deutschland Transportgeräte* (1995).

Expresso product literature (no date).

Expresso "Skillful Concepts for Airports," ad, *ACI Europe Airport Bus. Supp. Winter* (no date).

Ordnungssysteme für Gepäck–und Einkaufswagen (no date).

"Preview," *Airport Forum* (1995).

QVS Luggage Trolley Mgmt System brochure (no date).

"Smarte Carte® Unveils New Baggage Trolley System for European Airports," *Smarte Carte International Concourse,* (Sep. 1987).

*Primary Examiner*—F. J. Bartuska

*Attorney, Agent, or Firm*—Merchant & Gould P.C.

[57] ABSTRACT

A cart management apparatus and method for retaining and vending carts such as luggage carts, shopping carts, and strollers, includes a retaining device for selective retaining at least one of the carts; a cart identification sensor for uniquely identifying carts retained by the retaining device; a control device for controlling the vending and returning of carts, wherein the control device maintains a queue of carts identified by a cart identification sensor and retained by the retaining device; a reward device for dispensing a reward when a cart is returned to the retaining device; and a counter for counting a number of times that an identification of the cart is missed from the queue of carts so as to prevent the reward device from dispensing a reward when the number of times exceeds a predetermined value of the counter.

19 Claims, 28 Drawing Sheets

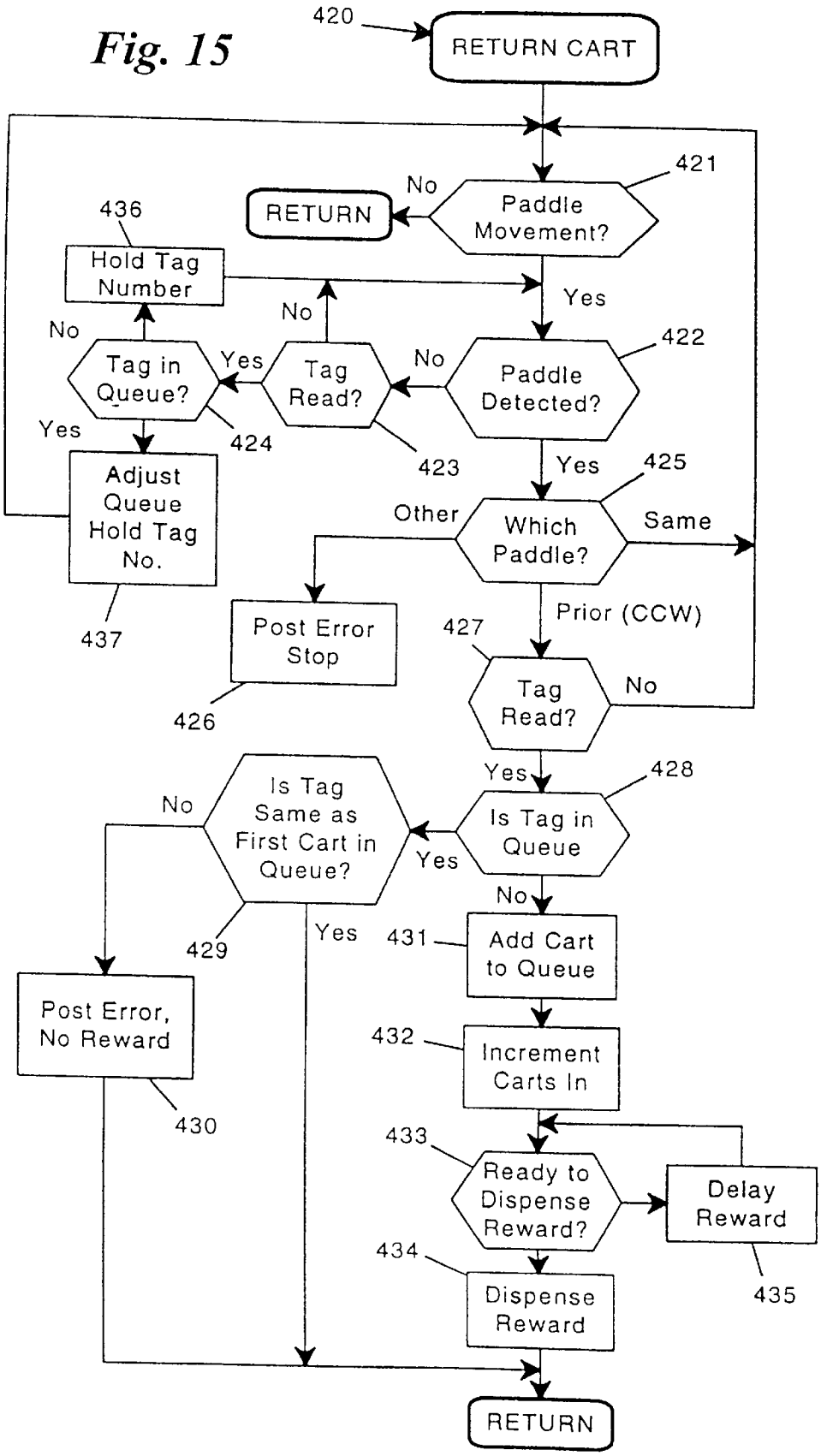
Fig. 15
420
RETURN CART
421
Paddle Movement?
No
RETURN
Yes
422
Paddle Detected?
No
Tag Read?
423
Yes
No
Tag in Queue?
424
Yes
No
436
Hold Tag Number
Adjust Queue Hold Tag No.
437
425
Which Paddle?
Other
Same
Post Error Stop
426
Prior (CCW)
427
Tag Read?
No
Yes
428
Is Tag in Queue
Yes
No
Is Tag Same as First Cart in Queue?
No
Yes
429
Post Error, No Reward
430
431
Add Cart to Queue
432
Increment Carts In
433
Ready to Dispense Reward?
Delay Reward
435
434
Dispense Reward
RETURN

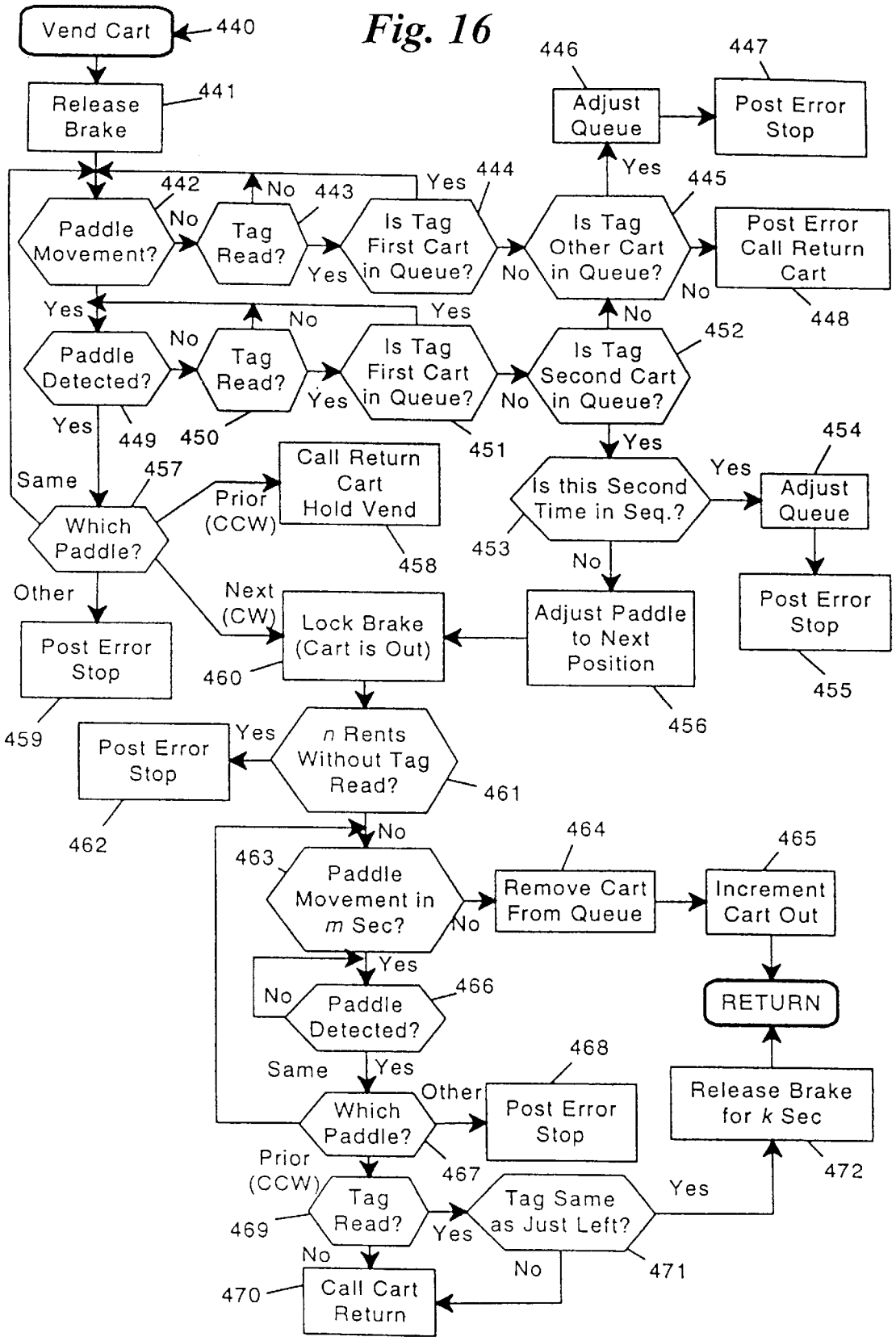
Fig. 16
Vend Cart
440
Release Brake
441
Paddle Movement?
442
No
Tag Read?
443
Yes
Is Tag First Cart in Queue?
444
Yes
No
Is Tag Other Cart in Queue?
445
Yes
Adjust Queue
446
Post Error Stop
447
No
Post Error Call Return Cart
448
Paddle Detected?
449
Yes
No
Tag Read?
450
Yes
No
Is Tag First Cart in Queue?
451
Yes
No
Is Tag Second Cart in Queue?
452
Yes
Is this Second Time in Seq.?
453
Yes
Adjust Queue
454
Post Error Stop
455
No
Adjust Paddle to Next Position
456
Which Paddle?
457
Same
Prior (CCW)
Call Return Cart Hold Vend
458
Other
Post Error Stop
459
Next (CW)
Lock Brake (Cart is Out)
460
n Rents Without Tag Read?
461
Yes
Post Error Stop
462
No
Paddle Movement in m Sec?
463
No
Remove Cart From Queue
464
Increment Cart Out
465
Yes
Paddle Detected?
466
No
Same
Yes
Which Paddle?
467
Other
Post Error Stop
468
Prior (CCW)
Tag Read?
469
Yes
Tag Same as Just Left?
471
Yes
Release Brake for k Sec
472
RETURN
No
Call Cart Return
470
No

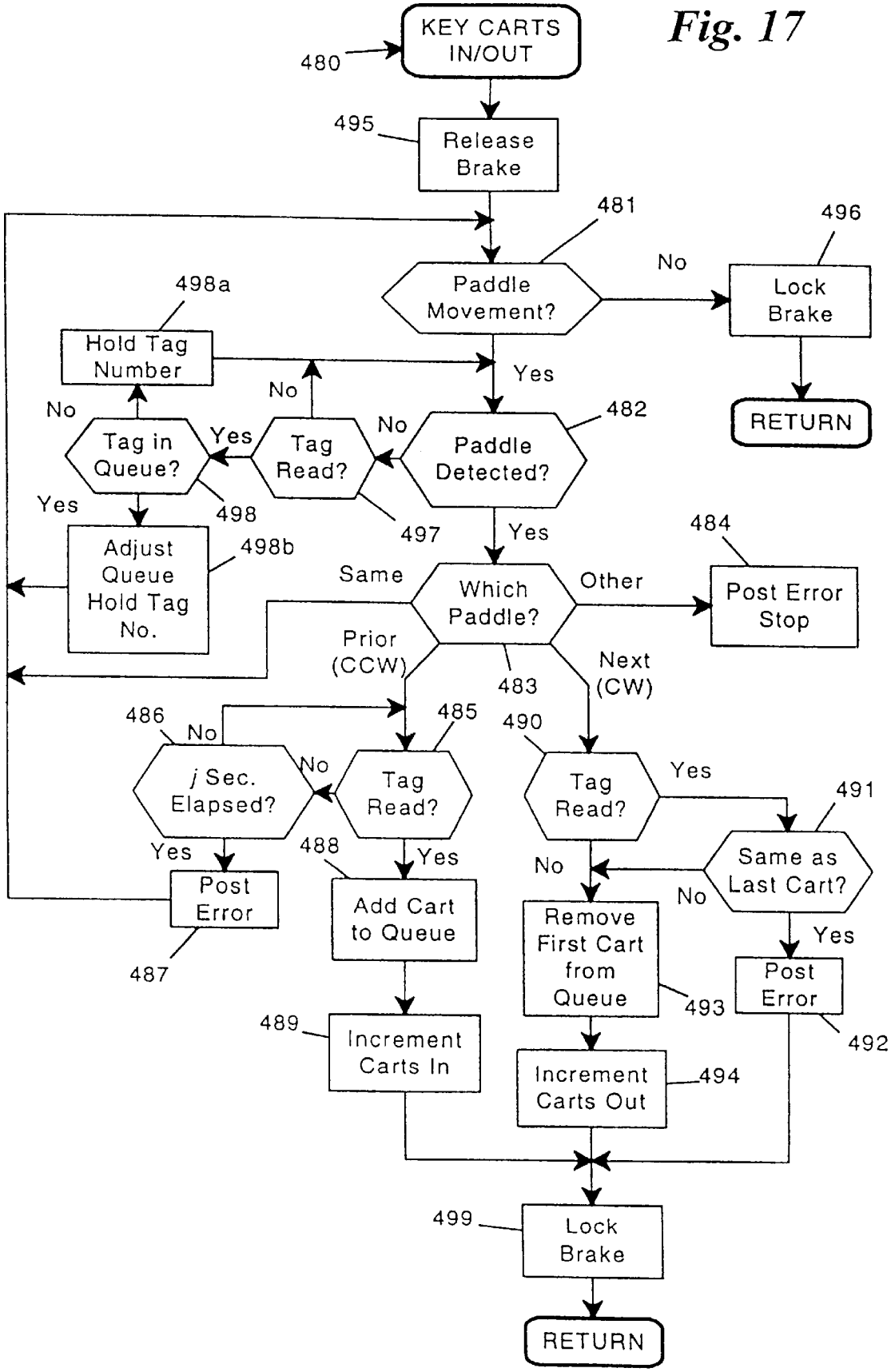
Fig. 17
KEY CARTS IN/OUT
480
Release Brake
495
Paddle Movement?
481
No
Lock Brake
496
RETURN
Yes
Paddle Detected?
482
No
Tag Read?
497
No
Yes
Tag in Queue?
498
No
Hold Tag Number
498a
Yes
Adjust Queue Hold Tag No.
498b
Yes
Which Paddle?
483
Same
Other
Post Error Stop
484
Prior (CCW)
Next (CW)
Tag Read?
485
No
j Sec. Elapsed?
486
Yes
Post Error
487
Yes
Add Cart to Queue
488
Increment Carts In
489
Tag Read?
490
Yes
Same as Last Cart?
491
No
Yes
Post Error
492
No
Remove First Cart from Queue
493
Increment Carts Out
494
Lock Brake
499
RETURN

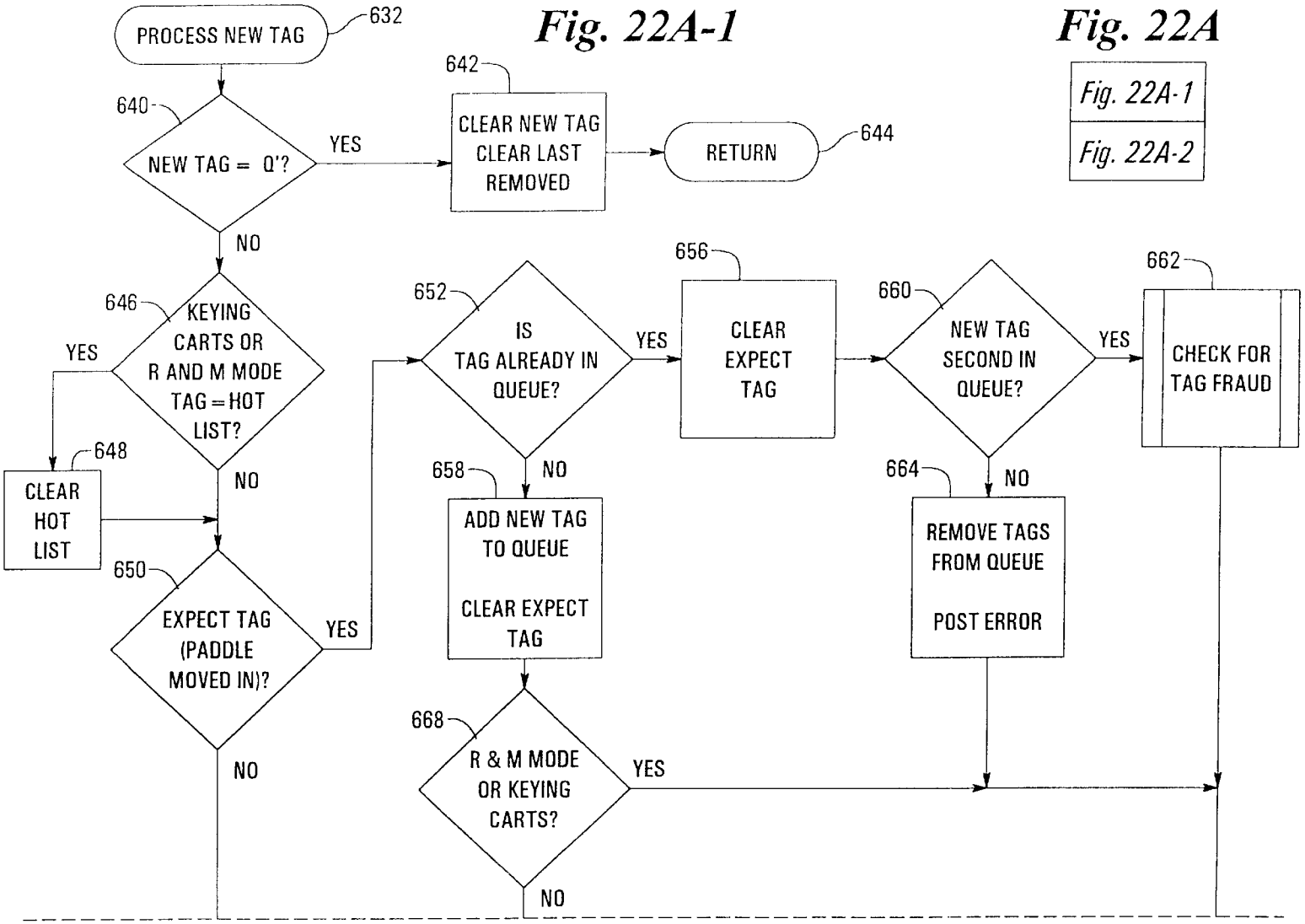
Fig. 22A
Fig. 22A-1
Fig. 22A-2
PROCESS NEW TAG
632
NEW TAG = 0'?
640
YES
NO
CLEAR NEW TAG
CLEAR LAST
REMOVED
642
RETURN
644
KEYING
CARTS OR
R AND M MODE
TAG = HOT
LIST?
646
YES
NO
CLEAR
HOT
LIST
648
EXPECT TAG
(PADDLE
MOVED IN)?
650
YES
NO
IS
TAG ALREADY IN
QUEUE?
652
YES
NO
CLEAR
EXPECT
TAG
656
ADD NEW TAG
TO QUEUE
CLEAR EXPECT
TAG
658
R & M MODE
OR KEYING
CARTS?
668
YES
NO
NEW TAG
SECOND IN
QUEUE?
660
YES
NO
REMOVE TAGS
FROM QUEUE
POST ERROR
664
CHECK FOR
TAG FRAUD
662

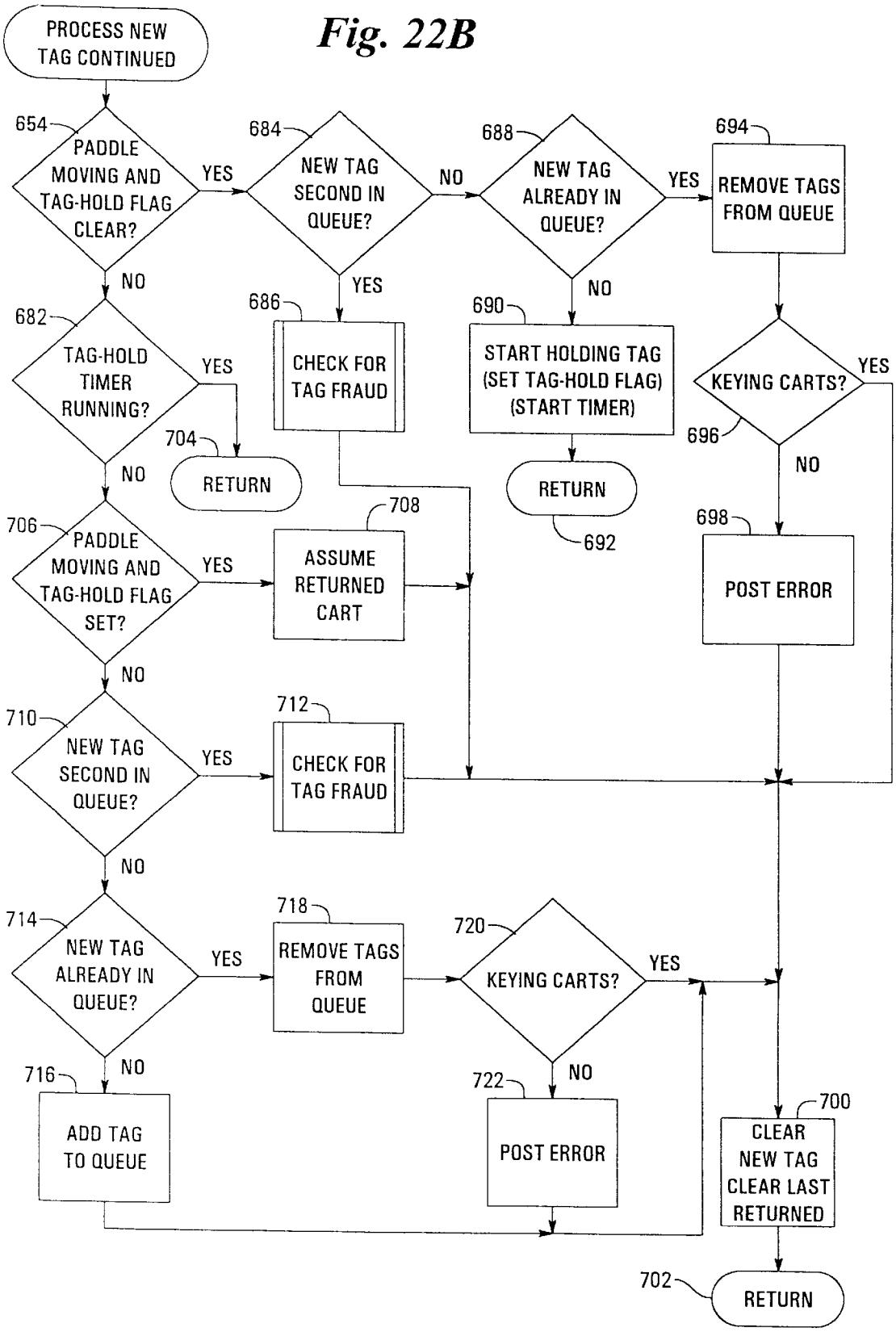
Fig. 22B
PROCESS NEW TAG CONTINUED
654
PADDLE MOVING AND TAG-HOLD FLAG CLEAR?
YES
NO
684
NEW TAG SECOND IN QUEUE?
YES
NO
686
CHECK FOR TAG FRAUD
688
NEW TAG ALREADY IN QUEUE?
YES
NO
690
START HOLDING TAG (SET TAG-HOLD FLAG) (START TIMER)
RETURN
692
694
REMOVE TAGS FROM QUEUE
KEYING CARTS?
696
YES
NO
698
POST ERROR
682
TAG-HOLD TIMER RUNNING?
YES
NO
704
RETURN
706
PADDLE MOVING AND TAG-HOLD FLAG SET?
YES
NO
708
ASSUME RETURNED CART
710
NEW TAG SECOND IN QUEUE?
YES
NO
712
CHECK FOR TAG FRAUD
714
NEW TAG ALREADY IN QUEUE?
YES
NO
716
ADD TAG TO QUEUE
718
REMOVE TAGS FROM QUEUE
720
KEYING CARTS?
YES
NO
722
POST ERROR
700
CLEAR NEW TAG CLEAR LAST RETURNED
702
RETURN

CART MANAGEMENT SYSTEM AND METHOD

CROSS-REFERENCE TO RELATED APPLICATIONS

This application is a continuation-in-part of U.S. Ser. No. 08/531,953, filed Sep. 21, 1995, now U.S. Pat. No. 5,921,373, which is a continuation-in-part of U.S. Ser. No. 08/306,638, filed Sep. 15, 1994, by Keith L. Amdahl et al., now U.S. Pat. No. 5,526,916 and entitled "CART MANAGEMENT SYSTEM", which are incorporated by reference herein.

FIELD OF THE INVENTION

The invention is directed to a system and method for the management of carts such as luggage carts, shopping carts, strollers and the like. More particularly, the invention is directed to an automated stand alone cart management system allowing for the storage, vending and return of a plurality of carts.

BACKGROUND OF THE INVENTION

Carts have a wide variety of applications in public places such as airports, shopping centers, parks, zoos, etc. For example, in airports, luggage carts have become popular for assisting air travelers with transporting luggage to and from planes and ground transportation.

A large public facility such as an airport may require hundreds or thousands of carts to satisfy the demands of air travelers. Many airports, especially in Europe, own and provide these carts as a service to their customers. However, the carts often become a nuisance in the airport as many customers do not return the carts to a central area after using them. Unreturned carts can be safety hazards and disrupt pedestrian and motor traffic. Further, the carts are often not maintained properly and can break down.

Automated cart management systems have become popular in the United States for managing and vending a large number of carts for use by the general public. These systems typically retain a number of carts within a track or rail, and allow for vending and return of carts without the need for a human attendant. An attendant is needed only to periodically check the system to collect currency and perform routine maintenance. Furthermore, cart management systems provide an additional source of revenue for an airport.

Most cart management systems use carts which are specifically designed for use in the systems. Many retain a wheel or a specialized "key" on a cart. Consequently, most cart management systems are sold as complete systems having specialized cart management units and carts.

Many public facilities, especially in Europe, already own carts but do not have cart management units for vending the carts. While these facilities would like to convert their own carts to automated systems, to date there have been few alternatives, short of purchasing a new cart management system with all new carts, for doing so. Therefore, there is a need for a cart management system which may be used to retrofit existing carts for incorporation therein in an automated system.

Cart management systems also provide an added benefit in that the number of unreturned carts left around a public facility is often reduced. Many cart management systems are designed to offer a "reward" for returning the cart to the system, which encourages customers to return their carts once they are done with them. Even if the customer who vended the cart does not return the cart, another person can collect the cart and return it for the reward. It has been found that the reward system significantly cuts down on the number of unreturned carts, thus reducing safety hazards and traffic congestion as a result of unreturned carts.

By providing the potential for rewards in a cart management system, however, hustlers may attempt to cheat the system and repetitively retrieve rewards by making the system think carts are being returned when in fact they are not. Many cart management units are susceptible to theft of large amounts of reward money as a result of clever hustlers. Therefore, a need has also arisen for a cart management system which is resistant to theft from hustled rewards.

Additionally, many cart management systems are controlled by an electronic control system executing proprietary software. When electronic control systems fail, however, it is often difficult and costly to replace these control systems. Moreover, important statistical data regarding the cart management system may be lost in the replacement. Similar problems exist should it be desired to upgrade the electronic control system or any other peripheral components controlled by the control system of the cart management system.

The difficulty and cost of replacing electronic control systems for cart management systems is often exasperated because different models of cart management systems may be available from any single provider. Additionally, systems may use different peripheral components manufactured by different vendors, such as bill readers, card readers, coin readers, coin dispensers, retaining mechanisms, etc., each of which may require specialized software and/or electronics to communicate and in general operate with the primary controller of a cart management system.

With hustlers become more and more clever in attempting to get rewards from a cart management system, a further enhanced fraud prevention mechanism is needed. A clever hustler tries to manipulate the electronics of the system into thinking that a valid cart has been returned. For example, a hustler returns a tag without returning a cart to which the tag is attached; a reward is issued by the CMU because the CMU knows the tag is not in the queue. But once the tag has been entered into the queue, the CMU will not give a second reward for the second try of the same tag. The problem is that when the next cart is rented and validly returned, hustler's prior tag can be used again to get a reward. A clever hustler would, instead of waiting for the next rented cart being validly rented by another customer, rent the next cart himself so that the hustler's prior invalid tag can be used again to get the reward. This type of hustler return situation can be repeated again and again until the CMU is out of money. Therefore, there is a need for a cart management system which is resistant to theft from the cleverly hustled rewards.

Therefore, a substantial need also exists for an electronic control system for a cart management system which is easier and less expensive to replace or upgrade, and which is capable of retaining important statistical information regarding the cart management system even when replaced or upgraded.

SUMMARY OF THE INVENTION

The invention addresses these and other problems associated with the prior art in providing an automated cart management system which is readily usable with a variety of carts, even existing carts not specifically designed and manufactured for use in the cart management system. Preferred systems retain cart keys attached to carts in a retaining rail, and utilize a paddlewheel mechanism to selectively control the vending and returning of carts. Furthermore, sophisticated and substantially fault-free electronic control over the vending and returning of carts is provided through the use of various position and proximity sensors. Consequently, the invention is particularly well suited for facilities owning one or more different types of carts as these carts may all be integrated into a single automated cart management system which is resistant to "hustling", particularly to the theft of rewards which are dispensed by the system.

In preferred embodiments of the invention, a cart or key identification sensor is used to uniquely identify carts retained by the system. This permits a queue of retained carts to be maintained and analyzed during vend and return operations to ensure that rewards are dispensed only in response to return of a valid cart to the system.

Therefore, in accordance with one aspect of the invention, a cart management system for vending carts is provided. The cart management system includes a cart key mounted to a cart at a predetermined height; retaining means for selectively retaining the cart key; and key identification sensing means for identifying the cart when the cart key is retained by the retaining means. The key identification sensing means includes first transmitting means, disposed within the cart key, for providing an identification signal indicative of the cart; and first receiving means, coupled to the retaining means, for detecting the identification signal when the cart key is retained by the retaining means.

In accordance with another aspect of the invention, a cart management system is provided for vending a plurality of carts. The cart management system includes retaining means for selectively retaining at least one of the plurality of carts; a cart identification sensor for uniquely identifying carts retained by the retaining means; and control means, coupled to the retaining means and the cart identification sensor, for controlling the vending and return of carts, wherein the control means maintains a queue of carts identified by the cart identification sensor and retained by the retaining means.

In accordance with an additional aspect of the invention, a method is provided for vending carts in a cart management apparatus of the type including retaining means for selectively retaining at least one of a plurality of carts, the retaining means including a rotatably mounted paddlewheel including a plurality of paddles extending radially from a rotational axis thereof, the paddlewheel being rotatable to a plurality of discrete positions. The method includes the steps of sensing a position of the paddlewheel; identifying a cart inserted into the retaining means by reading a tag disposed on the cart to determine whether the cart is a valid cart; and dispensing a reward when a valid cart is identified and a rotation of the paddlewheel to an adjacent discrete position is sensed.

This invention also addresses additional problems associated with the prior art in providing an electronic control system for a cart management system which utilizes a removable universal control unit coupled with a non-volatile audit memory which is permanently mounted within the cart management system. Statistical and configuration information is stored in the audit memory, and may be automatically downloaded to the universal control unit when the unit detects that it has been inserted into a new cart management system.

Therefore, in accordance with an additional aspect of the invention, a cart management system is provided for vending carts. The cart management system includes a permanently mounted non-volatile audit memory for storing system parameters; and an electronic control unit coupled to the audit memory, the control unit including update means for automatically updating the electronic control unit with the system parameters stored in the audit memory when the electronic control unit does not match the audit memory; whereby the system parameters are restored upon replacement of the electronic control unit.

In accordance with another aspect of the invention, a cart management system is provided for mechanism for determining and reporting a pattern of queue adjustments in connection with a hustler's fraudulent serial cart tag activity and as a result denying a reward to the hustler. In one embodiment, the cart management system for vending and returning carts includes retaining means for selectively retaining at least one of the carts; a cart identification sensor for uniquely identifying carts retained by the retaining means; control means controlling the vending and returning of carts, wherein the control means maintains a queue of carts identified by the cart identification sensor and retained by the retaining means; reward means for dispensing a reward when a cart is returned to the retaining means; and means for counting a number of times that an identification of the cart is missed from the queue of carts so as to prevent the reward means from dispensing a reward when the number of times exceeds a predetermined value of the means.

In accordance with an additional aspect of the invention, a method is provided for determining and reporting a pattern of queue adjustments in a queue management system. The queue management system managing a queue of objects includes an identification sensor for uniquely identifying the objects; control means for maintaining the queue of objects identified by the identification sensor; and a pattern detector determining a pattern when a number of deviations from a predetermined queue have occurred so as to prevent a regular subsequent event directly by the control means from happening. In addition, the queue management system can be used for manufacturing purposes or for monitoring a queue for security purposes. It is appreciated that such a pattern detection or diagonosis method can be implemented in other types of applications to prevent thefts or other related activities. It is also appreciated that such a pattern detection mechanism can be implemented in other fields of applications without departing from the spirits or scopes of the present invention.

In one embodiment of the cart management system, a counter is set for counting the number of times that a missing cart tag situation occurs. When a cart tag missing from the queue is detected, the counter counts. If this missing cart tag is detected to be missing from a CMU queue by some set number of times, the cart tag is put on a HOT LIST™ so that the CMU will deny a reward for any future return by this cart tag.

In an alternative embodiment, the cart management system is applied to more than one cart management unit on a local area network (LAN) such that the information, such as the HOT LIST™, can be shared among all of the CMUs connected to the LAN.

One advantage of the alternative cart management system using a counter or its equivalents to establish a fraudulent cart returned HOT LIST™ is that the system is able to avoid recording a cart tag of a validly taken cart, usually by an operator (employee), on the HOT LIST™. If the system only relies on that the CMU queue manages every cart ID number and denies rewards for a cart if it is found to be missing from a queue, an embarrassment may arise when a cart is removed from a CMU system by an operator (employee) without it being rented and so it is placed on the HOT LIST™. This cart then becomes a HOT LIST™ cart (bad cart) in the fleet of carts such, for any one later making a valid rental and return of this cart, a reward is denied. This will cause upset customers for not getting a reward after renting and/or returning a cart. Trying to locate one bad cart among thousands of carts is a very difficult task.

One of another advantages of the alternative cart management system using a counter or its equivalents is that it avoids accidentally placing a cart tag on a queue HOT LIST™ due to, sometimes, imperfect electronics and mechanics failures which cause the CMU to become defective.

It should be understood that as electronics become more and more advanced, and hustlers become more and more intelligent, the feature of watching the queue for patterned mis-adjustments can be modified to include several situations similar to the example described above.

These and other advantages and features, which characterize the invention are pointed out with particularity in the claims annexed hereto and forming a part hereof. However, for a better understanding of the invention and the advantages and objectives obtained by its use, reference should be made to the drawing which forms a further part hereof and to the accompanying descriptive matter, in which there is described a preferred embodiment of the invention.

BRIEF DESCRIPTION OF THE DRAWING

FIG. 15 is a flowchart diagram showing the operation of the RETURN CART routine of FIG. 14.

FIG. 16 is a flowchart diagram showing the operation of the VEND CART routine of FIG. 14.

FIG. 17 is a flowchart diagram showing the operation of the KEY CARTS IN/OUT routine of FIG. 14.

FIGS. 22A and 22B are a flowchart diagram showing the operation of a PROCESS NEW TAG routine for the alternative cart management system having a pattern detector.

DETAILED DESCRIPTION OF THE PREFERRED EMBODIMENTS

Figure 1A:
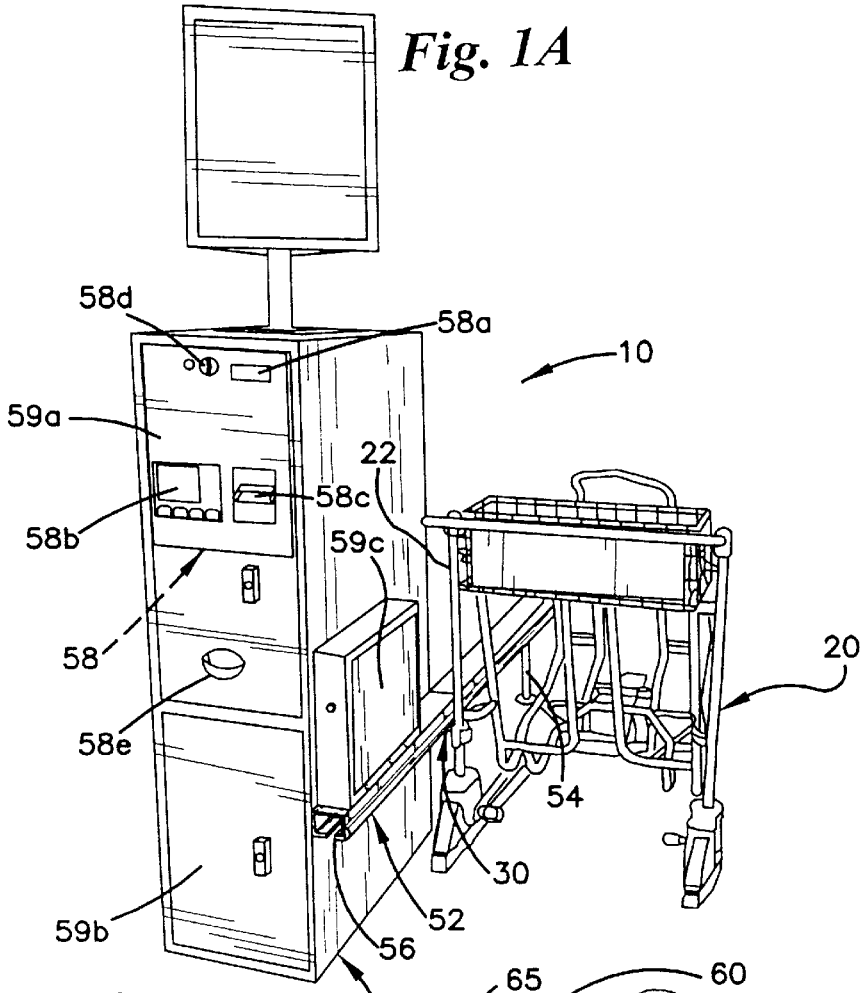
FIG. 1*a* is a perspective view of a preferred cart management system consistent with the invention.
Figure 1B:
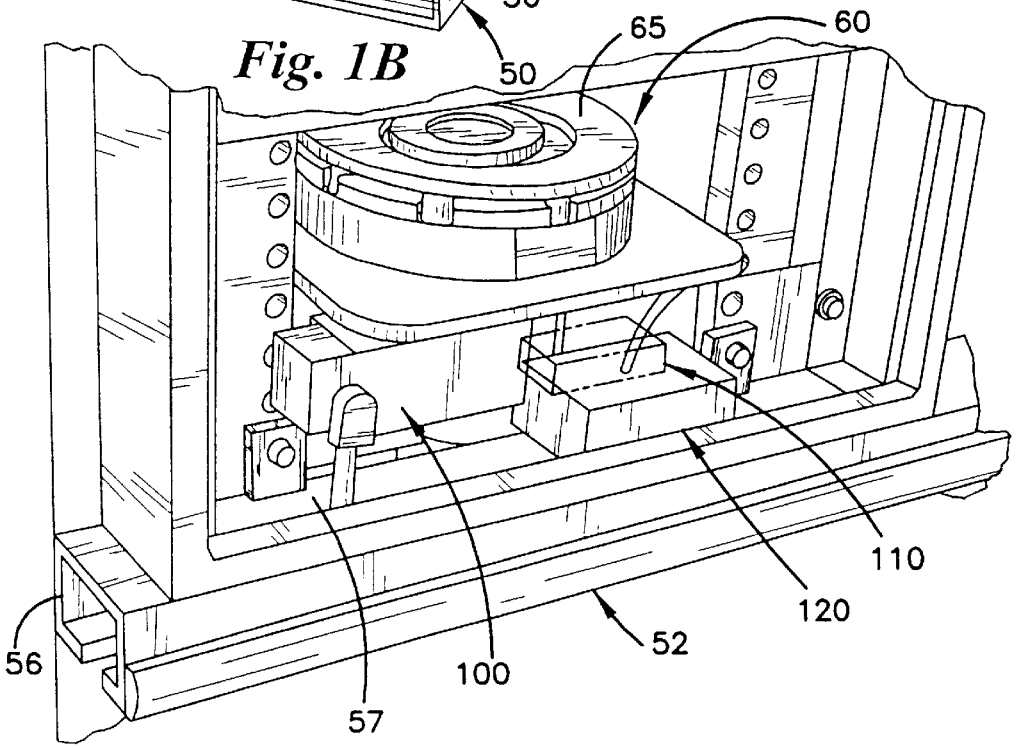
FIG. 1*b* is an enlarged partial fragmentary perspective view of the cart management system of FIG. 1*a*, with an access panel removed therefrom showing the paddlewheel mechanism and sensors retained therein.

Turning to the Drawing, wherein like numbers denote like parts throughout the several views, FIGS. 1*a* and 1*b* show a preferred cart management system 10 consistent with the invention, including a cart management unit 50 for retaining and vending a plurality of carts such as luggage cart 20. Cart management unit 50 includes a retaining rail 52, supported off the ground by a plurality of supports 54, for receiving and vending carts through an open end 56 thereof. A paddlewheel mechanism 60 projects into the retaining rail to control the insertion and removal of carts into and out of the system, and a controller 58 provides electronic control over system 10, including controlling paddlewheel mechanism 60, accepting currency and dispensing rewards.

Cart 20 is preferably a nestable luggage cart, such as those available from a number of vendors, including Smarte Carte, Inc. Other types of carts, including shopping carts, strollers, etc. may also be used consistent with the invention. Furthermore, while the preferred carts are nestable to reduce the amount of rail needed to retain a number of carts, non-nestable carts may also be used.

Figure 2:
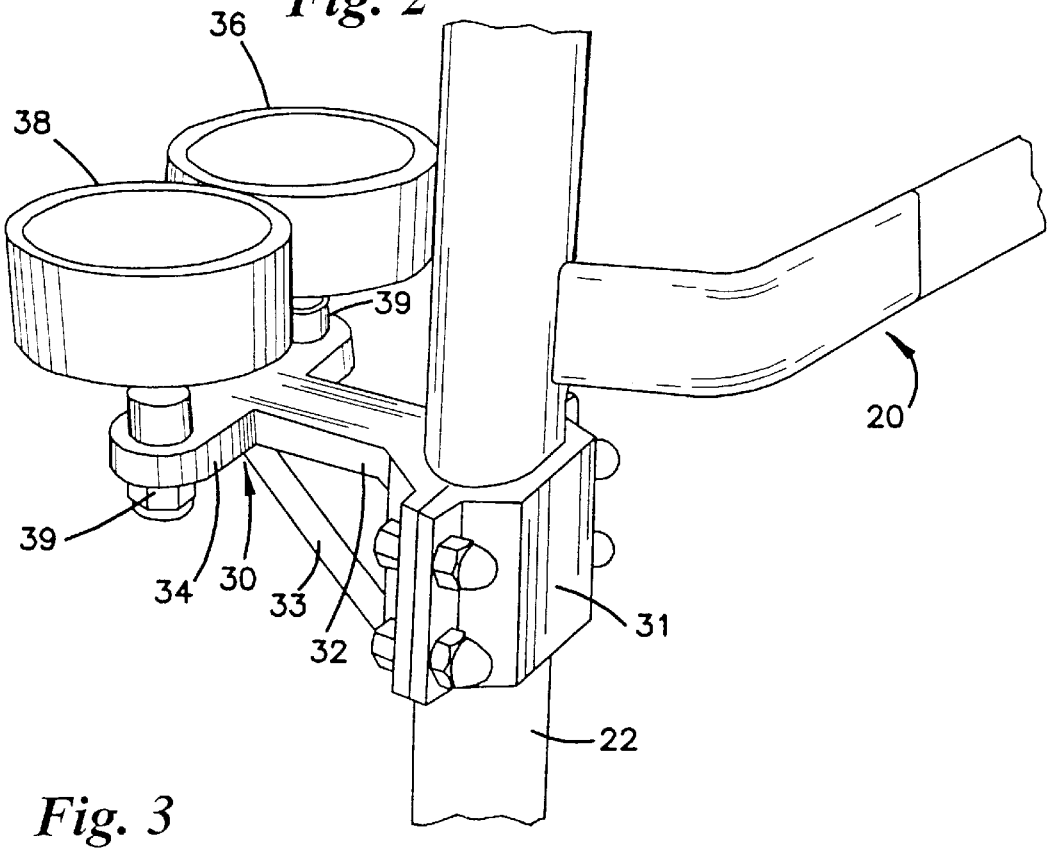
FIG. 2 is a partial fragmentary perspective view of the cart key of FIG. 1*a*.

A cart key 30 is utilized on cart 20 to cooperate with retaining rail 52 in retaining cart 20 in cart management unit 50. As shown in FIG. 2, key 30 includes a mounting bracket 32 with saddle clamp 31 that removably fixes key 30 on an upward support 22 near the rear of cart 20 at a predetermined height from the ground surface. The height of key 30 preferably ranges from about 9 to 14 inches, more preferably about 12 inches in height. Alternate mounting methods, including permanent mounting methods such as welding may be used to mount key 30 to cart 20.

Cart key 30 may be installed on luggage carts, shopping carts, strollers, etc. Furthermore, it may be installed at different places on a cart, including vertical or horizontal supports, wheel housings, or baskets of a cart. It will be appreciated that the design of the key clamp will vary accordingly with the placement of the key on a cart. In addition, it will be appreciated that the wheels of the carts themselves may be used as the keys for retaining the carts in the retaining rail.

The preferred design of cart key 30 therefore enables carts which are not integrated into an existing cart management system (and thus do not have keys mounted thereon), as well as carts integrated into other automated systems (having other keys mounted thereon), to be utilized in the preferred cart management system 10. Consequently, the preferred system 10 may be utilized as a significantly standardized system for use with a wide variety of carts. It will be appreciated, however, that the preferred system 10 may also utilize new carts which are specifically designed for use with the system.

Cart key 30 includes first and second rollers 36 and 38 rotatably mounted to a base portion 34 of bracket 32 through bolts 39. A support 33 may also be used to reinforce base 34 against saddle clamp 31.

Rollers 36 and 38 are preferably made of a plastic such as Versathane® polyurethane. Other materials, including Nylon may also be used. First roller 36 preferably includes electronics (discussed below) which provide an identification signal utilized by cart management unit 50 to identify the particular cart to which key 30 is attached. In the preferred embodiment, however, second roller 38 is inactive, i.e., no electronics are included therein.

The two roller construction of key 30 offers several benefits. First, the longitudinally aligned rollers help in centering the key in retaining rail 52. Furthermore, the rollers facilitate the movement of cart 20 along the rail, by rolling against the internal sides of the rail, by maintaining the key centered in the rail, and by preventing the cart from being twisted while the key is retained in the rail. The use of a second roller also has the benefit of preventing the first roller from being pulled back into proximity with a sensor once the key is inserted into the rail, providing one of the hustler-prevention measures in the preferred system 10 (discussed in greater detail below).

Rollers 36 and 38 are preferably rotatable on base 34. As discussed above, by being rotatable, movement of the key along the retaining rail is facilitated. However, the rollers may be replaced by fixed members, although greater friction may result within the rail.

Figure 3:
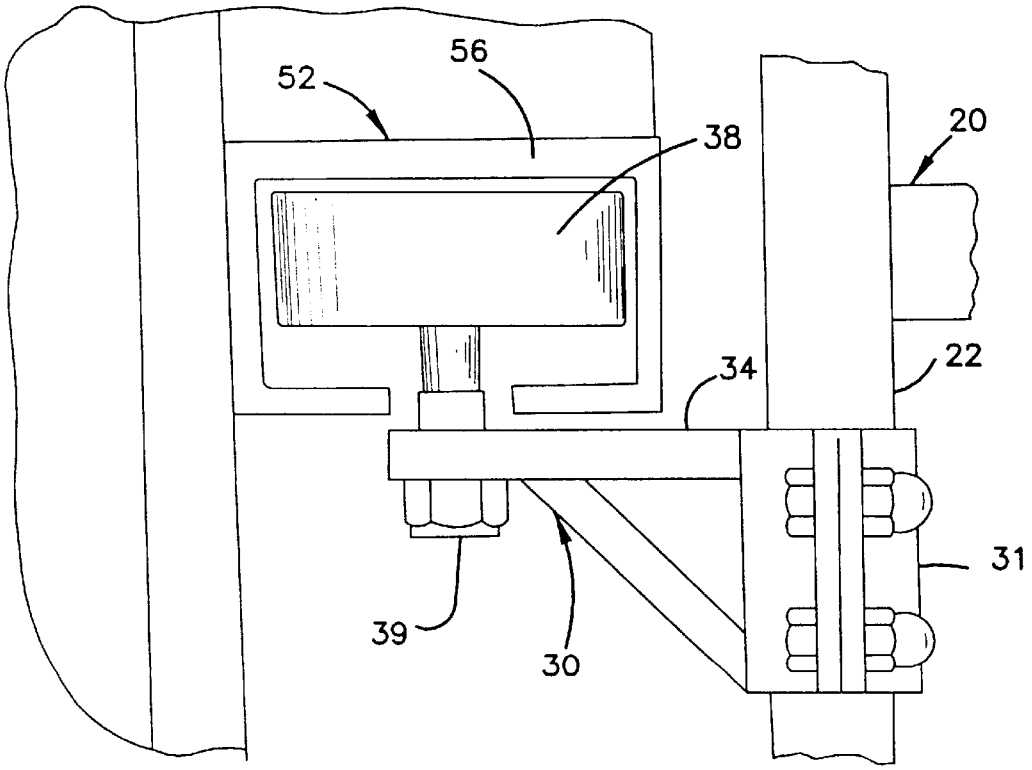
FIG. 3 is an end elevational view through the open end of the retaining rail, showing a cart key retained therein.

In addition, rollers 36 and 38 preferably rotate about vertical axes. As seen in FIG. 3, this arrangement provides a degree of clearance within rail 52 to compensate for variations in key height between carts, or to compensate for variations in ground surfaces (e.g. bumps or cracks) which may vary key height as a cart rolls down the retaining rail. Carts may be significantly less likely to catch in the retaining rail as a result of key height imperfections with this design. It will be appreciated that the rollers could instead rotate about horizontal axes (or may even be the wheels of the cart themselves) consistent with the invention.

Returning to FIG. 1*a*, cart management unit 50 is used to retain and control the vending of carts 20. Unit 50 includes a controller 58 which provides electronic control over the vending, return, reward and change dispensing, and payment functions of cart management system 10. The primary operational components of controller 58 will be discussed below with relation to FIG. 8; however, the components shown in FIG. 1, which make up the user interface for system 10, will be described briefly.

A display 58*a* is included to provide prompts and convey information to a user. Display 58*a* may be any of a number of types of alphanumeric displays, including LED, LCD, Vacuum, or CRT displays, for example a 16 character No. L2014B1J000 LCD display manufactured by Seiko.

Payment is accepted from a customer through one of three mechanisms. The first, card reader 58*b* accepts payment from a credit or debit card, which may also include a modem and communications link to verify a card before accepting payment. One preferred card reader is the EasyReader card reader manufactured by CommStar, Inc. The second, bill reader 58*c* accepts payment from the insertion of dollar bills in different denominations. One preferred bill reader is the CBA-2 bill reader manufactured by Rowe. The third, coin reader 58*d* accepts payment in coin currency. One preferred coin reader is the C235 Sentinal coin reader manufactured by Coin Controls. The use and operation of each of these types of readers is known in the art, and it will be appreciated that payment may be accepted in any combination of the above devices.

The user interface for controller 58 also includes a change dispenser 58*e* which returns change and/or rewards to a customer in coin currency, such as the Mark II change dispenser manufactured by Coin Controls. Change and rewards may also be returned by a bill dispenser or by crediting a credit or debit account; however, typically a return in coin currency is sufficient for most situations.

Several access panels are also provided on unit 50 for performing routine maintenance of the system. For example, three access panels 59*a*, 59*b* and 59*c* are shown in FIG. 1. The panels are preferably locked to permit access only to authorized personnel. It will be appreciated that the arrangement and number of panels may vary.

A retaining rail 52 is supported by a number of vertical supports 54 at a predetermined height. As shown in FIG. 3, rail 52 is preferably rectangular in cross section with a downwardly open slot extending along the length of the rail. It will be appreciated that the height and cross-sectional shape of the rail will be dictated primarily by the height and shape of keys 30 on carts 20. For example, if the keys include rollers which rotate about horizontal axes, the slot in the rail would be open to the side of the rail.

The length of rail 52 will vary depending upon the number of carts which are to be retained. The rail is preferably a modular design, whereby fixed lengths of rails may be joined together in any manner known in the art to provide the necessary length.

The preferred system 10 utilizes a single unit 50 to vend and return carts, resulting in last in-first out cart vending. Consequently, rail 52 is preferably open only at one open end 56, with the opposite end otherwise obstructed. However, an alternate embodiment may include separate control units at each end of the rail for first in-first out vending, whereby carts would be returned at one end of the system and vended at the other end.

Figure 4:
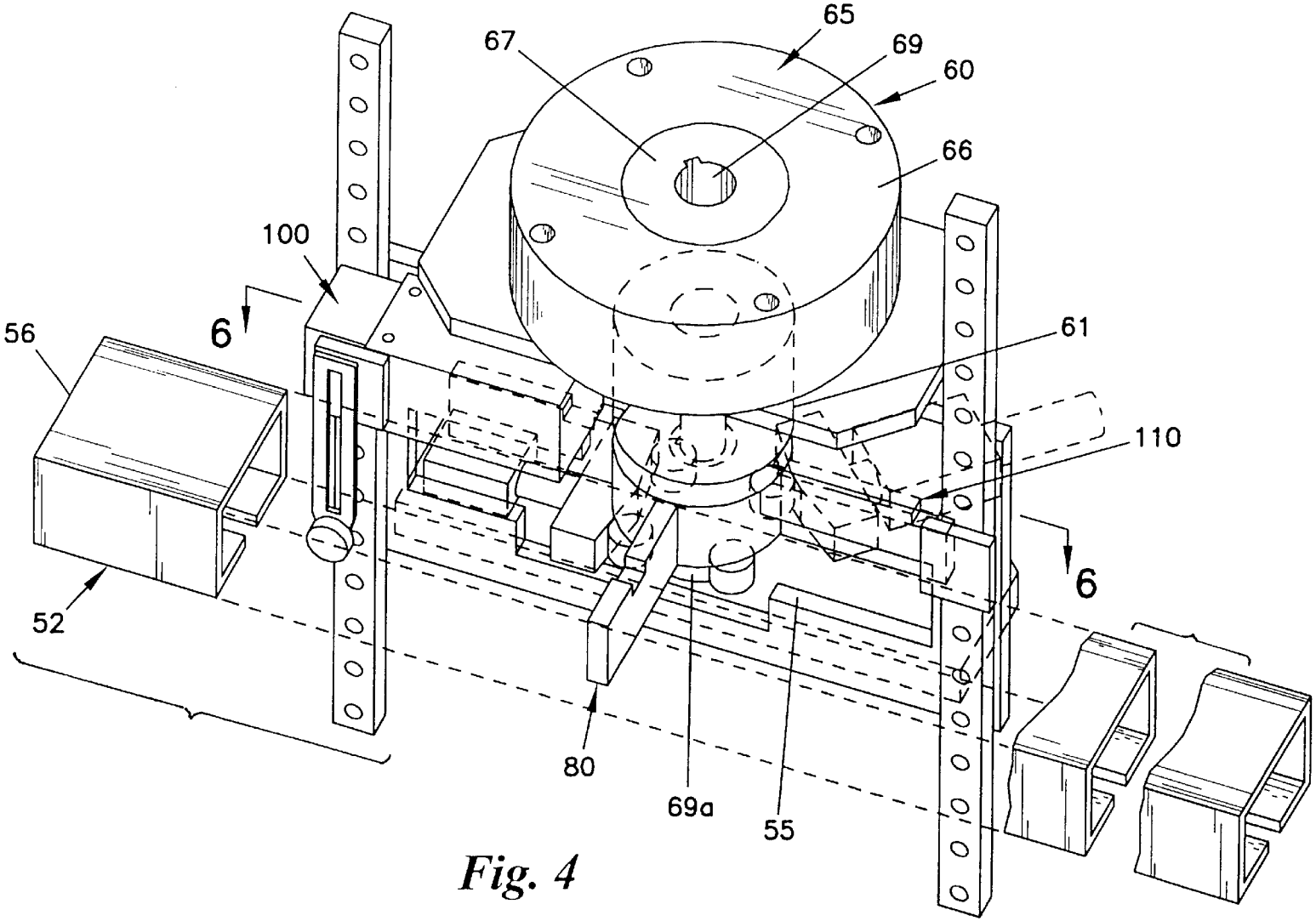
FIG. 4 is a partial fragmentary perspective view of the retaining rail, paddlewheel mechanism and sensors for the cart management system of FIGS. 1*a* and 1*b*.
Figure 5A:
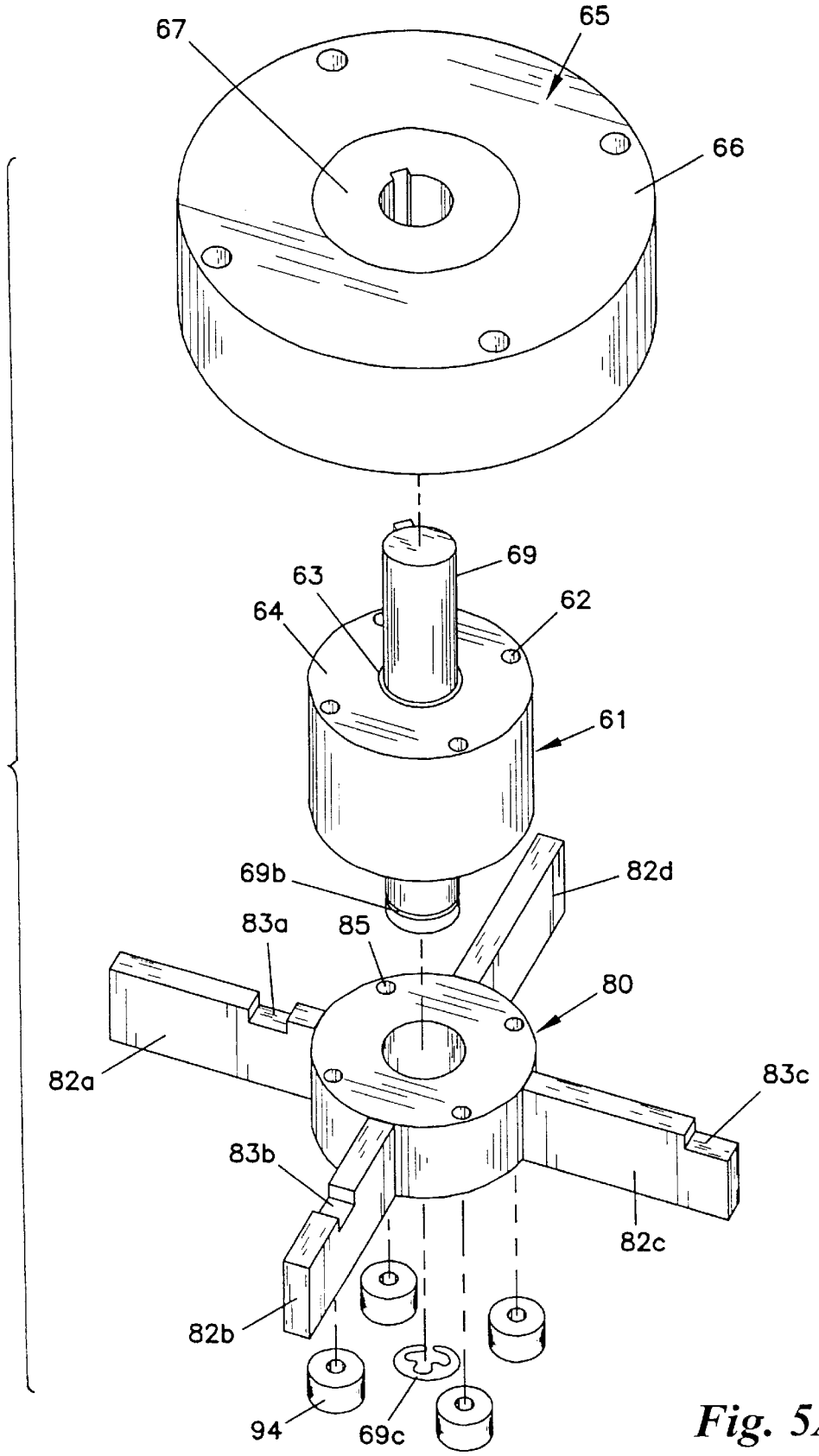
FIG. 5*a* is an exploded perspective view of the paddlewheel mechanism of FIG. 4.

As shown in FIG. 4, a paddlewheel mechanism 60 provides an obstruction in retaining rail 52 through an access aperture 55 in the rail. As best shown in FIG. 5*a*, the primary components of paddlewheel mechanism 60 are paddlewheel 80, one-way clutch 61 and electromagnetic brake 65.

Figure 5B:
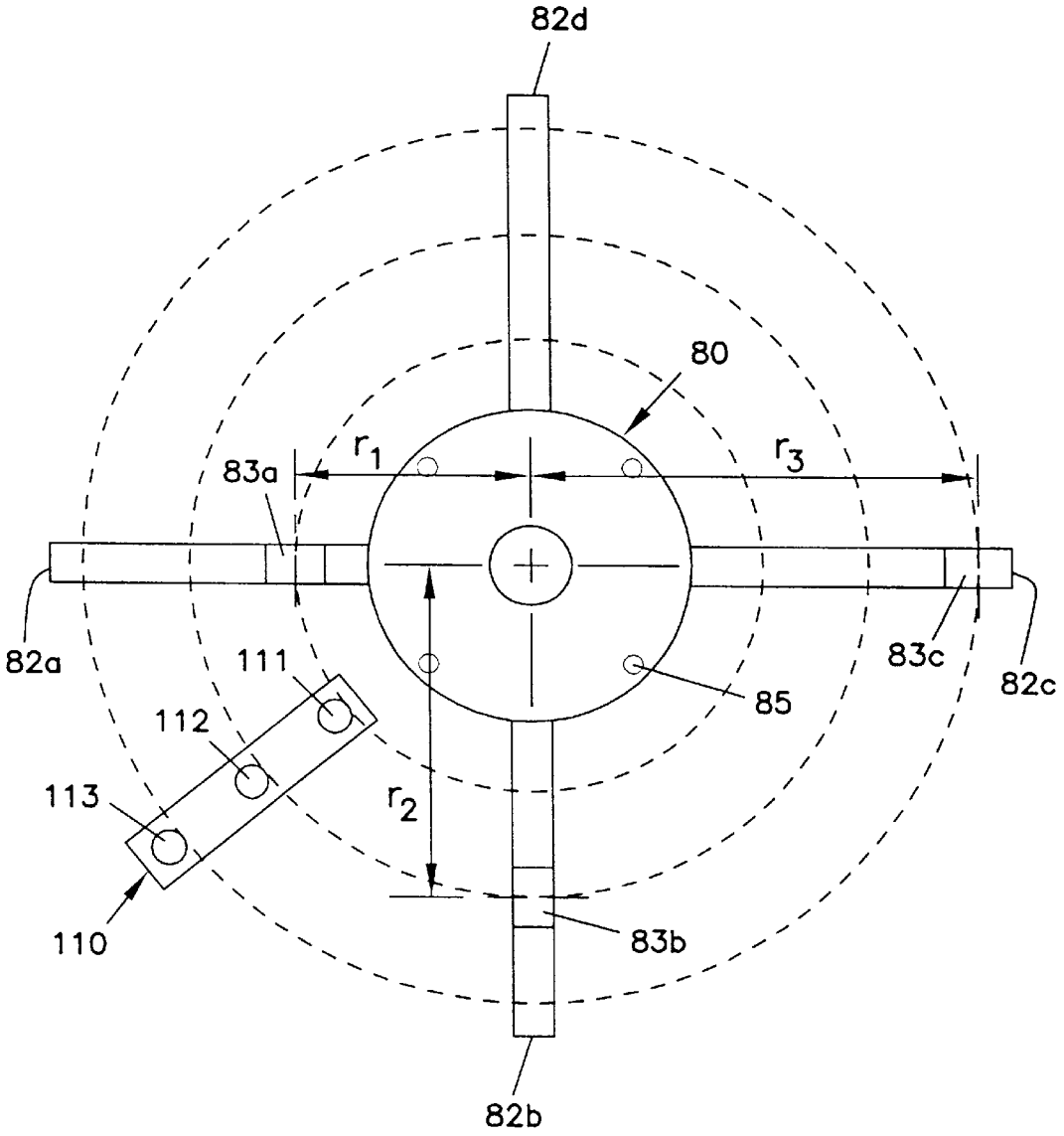
FIG. 5*b* is a top plan view of the paddlewheel of FIG. 5*a*.

FIGS. 5*a* and 5*b* show paddlewheel 80 in greater detail. Paddlewheel 80 preferably includes four paddles 82*a–d* radially extending from the rotational axis of the paddlewheel. Any number of paddles, e.g., as few as two, may be used. Further, paddlewheel 80 preferably rotates about a vertical axis, which enables the rollers of cart key 30 to roll along the paddles as the key is pushed through the rail past paddlewheel mechanism 60, thereby reducing the friction encountered by the cart key in the rail. Consequently, for rollers which rotate instead about horizontal axes, paddlewheel 80 may rotate about a horizontal axis as well. Alternatively, paddlewheel 80 may rotate about a transverse axis to that of key rollers 36 and 38.

Paddles 82*a–d* of paddlewheel 80 preferably engage a cart key through access aperture 55 in retaining rail 52. Alternatively, the paddles may engage other components of a cart, either retained within a secondary retaining rail or not, e.g., coupled with a cart key retained in rail 52.

One-way clutch 61 includes a slotted member 63 which is rotatable in a main housing 64 mounted to paddlewheel 80 through a plurality of bolts extending through apertures 85 and 62 in paddlewheel 80 and housing 64, respectively. A shaft 69 is in turn coupled to the slotted member 63, which has a slotted aperture therein for cooperatively retaining a key on shaft 69.

One preferred design for clutch 61 is an over-running/indexing/backstopping type clutch, such as the FSO 300 clutch manufactured by Warner Electric. This type of clutch permits paddlewheel 80 and clutch main housing 64 to rotate in a counterclockwise direction with respect to shaft 69 and slotted member 63 (when viewed from the top). This enables the paddlewheel to rotate freely when a cart key is being inserted into retaining rail 52 (i.e., in an insertion or returning direction) as a cart is being returned.

The lower end of shaft 69 is retained by a bearing 69*a* (shown in FIG. 4) that secures the shaft in the unit while permitting shaft 69 to rotate in relation thereto. The lower end of shaft 69 also includes an annular groove 69*b* (FIG. 5*a*) which is secured by a Waldes Truarc #5133-74 e-ring circular clip 69*c*, which supports clutch 61 and paddlewheel 80 on shaft 69. The opposite end of shaft 69 projects through an electromagnetic brake 65 and is retained by a slotted member 67 which is selectively rotatable within a main housing 66. Brake 65 selectively inhibits rotation of paddlewheel 80 to restrict removal of a cart key from rail 52 in a removal or vending direction.

Brake 65 is preferably an electrically actuated spring applied friction brake which is normally biased to a locked stated in the absence of an electrical control signal, such as the ERS-68 electromagnetic brake manufactured by Warner Electric. Upon the application of an electrical signal (at least 24 VDC in the case of the preferred brake), slotted member 67 is permitted to rotate freely within housing 66. In the alternative, electromagnetic brake 65 may be biased normally to an unlocked state; however, in such a case, the brake would draw more power since the brake is typically locked the majority of the time, being unlocked only when a cart is vended.

Different locking mechanisms may be used in the alternative to electromagnetic brake 65. Examples include solenoid and controlled mechanical mechanisms, ratchet release control mechanisms, etc.

Either the one-way clutch or the electromagnetic brake may be used independent of the other in the control of paddlewheel 80. However, it has been found that the combination clutch and brake offers simple, efficient and low power control over paddlewheel 80. For example, the one-way clutch enables carts to be returned without applying power to the brake, since the clutch permits rotation of the paddlewheel in an insertion direction. In addition, since the clutch permits free rotation in this direction, certain components of the system such as key identification sensor 120 do not need to be continuously active to sense when a cart is being returned, rather, the insertion of the cart itself can be detected by a sensor to "wake up" the system to handle the cart return and reward operations. With this configuration, the only time in which power need be applied to the brake is when a cart is being vended, after sufficient currency has been inserted by a customer. Consequently, less power is utilized by the system. Further, the system is more reliable given that a cart can only be released from the system only when power is applied to brake 65 by controller 58.

A centering mechanism is also preferably incorporated in paddlewheel mechanism 60 to center the paddlewheel at predetermined positions, preferably with a paddle projecting into retaining rail 52 generally orthogonal to the longitudinal axis thereof. By maintaining the paddlewheel at predetermined positions when at rest, the position of the paddlewheel is significantly easier to detect and control with less complex and expensive sensors. Otherwise, a positional sensor may be incorporated into the paddlewheel mechanism to provide a signal representative of the precise angular position of the paddlewheel; however, such a sensor would most likely be more expensive and complex, and would require more elaborate software control by controller 58.

Figure 6:
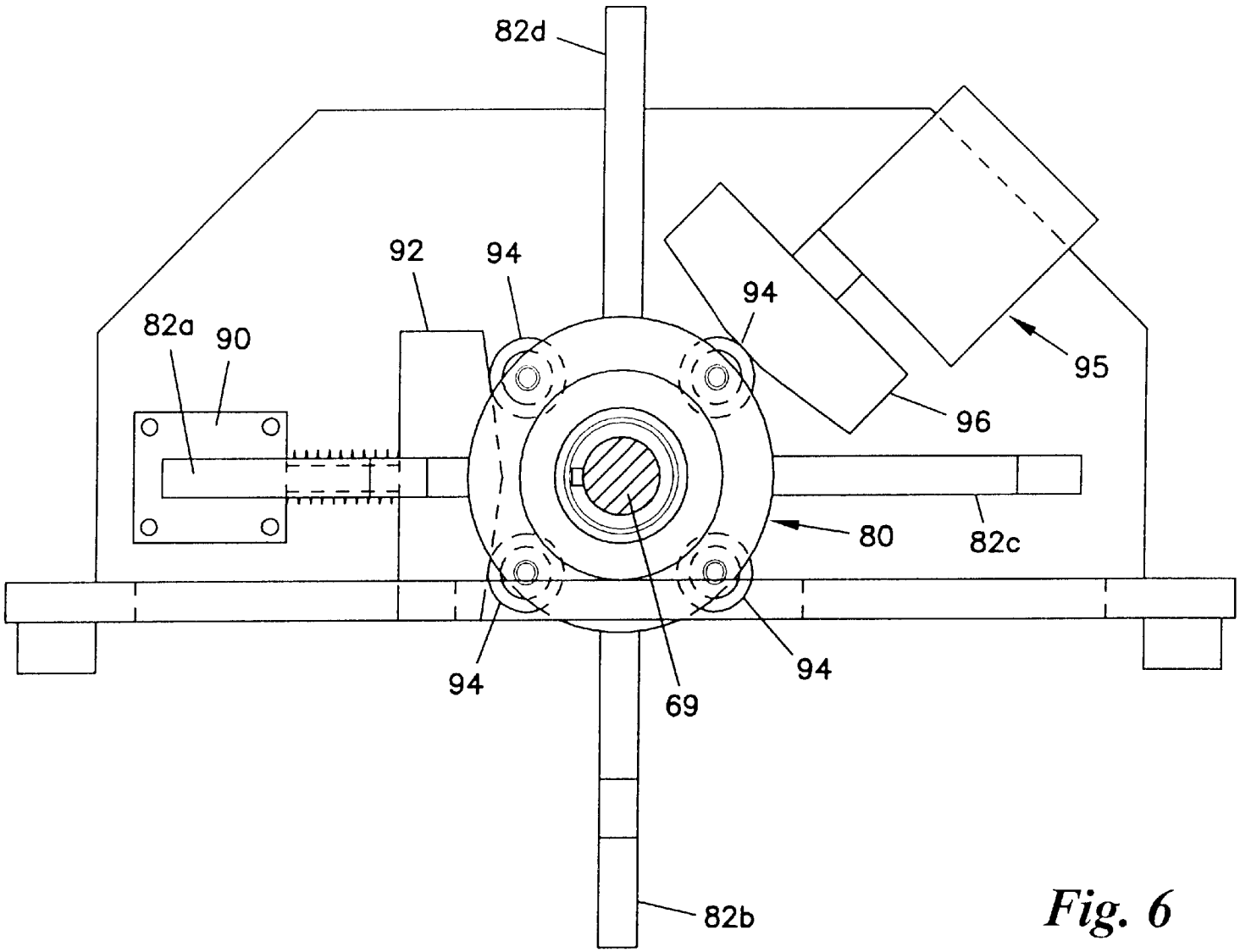
FIG. 6 is a top cross-sectional view of the centering mechanism and dampening mechanism for the paddlewheel mechanism of FIG. 4.

As shown in FIG. 6, in the centering mechanism, a spring-loaded centering device 90 engages a plurality of cam follower rollers 94 coupled to the paddlewheel 80. Centering device 90 includes a spring loaded cam 92 having tapered edges which engage the cam follower rollers 94 and urge the paddlewheel to one of four positions. In the preferred embodiment, the cam edge is formed by a pair of planar surfaces joined at an apex. However, it will be appreciated that other known edge profiles, including curved, may be used to vary the camming action applied by the device on paddlewheel 80.

Cam follower rollers 94 are preferably rotatably mounted on bolts threaded through the underside of paddlewheel 80. The number, spacing and placement of the rollers will be dependent upon the number of paddles and the desired centering action (e.g., the amount of centering force applied) applied by the mechanism. For four paddles, four evenly positioned rollers 94 are preferred, with the desired angular positions of the paddlewheel being at the midpoints between adjacent pairs of rollers. The paddlewheel will be urged to the point at which the compression of the spring in centering device 90 is minimized, which is at these midpoint positions since cam 92 of device 90 is the least compressed at these positions.

It will also be appreciated that the rollers may be fixably mounted to the paddlewheel/clutch assembly. However, this would increase the friction between rollers 94 and centering device 90, thus making the paddlewheel harder to turn.

A dampening mechanism may also be optionally incorporated in paddlewheel mechanism 60 to smooth out the rotation of the paddlewheel. It has been found that due to the centering force applied by the centering mechanism, the paddlewheel may have the tendency to overshoot the predetermined rotational position. Through the use of a dampening mechanism, the conversion of the potential energy stored in the centering mechanism to the kinetic energy of the paddlewheel is tempered, whereby the rotation of the paddlewheel induced by the centering mechanism is moderated to prevent the paddlewheel from overshooting the predetermined positions.

The dampening mechanism utilizes a damper device 95 having a cam 96 which is similar in configuration to cam 92 of centering device 90, having tapered edges which can have many different cam surface profiles. Cam 96 moves relative to damper device 95 through a hydraulic piston and cylinder assembly, e.g., an air cylinder similar in operation to a shock absorber, such as the MC150 manufactured by Ace Controls Inc. This type of assembly is resistant to changes in velocity, thereby providing relatively uniform motion for cam 96, and consequently, uniform motion for paddlewheel 80.

The dampening mechanism also utilizes cam follower rollers 94 which are rotatably mounted on the underside of paddlewheel 80. The dampening device 95 is preferably oriented about 45 degrees (or alternatively, at 135, 225 or 275 degrees) offset from the position of centering device 90. In this orientation, the maximum dampening effect of the dampening mechanism is coordinated with the position of maximum potential energy for the centering mechanism. In an alternate embodiment, rollers 94 may be mounted to the top side of paddlewheel 80, or to a separate member which rotates in cooperation with the paddlewheel. Further, separate rollers may be used for the dampening and centering mechanisms, respectively, however, it has been found that the use of a single set of rollers reduces the number of parts and permits easier assembly.

Returning again to FIG. 1*b*, cart management system 10 uses a plurality of sensors for tracking the movement of carts through the retaining rail 52. A first sensor, cart in/out sensor 100, is mounted proximate end 56 of retaining rail 52 in a sensor aperture 57. This sensor includes an arm projecting into rail 52. A cart key moving past sensor 100 engages the arm and rotates it about an axis transverse to the longitudinal axis of the rail.

Sensor 100 is preferably a two-way sensor which provides separate signals for detecting whether a cart key is moving in or out of rail 52. This type of sensor is exemplified by the Limit Switch manufactured by Micro Switch. Other known sensors, including mechanically actuated, magnetic, or capacitive proximity sensors, etc. may be used, further including binary sensors which only detect whether a key is present, rather than detecting the direction in which the key is moving. In addition, sensor 100 may be omitted, with its functions instead incorporated into the software and the other sensors.

Sensor 100 is used to count carts in and out of the system. Furthermore, sensor 100 may be used to activate controller 58 to turn on key identification sensor 120, among other operations (e.g., wake the controller from a "sleep" state) when a cart key is inserted into rail 52. Consequently, substantially automatic operation is provided since a user does not need to manually activate the system prior to returning the cart.

As best shown in FIG. 4, and functionally in FIG. 5*b*, a second sensor, a paddlewheel position sensor 110, is used to detect which paddle 82*a–d* is positioned within retaining rail 52. In the preferred embodiment, three separate proximity detectors 111, 112 and 113 are used to detect notches 83*a–c* cut into different paddles. The detectors are arranged along a radial line at distances $r_1$, $r_2$ and $r_3$, respectively, from the rotational axis of paddlewheel 80.

The angular position of the detectors is preferably 90 degrees from the angular position of the paddle projecting into rail 52, although the detectors may also be oriented at 0, 180 or 270 degrees therefrom. The detectors are preferably positioned directly over one of the paddles when the paddlewheel is at a centered position so the paddle may be identified when centered. It will be appreciated, however, that the arrangement and number of detectors will vary with the arrangement and number of paddles.

As seen in FIGS. 5*a* and 5*b*, notches are cut into the top edges of the paddles on paddlewheel 80. Alternatively, the notches and detectors may be located on the underside of the paddlewheel, or on a separate member which rotates in cooperation with the paddlewheel. Notch 83*a* is formed on paddle 82*a* at distance $r_1$ from the rotational axis of paddlewheel 80. Similarly, notch 83*b* is formed on paddle 82*b* at distance $r_2$, and notch 83*c* is formed on paddle 82*c* at distance $r_3$. Paddle 82*d* does not have a notch. It will be appreciated that the arrangement of these notches on the paddles may vary.

Detectors 111, 112 and 113 are proximity type detectors such as the Inductive proximity sensors manufactured by Turck Inc, which generally include a coil and ferrite core arrangement, an oscillator circuit, a detector circuit, and a solid-state output circuit. The oscillator circuit drives the coil and emits a high frequency field therefrom. A metal object placed closed to the coil collects eddy currents and reduces the energy in the oscillator circuit. The detector and solid-state output circuits detect the loss of energy in the oscillator circuit and provide a digital output representative thereof. Other known types of detectors may also be used.

With detectors 111, 112 and 113, each notch in a paddle is indistinguishable from the detected condition when no paddle is underneath the detectors. Therefore, each paddle is identified by paddlewheel position sensor 110 as follows. Each paddle 82*a–d* has a unique identification as a result of the presence and position of the notch on the paddle. Assuming a "1" indicates the detection of the metallic material in a paddle, and a "0" indicates no metallic material detected, detectors 111, 112 and 113 will output in one of five states, as shown in Table I:

TABLE I

| | Detector | | | |
|---|---|---|---|---|
| Condition | | 111 | 112 | 113 |
| 1) Between paddles | 0 | 0 | 0 | |
| 2) Paddle 82a | 0 | 1 | 1 | |
| 3) Paddle 82b | 1 | 0 | 1 | |
| 4) Paddle 82c | 1 | 1 | 0 | |
| 5) Paddle 82d | 1 | 1 | 1 | |

In the alternative, a single detector could be used to detect when a paddle passed a certain position, with the software being used to increment or decrement a count to keep track of which paddle is projecting into rail 52. One potential problem with this alternate configuration, however, is that a hustler could break the clutch or brake and "jiggle" the paddlewheel back and forth across a detector to simulate multiple cart returns. In the preferred configuration, on the other hand, controller 58 will have a reliable identification of which paddle is positioned under sensor 110, and knowing in which order the paddles are arranged, will not be susceptible to this particular hustling technique since the controller will know precisely which paddle should be expected in a proper return.

Figure 5C:
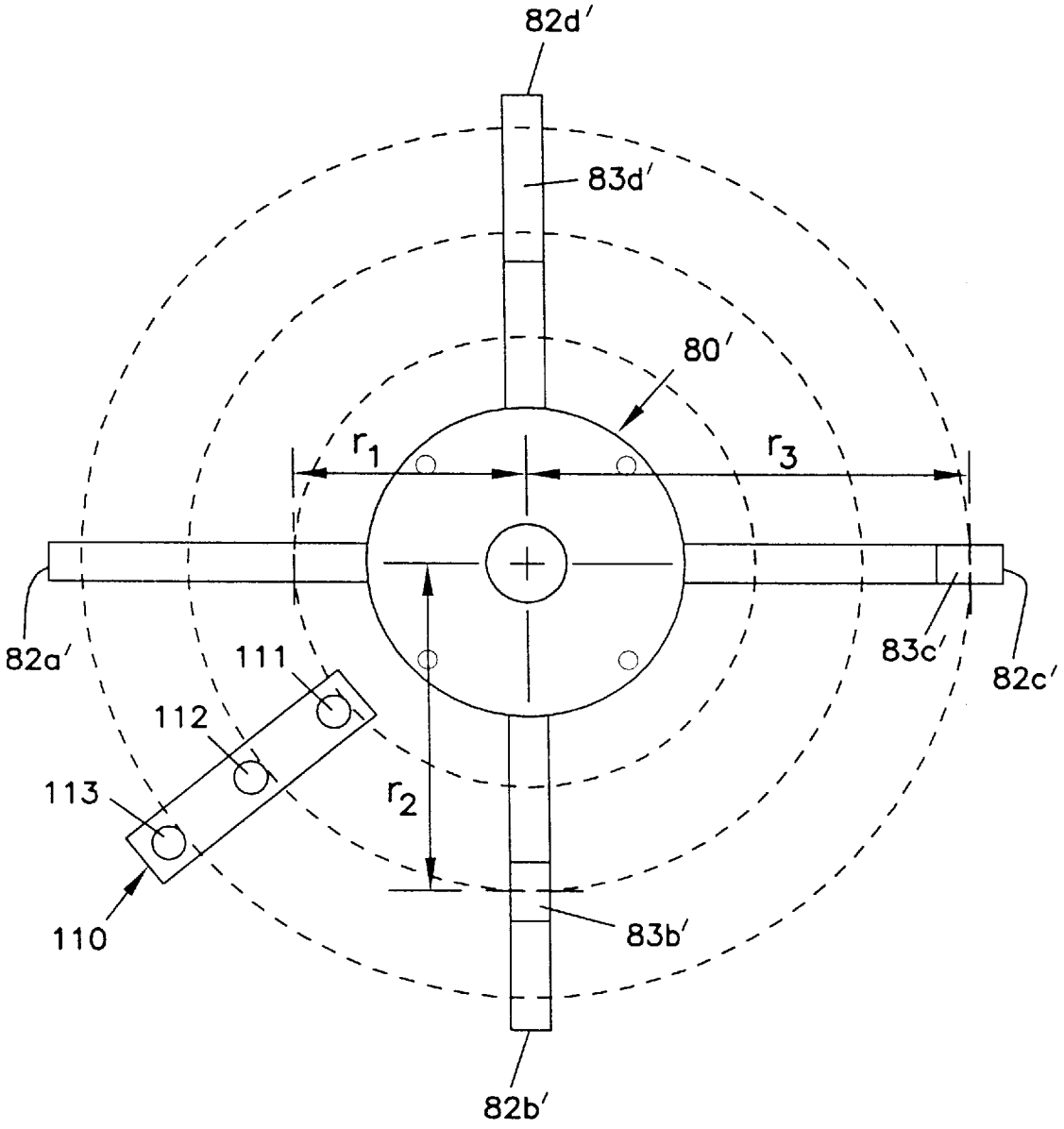
FIG. 5*c* is a top plan view of an alternate paddlewheel suitable for use with the paddlewheel position sensor in the system of FIGS. 1*a* and 1*b*.

Different paddlewheels with various combinations of notches on the paddles may be used with paddlewheel position sensor 110. For example, as shown in FIG. 5*c*, an alternate paddlewheel 80' includes paddles 82*a*'–82*d*'. Paddlewheel position sensor 110 again has detectors 111, 112 and 113 disposed at radii $r_1$, $r_2$ and $r_3$, respectively. In this embodiment, paddle 82*a*' does not include a notch. Paddle 82*b*' includes a notch 83*b*' at radius $r_2$, and paddle 82*c*' includes a notch 83*c*' at radius $r_3$. In addition, paddle 82*d*' includes a notch 83*d*' that spans from radius $r_2$ to radius $r_3$. No notches are disposed at radius $r_1$; therefore, detector 111 may be used independently as a "centered" sensor which senses whenever a paddle is positioned directly below position sensor 110. The identification of which paddle is in this position is detected by the combination of detectors 112 and 113. Table II shows the detector outputs for paddlewheel 80':

TABLE II

| Condition | Detector 111 | 112 | 113 |
|---|---|---|---|
| 1) Between paddles | 0 | 0 | 0 |
| 2) Paddle 82a | 1 | 1 | 1 |
| 3) Paddle 82b | 1 | 0 | 1 |
| 4) Paddle 82c | 1 | 1 | 0 |
| 5) Paddle 82d | 1 | 0 | 0 |

The alternative arrangement shown in FIG. 5*c* has the advantage of being able to detect whether a paddle is centered in a position with detector 111 alone (1=paddle, 0=no paddle), then being able to detect which paddle is located under the sensor using only detectors 112 and 113. This arrangement tends to simplify the software code necessary for detecting paddlewheel positions.

This alternative arrangement also is particularly useful for embodiments in which in/out sensor 100 is not used, and it enables detectors 112 and 113 to be disabled much of the time, saving processing time and power requirements. For example, when a paddle is centered under sensor 110, there is typically no need to enable detectors 112 and 113. Detector 111 may be checked periodically (e.g., every 0.1 second) to determine whether movement of the paddle has occurred (e.g., in a cart return situation), or may be tied to an interrupt line to awaken the system when movement of the paddlewheel is detected (effectively performing the same function as sensor 100). Then, when movement of the paddle away from detector 111 occurs, the system can then activate detectors 112 and 113 to assist in identifying the next paddle. Once the next paddle is identified, detectors 112 and 113 may be disabled, and detector 111 may return to the sleep state. It will be appreciated that a paddle will generally be located under sensor 110 almost all of the time, therefore, the usage of detectors 112 and 113 is greatly reduced in this manner.

An alternative embodiment of paddlewheel position sensor 110 utilizes a pair of detectors arranged along a radial line at first and second distances from the rotational axis of paddlewheel 80. One pair of oppositely disposed paddles, e.g. paddles 82*a* and 82*c*, have notches at the first distance, and the other pair, paddles 82*b* and 82*d*, have notches at the second distance. Again, assuming "1" denotes the detection of paddle metallic material, and "0" denotes the absence of metallic material, the first and second detectors would output in three different states, as shown in Table III:

TABLE III

| Condition | First Detector | Second Detector |
|---|---|---|
| 1) Between paddles | 0 | 0 |
| 2) Paddles 82a/82c | 0 | 1 |
| 3) Paddles 82b/82d | 1 | 0 |

In this alternative embodiment, controller 58 would be programmed with the arrangement of paddles, and therefore, would be able to determine which paddle is under the first and second detectors. Consequently, the aforementioned hustling scheme would also not pose a problem for this alternate embodiment.

It will be appreciated that both of the preferred paddlewheel position sensor designs are relatively simple and inexpensive, and are comparatively easy to implement in controller 58. Other position sensors, including angular position sensors, may be used in the alternative.

As shown in FIG. 1*b*, a third sensor, key identification sensor 120, is positioned along rail 52 immediately beyond paddlewheel mechanism 60. This sensor confirms that a cart key for a returned cart has been fully inserted into rail 52 and retained by paddlewheel mechanism 60. Furthermore, this sensor may also be used to identify the cart key as belonging to system 10 for the purpose of refunding a reward and further protecting from hustlers.

The first of the above-described functions for sensor 120 may be accomplished by many types of sensors, including those described above in relation to first sensor 100. The second function, however, identifying the cart key, requires some additional degree of cooperation between key 30 and sensor 120.

Figure 7:
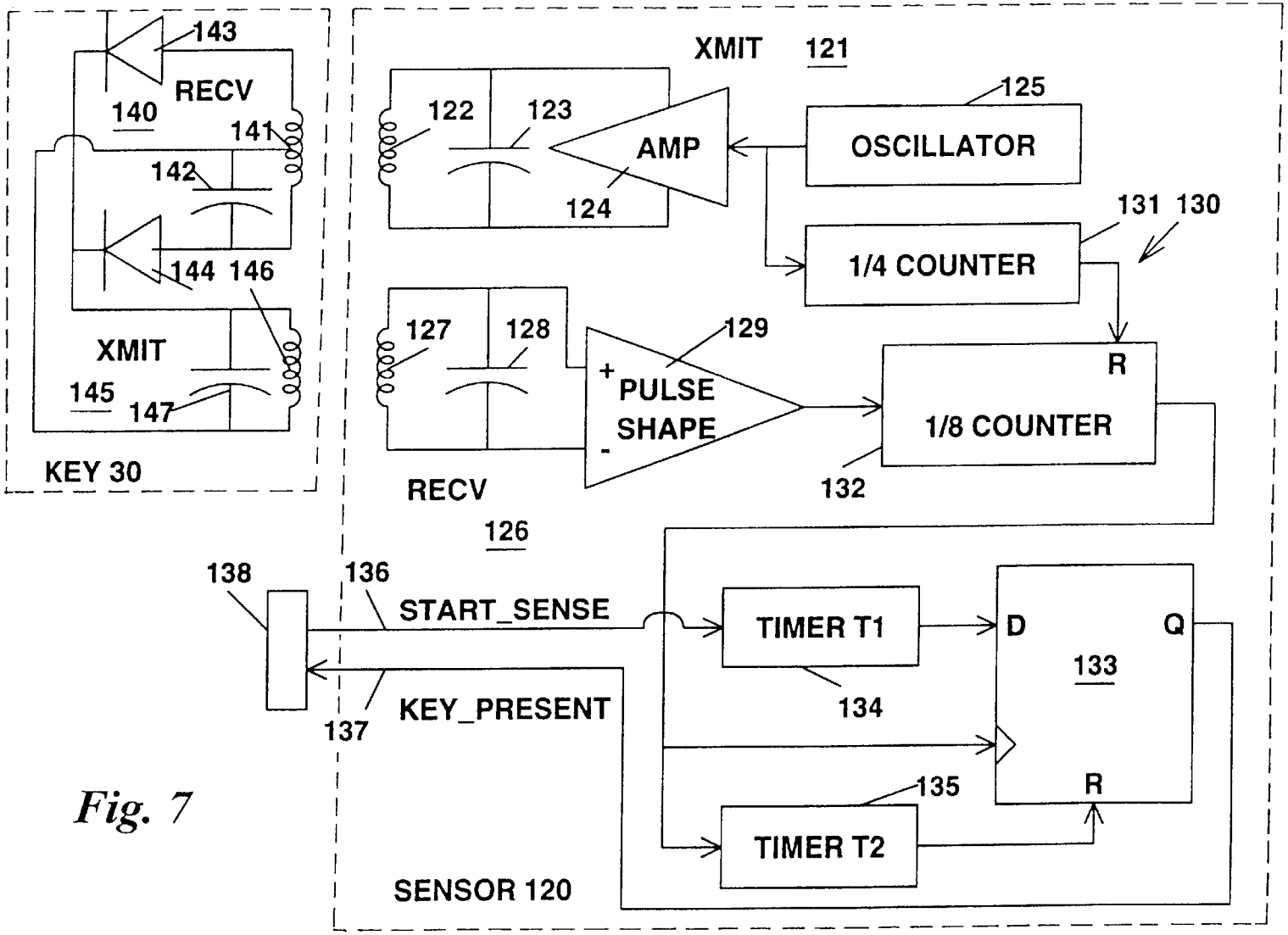
FIG. 7 is a schematic diagram of the electronic components in the cart key and key identification sensor for the system of FIG. 1*a*.

The preferred design for the key identification sensor 120 is shown schematically in FIG. 7. Sensor 120 includes a transmitter 121, a receiver 126 and a key detector circuit 130 coupled to the transmitter and receiver. Also shown in FIG. 7 is a cart key 30 having a receiver 140 coupled to a transmitter 145. When cart key 30 is in close proximity to sensor 120, transmitter 121 of sensor 120 is electromagnetically coupled to receiver 140 of key 30, and receiver 126 of sensor 120 is electromagnetically coupled to transmitter 145 of key 30. When this coupling occurs, key detector circuit 130 generates a signal KEY_PRESENT indicating that a valid key has been detected.

The operation of sensor 120 and key 30 is as follows. Transmitter 121 of sensor 120 is any known oscillator circuit capable of generating a fixed frequency signal at a frequency $F_1$, which is preferably any frequency between about 30 kHz and 200 KHz. For example, transmitter 121 may include an oscillator 125 and an amplifier 124 connected to a parallel L-C circuit comprised of a wire coil 122 and a capacitor 123. The inductance and capacitance of coil 122 and capacitor 123, respectively, are selected to generate the frequency $F_1$, in a manner known in the art. The fixed frequency signal is emitted from coil 122 for a short distance from the coil, preferably about 0.5 to 2.0 inches. The distance is selected such that a key will only be detected when it is in retaining rail 52 directly opposite sensor 120.

The signal emitted by coil 122 is received by receiver 140 when the key is in close proximity to sensor 120. Receiver 140 includes a parallel-resonant network including a coil 141 and capacitor 142 connected in parallel, with the inductance and capacitance of the coil and capacitor, respectively, selected such that receiver 140 is tuned to resonate at frequency $F_1$.

Receiver 140 is coupled to key transmitter 145, which includes a parallel-resonant network of coil 146 and capacitor 147. One end of the parallel-resonant network of transmitter 145 is connected to a center tap off of coil 141. The other end of the transmitter network is connected through a pair of diodes 143 and 144 to the ends of coil 141 of receiver 140. The inductance and capacitance of coil 146 and capacitor 147, respectively, of transmitter 145 are selected such that, when a signal (e.g., generated by transmitter 121 of sensor 120) is present with sufficient strength, the induced alternating voltage potential at each end of coil 141 with respect to its center tap is coupled into the parallel-resonant network of transmitter 145 through diodes 143 and 144. Since the alternating voltage at each end of coil 141 is 180 degrees out of phase with the other end, and since the diodes pass the positive cycle of each, the exciting signal into the parallel-resonant network of transmitter 145 is exactly double the frequency of the receiver's oscillation. This causes the parallel-resonant network of transmitter 145 to resonate at a frequency $F_2$, which is exactly double the frequency $F_1$. Preferably, the strength of this signal is sufficient to couple with receiver 126 of sensor 120 only when the key is directly opposite the sensor in the track.

It will be appreciated that since receiver 140 is tuned to resonate at frequency $F_1$, the receiver will not resonate as a result of applied signals at other frequencies, and consequently will not have enough energy to excite transmitter 145 to emit a return signal. Furthermore, since transmitter 145 is tuned to resonate at frequency $F_2$, the transmitter will not emit signals at any other frequency.

Receiver 126 of sensor 120 includes a parallel-resonant network of coil 127 and capacitor 128, the inductance and capacitance of which are selected such that receiver 126 is tuned to pick up a signal with frequency $F_2$. Receiver 126 will not efficiently pick up other signals. The resonant signal of the parallel-resonant network is amplified and converted to a pulse train by pulse shaper 129. Pulse shaper 129 may be a simple comparator, or another known device which provides a binary pulse train output from an oscillating AC signal.

From the known frequencies $F_1$ and $F_2$, key detector 130 can determine whether a valid key is being detected by sensor 120 as follows. The output from pulse shaper 129 is fed into a divide-by-eight counter 132 which produces an output with a frequency that is ⅛th the frequency of the pulse train generated by pulse shaper 129. The configuration of a counter to operate as a divide-by-eight frequency generator is known in the art.

The output of oscillator 125 of transmitter 121 is fed into a divide-by-four counter 131 which produces an output with a frequency that is ¼th the oscillator frequency $F_1$. The configuration of a counter to operate as a divide-by-four frequency generator is also known in the art.

The output of counter 131 is fed into the reset input of counter 132. Through this combination, the only time in which the output of counter 132 is forced high occurs when receiver 126 resonates to apply a signal to counter 132 at frequency $F_2$, since frequency $F_2$ is selected to be twice that of frequency $F_1$. If a pulse train was provided by pulse shaper 129 which was lower than frequency $F_2$, the counter 132 would be reset by counter 131 before its output would be forced high. This effectively prevents a signal at frequency $F_1$ (due to, for example, a hustler placing a metal object proximate sensor 120 to reflect the transmitted signal from transmitter 121) from indicating a key present condition due to the transmitted signal at frequency $F_1$ being picked up and amplified by receiver 126.

The output of counter 132 is fed to the clock input of a latch 133. The data input D of latch 133 is connected to the output of a first timer (T1) 134. Timer 134 accepts a START_SENSE signal 136 from controller 58 (not shown in FIG. 7) through a interface 138. Timer 134 is any known timer which is configured to output a high signal for a fixed period of time after being initiated by a high input signal thereto. In the preferred embodiment, timer 134 provides a positive voltage at the data input of latch 133 for about 5 to 15 seconds, preferably about 10 seconds, after START_SENSE is asserted by controller 58.

With the data input of latch 133 connected to timer 134 and the clock input connected to counter 132, the output Q of latch 133 will only be forced high when a key is detected in the time frame set by timer 134 (i.e., when the data and clock inputs are both high). Therefore, a user only has a certain period of time after sensor 120 has been activated to insert the cart key far enough into rail 52 to be detected by sensor 120.

The output Q of latch 133 is returned to controller 58 as a KEY_PRESENT signal 137 through interface 138. A second timer (T2) 135 is used to reset the KEY_PRESENT signal after a predetermined period of time. Timer 135 is activated by the output of counter 132, and therefore, will be initiated when the clock input of latch 133 is forced high by counter 132. The output of timer 135 is fed to the reset input of latch 133, whereby after a fixed period of time after the clock input of latch 133 is forced high, preferably about 10 seconds, the output will be reset to low. The action of timer 135 keeps the KEY_PRESENT signal active long enough for controller 58 to detect the signal if it is operating in a polling mode.

Various modifications to the design of sensor 120 and key 30 may be made consistent with the invention. For example, transmitter 121 of sensor 120 may be controlled by the START_SENSE signal 136 to oscillate only when directed by controller 58. Furthermore, sensor 120 may be used to verify that no pulses are received during a time window in which transmitter 121 is shut off.

Other sensor/key configurations may also be used consistent with the invention. For example, other proximity identification systems, even those which can provide separate identification codes for each key (to enable the system to keep track of each individual cart in the system), may also be used; however, these more sophisticated systems are comparatively more expensive, and would require more sophisticated control than the comparatively simple and inexpensive preferred sensor 120.

Receiver 140 and transmitter 145 of key 30 are preferably mounted within the first roller 36 thereof. In the preferred embodiment the components of the receiver and transmitter are formed on a circular fiberglass circuit board which is adapted for mounting within a covered recess on roller 36. Coils 141 and 146 are preferably formed as circuit board traces on the circuit board, and the diodes and capacitors are mounted to the board, in a manner known in the art. Alternatively, coils 141 and 146 may be wound coils of wire mounted about the periphery of a disk.

It will be appreciated that frequencies $F_1$ and $F_2$ may be selected to customize cart keys 30 and sensor 120 of the preferred cart management system 10. Consequently, different installations can utilize different frequencies, so that keys from one facility will not work with another facility. This also prevents hustlers for obtaining universal keys that will work on all installations.

As was described previously, second roller 38 of cart key 30 is inactive. One purpose for roller 38 is to prevent roller 36 from being pulled back into proximity with sensor 120 after paddlewheel 80 has been incremented by insertion of a cart fully into rail 52. Once the paddlewheel has been incremented, one-way clutch 61 and brake 65 restrict the rotation of the paddlewheel in the opposite direction, and the placement of sensor 120 immediately behind paddlewheel mechanism 60 also cooperates in keeping roller 36 from being detected a second time by sensor 120 after a valid key has already been detected.

Figure 8:
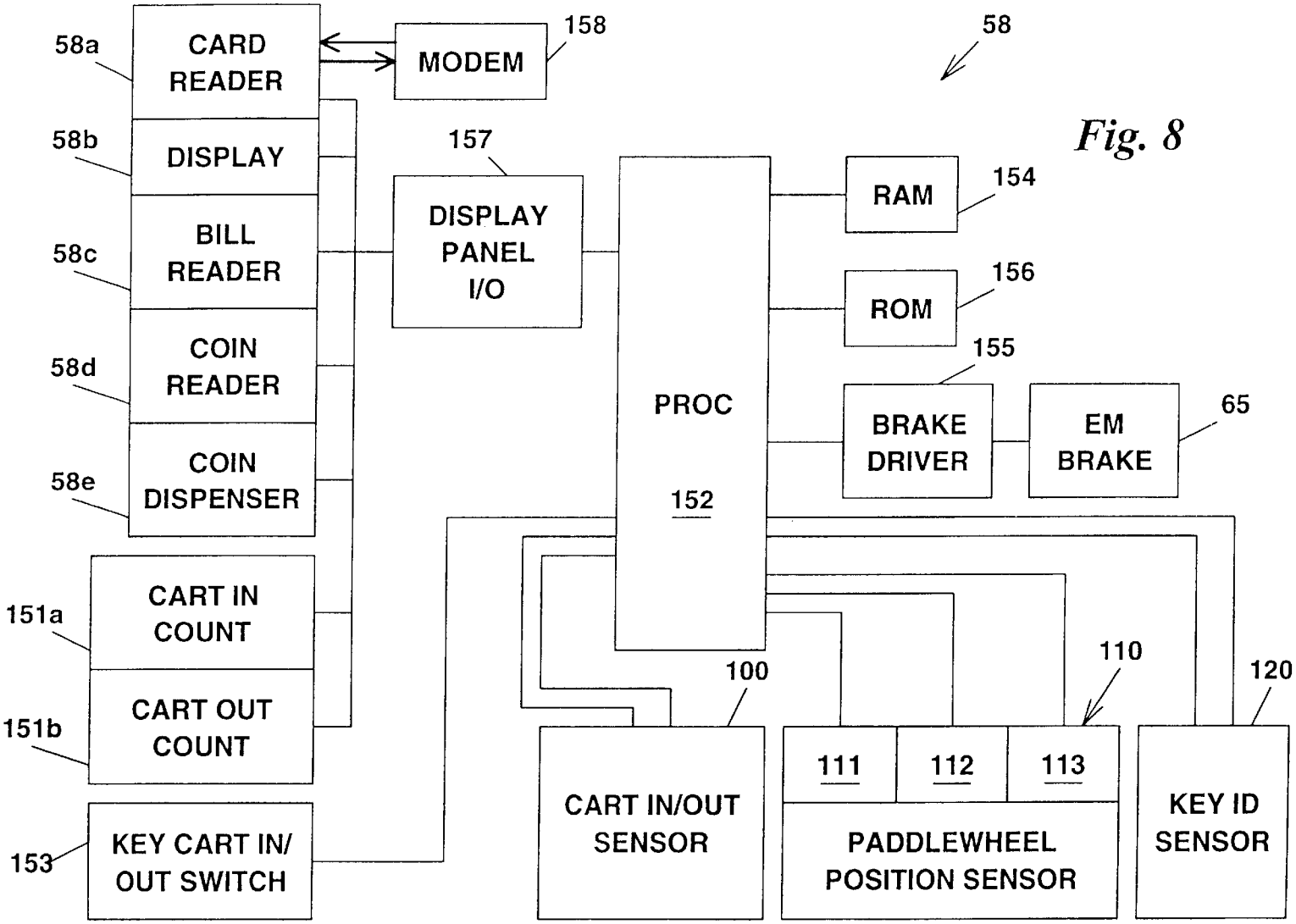
FIG. 8 is a schematic diagram of the electronic components in the controller for the system of FIG. 1*a*.

FIG. 8 shows a schematic diagram for the primary electronic components of controller 58. Program code for controller 58 is executed in a processor 152. The program code is stored in a combination of read only memory 156 and a portion of a battery-backed random access memory 154. A remaining portion of random access memory 154 is used for working memory. Many different known microprocessors or microcontrollers may be suitable for use as processor 152, for example, the 8031 processor manufactured by Intel.

It will be appreciated by one skilled in the art that various support circuitry will be required for processor 152 such as a power supply circuit, a crystal oscillator, data buffers, and other necessary components. Further, it will be appreciated that the configuration, installation and operation of processor 152, ROM 156, ROM 154 and the other required support circuitry are well known in the art.

Processor 152 has a number of inputs and outputs through which it communicates with several subgroups of external components within controller 58. For example, one subgroup includes the display panel components that provide the primary user interface, including display 58*a*, card reader 58*b*, bill reader 58*c*, coin reader 58*d*, and coin dispenser 58*e*, and which must be capable of receiving and transmitting information to and from processor 152.

A display panel input/output block 157 is shown between the display panel components and processor 152 for handling the information exchange therebetween. Display panel I/O block 157 is shown generically, as the display panel components may be interconnected with processor 152 in a number of manners. For example, each of the components may be assigned address space and connected to the address and data buses of processor 152 in a known manner. Alternatively, the information exchange may be handled through serial or parallel communication through one or more dedicated I/O ports from processor 152. It will further be appreciated that different buffers, multiplexers, and other communication devices may also be necessary depending on the particular selected manner for exchanging data between the display panel components and processor 152.

Components 58*a*–58*e* are preferably commercially available items, and consequently, the use, control, and information exchange protocols necessary for control of these items via a processor such as processor 152 is known in the art. Furthermore, since card reader 58*b* may also include credit card verification from a remote site, an optional modem 158 maybe interconnected thereto for handling the remote communication. The required peripheral devices, connections and control operations for controlling modem 158 are also known in the art.

A second subgroup of components which are driven by processor 152 are the cart in and cart out count displays 151*a* and 151*b* and the key cart in/out switch 153. The switch and displays are preferably located behind an access panel whereby only authorized maintenance personnel have access to the components. The cart in count display 151*a* displays the number of carts which are currently retained within system 10. Cart out count display 151*b* provides a display of the number of carts which are currently in use by customers. As shown in FIG. 8, both displays may be controlled through the display panel input/output circuitry 157. The displays are preferably selected from commercially available components such as CUB 3LR displays manufactured by Red Lion Controls, and consequently, the transfer of information between the displays and processor 152 is known in the art. In an alternative embodiment, the cart counts may be displayed on a single view register, or even on display 58*a*, accessed by a push button behind an access panel. An operator would be able to toggle through different views to get separate counts of carts in, carts out, carts used, carts vended, etc.

Key cart in/out switch 153 is used to select an alternate, maintenance mode of operation for processor 152 which automatically releases electromagnetic brake 65 to enable maintenance personnel to add or remove carts from the system. Switch 153 may be interconnected to processor 152 to any number of known manners, e.g., through a dedicated input/output, as an address in the processor addressing space, or as an external interrupt.

A third subgroup of components which are controlled by processor 152 are the cart in/out sensor 100, the paddlewheel position sensor 110, and the key identification sensor 120. Cart in/out sensor 100 preferably provides two separate outputs which indicate, respectively, whether a cart is being inserted into rail 52 or removed from rail 52. Paddlewheel position sensor 120 includes detectors 111, 112, 113, each of which has an output which is asserted whenever metallic material is detected in close proximity to the detectors. Furthermore, as discussed above with reference to FIG. 7, key identification sensor 120 receives an input START_SENSE which is asserted by processor 152 to initiate sensor 120 for detecting a valid key. Sensor 120 also provides an output KEY_PRESENT which is asserted when sensor 120 detects a valid key. It will be appreciated that the input/output signals to and from sensors 100, 110, 120 may be interconnected with processor 152 through any of the above-described known manners.

A fourth subgroup of components driven by processor 152 is the electromagnetic brake 65. As discussed above, brake 65 is normally biased to a locked position, and is unlocked through the application of a 24 VDC signal. Since many processors operate at 3 or 5 VDC, a brake driver 155 is preferably interposed between brake 65 and processor 152 to provide the necessary voltage amplification for driving brake 65 in response to a low voltage input signal asserted by processor 152. Many suitable amplifier circuits are known in the art.

Controller 58 preferably is configured to operate in the manner shown in FIGS. 9*a*–*d*. The program code necessary for performing the operations disclosed herein will be dependent upon the particular processor and programming language utilized in controller 58. Consequently, it will be appreciated that the generation of program code from the disclosure presented herein would be within the skill of an ordinary artisan.

Figure 9A:
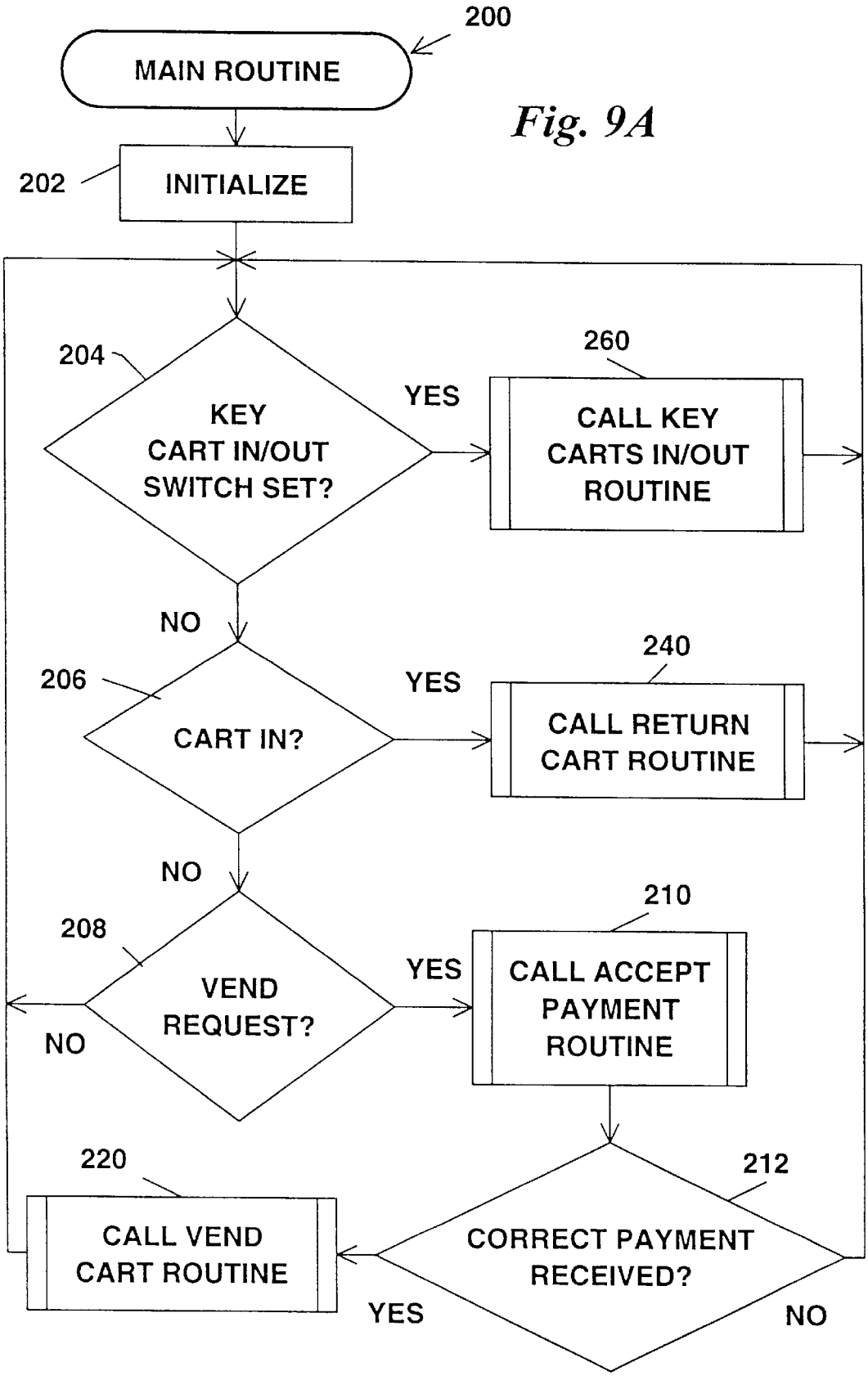
FIGS. 9*a–d* are flowchart diagrams showing the operation of a preferred control system for the system of FIG. 1*a*.

Main routine 200 for the operation of controller 58 is shown in FIG. 9*a*. The first step in this routine is an initialization step 202, wherein various housekeeping functions such as initializing variables, setting up interrupts, etc., is performed.

Next, routine 200 proceeds to block 204 to determine whether the key cart in/out switch is set. As discussed above, this switch will be set by a maintenance personnel when it is desired to add or remove carts from the system. If this switch is set, the routine proceeds to block 260 to call the key cart in/out subroutine which handles this alternate mode of operation. This routine is discussed below with reference to FIG. 9*d*.

If the key cart in/out switch is not set, as will be typically found in the normal operational mode of the system, control passes to block 206 to determine whether a "cart in" condition is detected, indicating that a cart is being returned. In the preferred embodiment, this condition is sensed by detecting a "cart in" sensed by sensor 100. However, in the alternate embodiment described above wherein sensor 100 is not used, the "cart in" condition may be detected by sensor 110 as a cart inserted into rail 52 will be allowed to rotate paddlewheel 80 by virtue of one-way clutch 61. The initial rotation of paddlewheel 80 as a result of a cart being inserted into the rail is sensed when detectors 111–113 all indicate no metallic material detected (corresponding to the "between paddle" condition in Table I above), or, for the paddlewheel of FIG. 5*c*, when detector 111 indicates no metallic material detected.

Once the "cart in" condition is detected, control passes to block 240 to call the return cart routine, which is discussed in greater detail below with reference to FIG. 9*c*. On the other hand, if the cart in condition is not detected, control passes to block 208 to determine whether a vend request has been initiated.

Any number of conditions may initiate a vend request. For example, a user may depress a pushbutton on the display panel to request a cart vend. Alternatively, the vend request may be initiated automatically by the insertion of a credit or debit card into card reader 58*b*, the insertion of a dollar bill into bill reader 58*c*, or the insertion of a coin into coin reader 58*d*, all of which indicate that a customer is preparing to obtain a cart.

If no vend request is received, control returns to block 204 to again cycle through the main loop of routine 200. However, if a vend request is received, control passes to accept payment routine 210 to control the various payment accepting devices and determine whether sufficient funds have been inserted into the system to initiate a cart vend operation. The program flow of accept payment routine 210 is generally known in the art, and will be dependent upon a number of factors, e.g., the cost of a cart, the number/types of payment devices present on the system, etc.

After the accept payment routine 210 is called, control passes next to block 212 to determine whether a correct payment has been received. If the correct payment is not received, control passes back to block 204 to cycle through the main loop. In addition, any necessary additional functions, such as refunding any partial payments, would be performed at this time.

If the correct payment is received, block 210 passes control to block 220 to call the vend cart routine. The operation of this routine is discussed below with reference to FIG. 9*b*. After routine 220, control returns to block 204 to cycle again through the main loop of routine 200.

It will be appreciated that any of the subroutines discussed above may be initiated by means of interrupts as opposed to being continuously cycled through in a main routine. It will also be appreciated that other functions, such as various general housekeeping routines, may also be included in the main routine. Furthermore, it will be appreciated that various fault detection and self-test routines may be utilized in routine 200 and further that a diagnostic or program mode may be incorporated therein to allow modification and customization of the main routine for a particular installation (e.g., changing the amount of the vending cost and the reward dispensed). Other modifications to routine 200 will be appreciated by one skilled in the art.

Figure 9B:
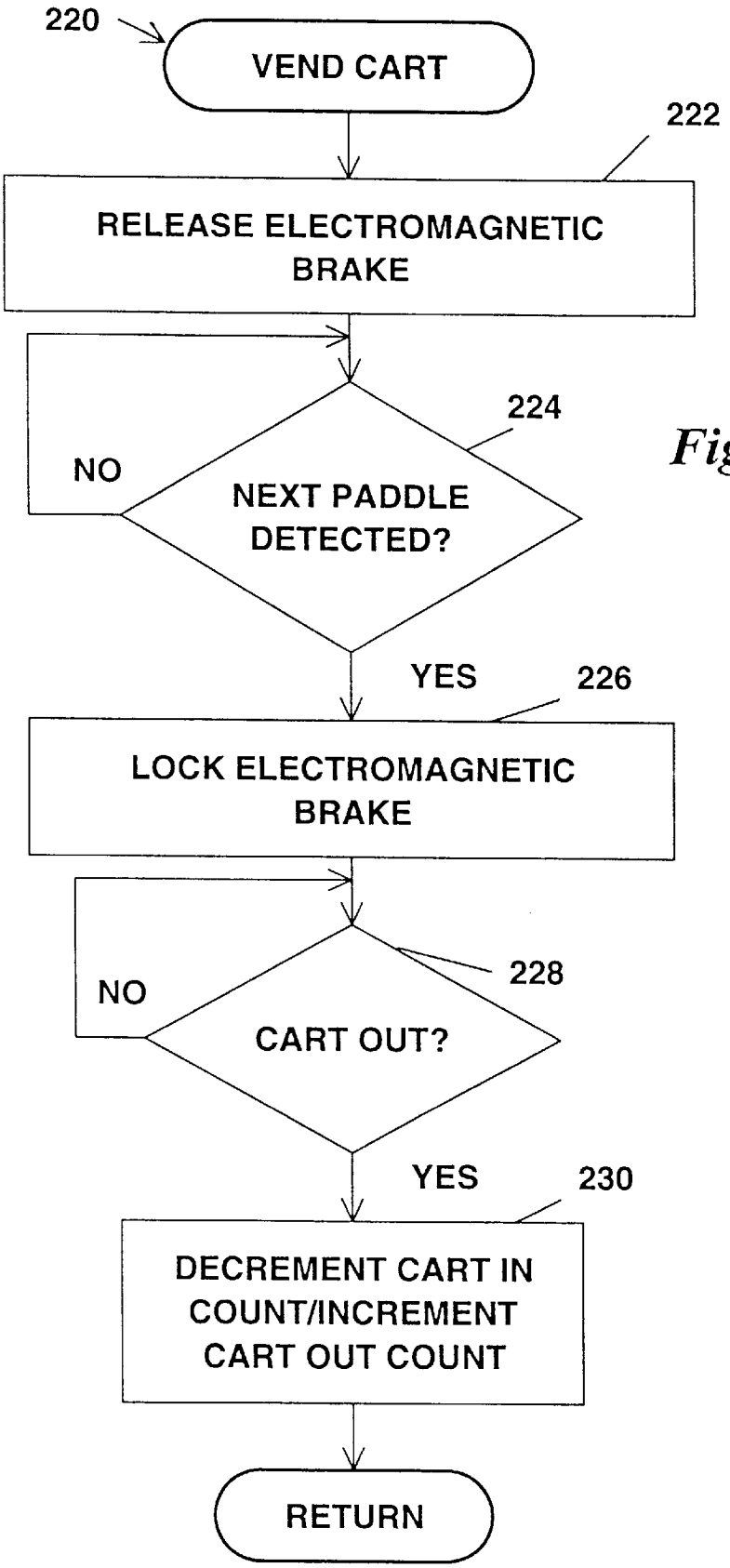

Turning to FIG. 9*b*, the vend cart routine 220 is discussed in greater detail. The first step in this routine is to release electromagnetic brake 222, which is preferably performed by asserting a signal to brake driver 155. This releases paddlewheel 80 and allows a customer to pull the last cart past paddlewheel 80 and out of rail 52. When one cart is pulled out of rail 52, paddlewheel 80 will be incremented to the next paddle. Therefore, in block 224, routine 220 waits until the next paddle is detected by sensor 110, which indicates that the cart key of the cart being vended has been moved past paddlewheel 80. At this point, routine 220 proceeds to block 226 to relock electromagnetic brake 65, thereby restricting the rotation of paddlewheel 80 further. Next, routine 220 waits in block 228 until a "cart out" condition is sensed by sensor 100. Once this condition is sensed, the cart key of the vended cart has been removed from retaining rail 52. At this point, the number of carts retained by system 10 ("carts in") is decremented, and the number of carts vended ("carts out") is incremented, in block 230. It will be appreciated that alternatively only one variable may be maintained related to the number of carts in or out, with the other value being calculated based upon the known number of carts in the system.

As discussed above, in an alternative embodiment, cart in/out sensor 100 may be omitted, with its functions incorporated into sensor 110. In this case, the "cart out" condition detected in block 228 would not be required since sensor 110 would indicate a "cart out" condition by detecting a 90 degree rotation of the paddlewheel. Consequently, the next paddle detected block 224 which detects when a rotation of the paddlewheel has occurred may be suitable to verify that the cart key of the vended cart is beyond paddlewheel 80 and no longer captured in the system. Therefore, it will be appreciated that the separate cart out detection block 228 is optional.

Figure 9C:
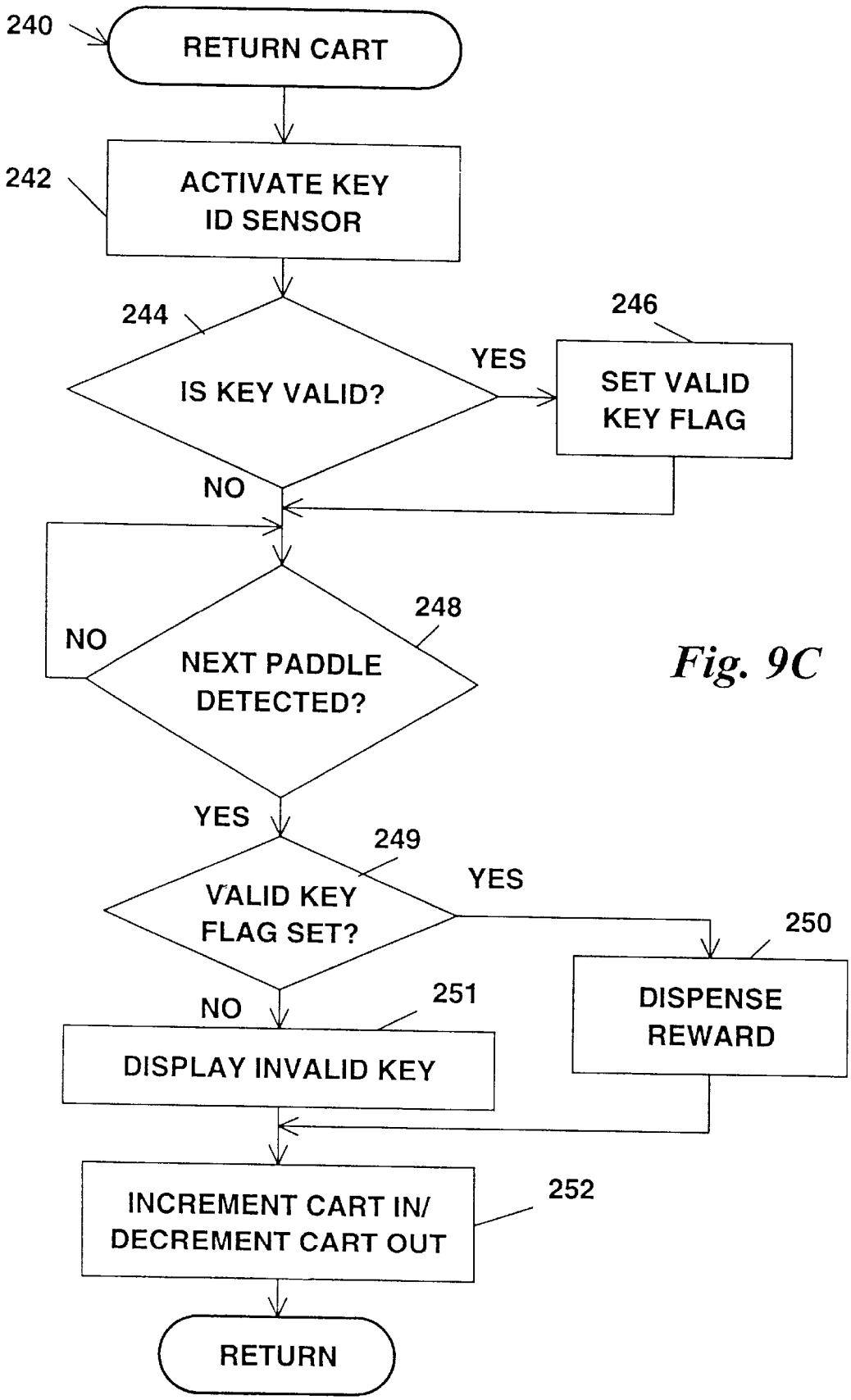
Figure 10A:
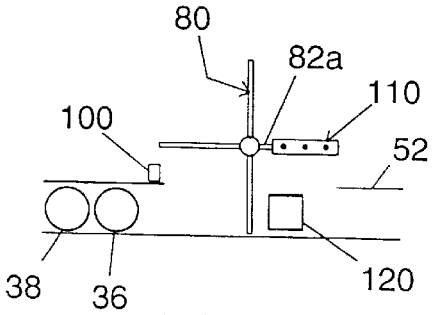
FIGS. 10*a–f* are functional top plan views showing various stages in the return of a cart into the cart management system of FIG. 1*a*.
Figure 10B:
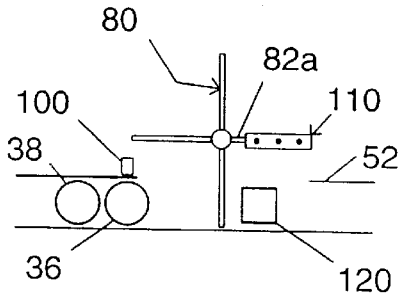

Turning next to FIG. 9*c*, the return cart routine 240 is described. In addition, reference is also made to FIGS. 10*a–f*, which show schematically the physical insertion of a cart key into rail 52 during the return of a cart. FIG. 10*a* shows the rollers 36, 38 of a cart key inserted into rail 52, and with paddle 82*a* disposed under sensor 110. FIG. 10*b* shows roller 36 passing sensor 100 and initiating a "cart in" condition, which is detected in block 206 of main routine 200 in the preferred embodiment (shown in FIG. 9*a*).

In routine 240, the first step is to activate key identification sensor 242, which is preferably performed by asserting the START_SENSE signal to sensor 120. Next, at block 244 the system determines whether the key for the return cart is a valid key in the manner described above.

If a valid key is detected by sensor 120, a flag is set in block 246 and control passes to block 248. Otherwise, the valid key flag will indicate an invalid key, and control will still pass to block 248. In block 248, the system cycles until the next paddle is detected by sensor 110. As discussed above, the next paddle can be detected by checking detectors 111–113 for paddlewheel 80 of FIG. 5*b*, or by checking only sensor 111 for paddlewheel 80' of FIG. 5*c*.

Figure 10C:
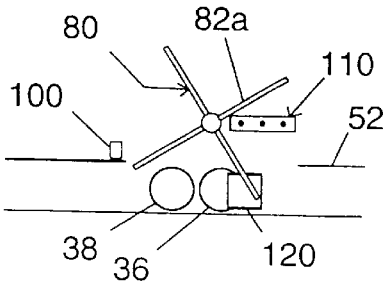
Figure 10D:
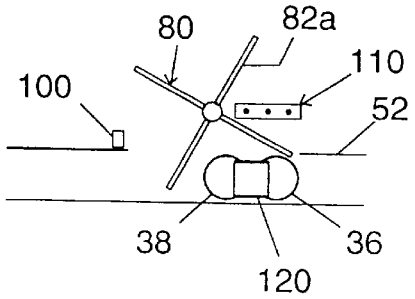
Figure 10E:
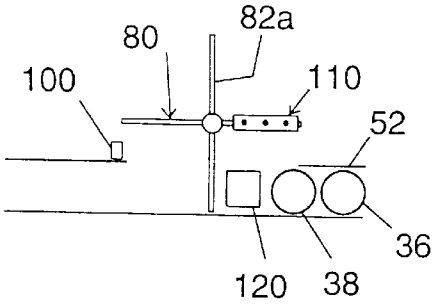
Figure 10F:
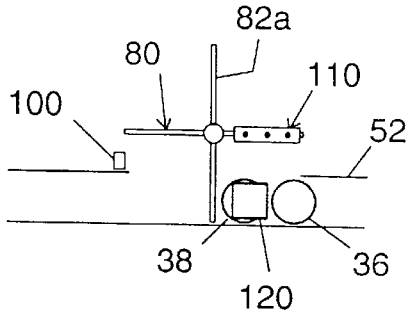
Figure 11:
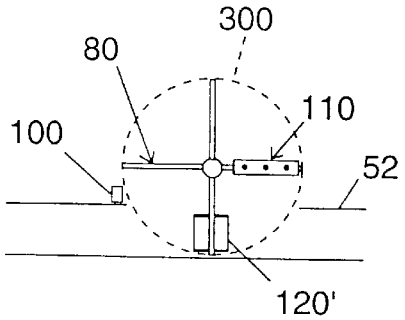
FIG. 11 is a functional top plan view showing an alternate positioning for the key identification sensor of the cart management system of FIG. 1*a*.

As shown in FIGS. 10*c* and 10*d*, roller 36 of key 30 will preferably pass sensor 120 prior to a full 90° rotation of paddlewheel 80 (which is depicted in FIG. 10*e*). Consequently, the detection of a valid key will preferably occur before the next paddle is detected by sensor 110. As shown in FIG. 11, sensor 120 will preferably be disposed within the area in the rail defined by the rotation of paddlewheel 80 (circumscribed by dashed line 300 in FIG. 11) so that the key will be identified prior to detecting the next paddle.

The preferred orientation of sensor 120 provides an important safeguard against reward theft. Otherwise, if the key was not read until after the paddlewheel incremented positions, a hustler would be able to rotate the paddlewheel a small amount by hand to simulate a returned cart and activate the system. Next, the hustler could pull the rearmost cart in the rail back into the reader position to enable sensor 120 to identify the key, and then rotate the paddlewheel to the next position by hand and receive a reward.

In addition, due to the preferred positioning of sensor 120 within the area defined by paddlewheel 80, the next paddle of the paddlewheel will preferably project into retaining rail 52 before roller 36 passes sensor 120. Consequently, at that point, the cart key would not be able to be pulled out of retaining rail 52 due to the obstruction presented by the next paddle.

With the preferred position of sensor 120 in rail 52, an additional level of theft prevention may be provided. As is exemplified by FIG. 10*f*, once paddlewheel 80 has been incremented to the next centered paddle position, roller 36 of key 30 may not be pulled back into proximity with sensor 120 by virtue of roller 38 contacting paddlewheel 80.

Furthermore, as shown in FIG. 11, positioning a key identification sensor 120' more proximate the centered position of a paddle may also be beneficial. In this situation, even if roller 38 is broken off key 30 by a hustler, key 36 still is unable to fully retracted over sensor 120' and identified due to the centered paddlewheel. Other positions for sensor 120 within the preferred range may also be used consistent with the invention.

Returning to FIG. 9*c*, after the next paddle is detected at block 248, indicating that a 90° rotation of paddlewheel 80 has occurred, block 249 checks if a valid key was detected by checking the valid key flag. If a valid key was detected, a reward is dispensed in block 250 by activating coin dispenser 58*e* to dispense the proper amount of the reward. The operation of this step will vary upon the particular coin dispenser utilized in a manner known in the art. If the valid key flag is not set, control instead passes to block 251 to display on display 58*a* that an invalid key was detected, and no reward is dispensed. In either instance, control next passes to block 252 to increment the number of captured carts and decrement the number of vended carts before control is returned to main routine 200.

Figure 9D:
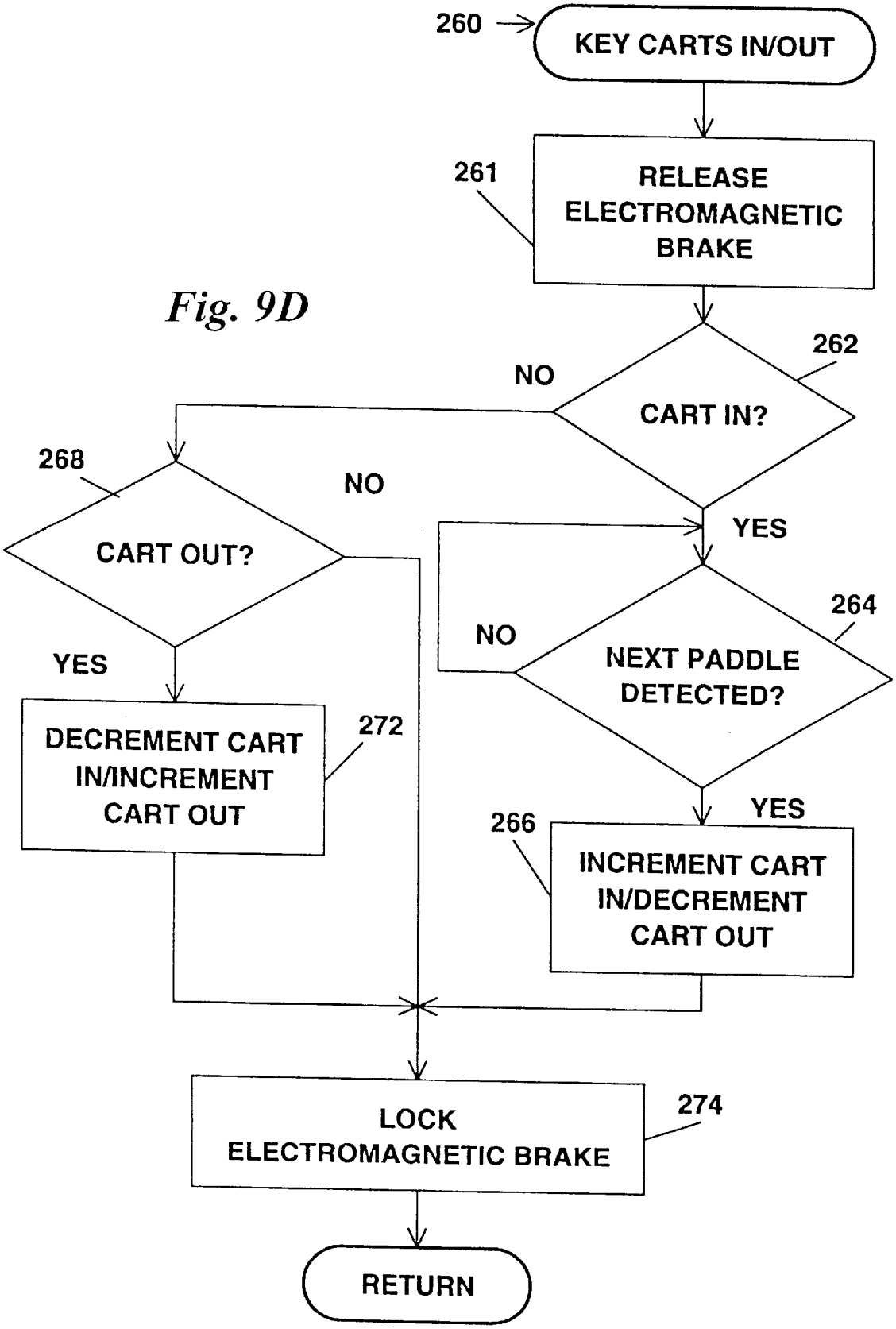

Turning to FIG. 9*d*, the alternate maintenance mode of controller 58, which is initiated by key cart in/out switch 153, is shown in key carts in/out routine 260. In this routine, electromagnetic brake 65 is released in block 261 to permit free insertion and removal of carts by a maintenance personnel. A "cart in" condition is checked for in block 262. This may be detected by sensor 100. If a "cart in" condition is detected, control passes to block 264 to wait until the next paddle is detected, indicating that a cart has been advanced past paddlewheel 80. At this point, in block 266, the number of captured carts may be incremented and the number of vended carts may be decremented. Then, before returning to main program 200, brake 65 may be locked in block 274. In block 266, the total number of carts in the system may also be incremented, for example, by selecting another position of switch 153 or by toggling a second switch (not shown), signifying that new carts are being added to the system.

If a "cart in" condition is not detected in block 262, control passes to block 268 to determine whether a "cart out" condition is being sensed. This condition is sensed by sensor 100 in the preferred embodiment. If no "cart out" condition is detected, control passes directly to block 274 to once again lock brake 65 before returning to main routine 200.

If, however, a "cart out" condition is detected, control is passed to block 272 to decrement the number of captured carts and increment the number of vended carts. Also, the total number of carts in the system may be decremented as described above. Next, in block 274, the brake is locked before control is returned to main routine 200.

It will be appreciated that once the "cart out" condition is sensed by sensor 100, paddlewheel 80 will already have been incremented to the next paddle position, so this condition does not necessarily need to be detected.

Figure 9E:
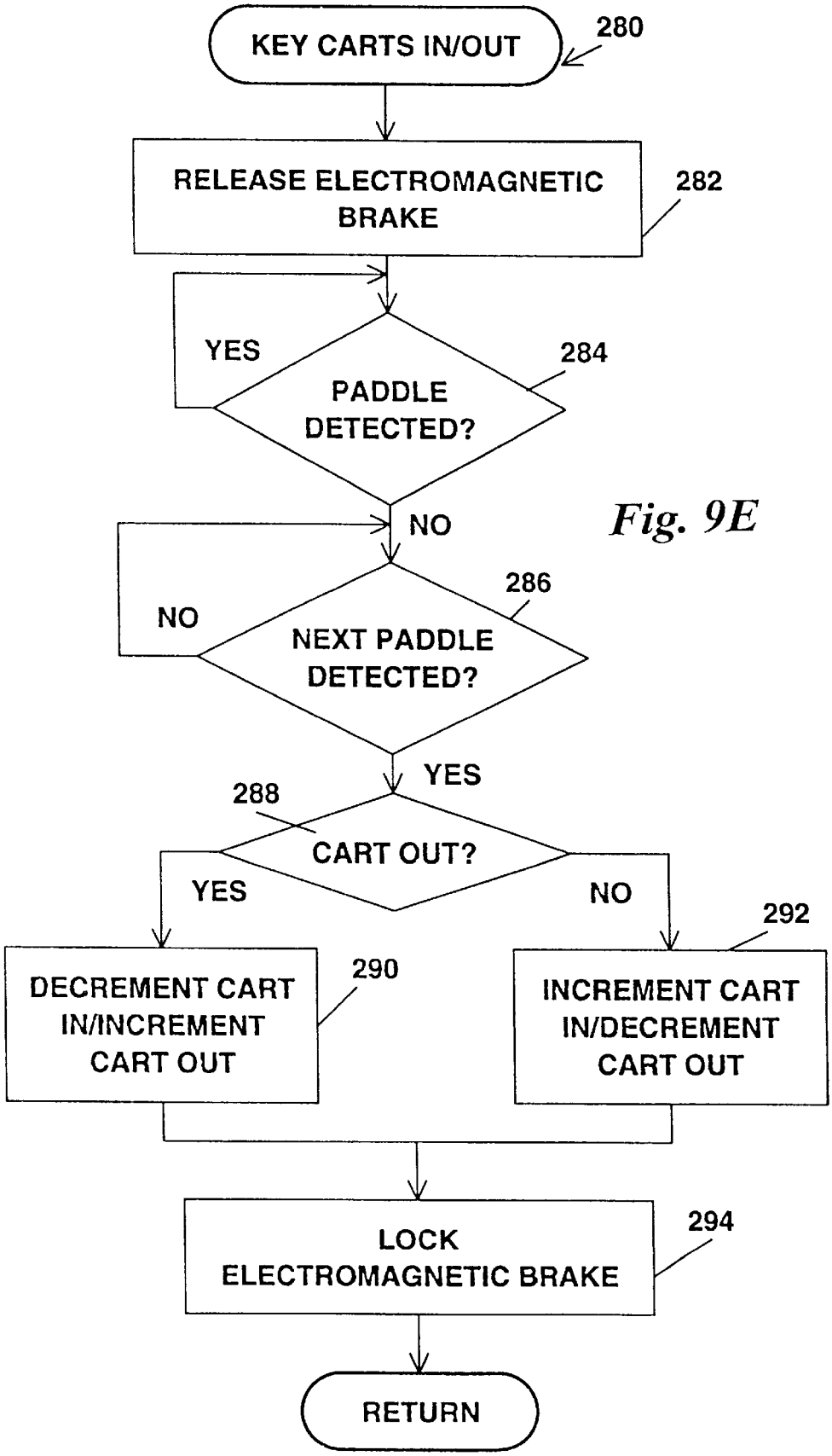
FIG. 9*e* is a flowchart diagram of an alternate key carts in/out routine to that of FIG. 9*d*.

In the alternative embodiment discussed above which does not utilize a sensor 100, the key carts in/out routine would be somewhat simplified, as exemplified in routine 280 in FIG. 9*e*. First, brake 282 would be released as above. Next, in block 284, the system waits until a paddle is not detected by sensor 110 (i.e., when a "between paddles" condition is detected), indicating that a cart is being inserted or removed from the rail. For paddlewheel 80 (FIG. 5*b*), this would be detected when detectors 111–113 indicate no paddle, and for paddlewheel 80' (FIG. 5*c*), this would be detected when detector 111 indicates no paddle.

Once the paddlewheel has left a centered position, control passes to block 286 to wait until the next paddle is detected, in the same manner for each paddlewheel embodiment (80 or 80') as discussed above for block 284.

Then, in block 288, the system determines from the new paddle position whether a "cart in" or "cart out" condition has occurred. For paddlewheel 80 of FIG. 5*b*, detectors 111–113 would all be polled as described above. For paddlewheel 80' of FIG. 5*c*, only detectors 112 and 113 need be activated after the new paddle is sensed by detector 111. Since the arrangement of paddles is stored in the system, a clockwise or counterclockwise rotation of the paddlewheel may be distinguished, with the cart in and cart out counts adjusted accordingly in blocks 290 and 292. Then, the brake is locked in block 294 before control returns to routine 200.

In another alternate embodiment of the invention, the key carts in/out routine may be controlled as an interrupt which is signaled by the position of the key carts in/out switch 153. In this instance, the control over brake 65 may be tied to the position of switch 153, thereby reducing the repetitive cycles in which the brake is transitioned between locked and unlocked states.

The above combination of sensors and components operating in the manner disclosed herein provides several levels of protection against the theft of rewards due to hustlers. The size and shape of the paddle permits only one key to be inserted into the rail at a time. The limited size of the slot in the bottom of the rail makes it difficult to access the paddlewheel and other internal components of the system. The centering mechanism makes it difficult to hold the paddlewheel in intermediate positions between centered positions. The combination of sensors 100, 110 and 120 are coordinated by the controller to dispense rewards only when a predetermined set of conditions occur in a predetermined order. Each paddle on the paddlewheel is separately identifiable, enabling the controller to distinguish between a rotation to a next paddle and "jiggling" proximate one paddle position. Also, as described above, the positioning of sensor 120 in the path of paddlewheel 80 prevents a cart key already inserted in the rail from being used to dispense additional rewards. Other theft preventive measures and benefits, including the others described above, will be appreciated by one of ordinary skill in the art.

Any of the embodiments disclosed herein may be used in single-ended, double-ended or even "triple-ended" cart management systems consistent with the invention. In a single-ended system, customers rent and return carts from a single station, and an operator may insert or remove carts from the same station. In a double-ended system, separate stations are disposed at each end of a nested arrangement of carts, whereby a customer rents from one station and returns to the other station. An operator may insert and remove carts either at both stations or at separate stations. In a "triple-ended" system, separate stations are disposed at each end of a nested arrangement of carts, but customers are able to rent and return carts from one station. An operator may also insert and remove carts at the one station, but may also insert and remove carts from the other station. The modifications necessary for modifying any of the embodiments disclosed herein to accommodate any such systems would be apparent to one of ordinary skill in the art. For example, in double-ended and triple-ended systems, it may not be necessary to include notches and multiple sensors for distinguishing individual paddles at one of the stations. Merely one sensor to detect a centered paddle may be substituted, for example, in rental stations since the risk of fraud is not as great as in return stations that dispense rewards.

Alternate Embodiment with Enhanced Fraud Prevention

Figure 12:
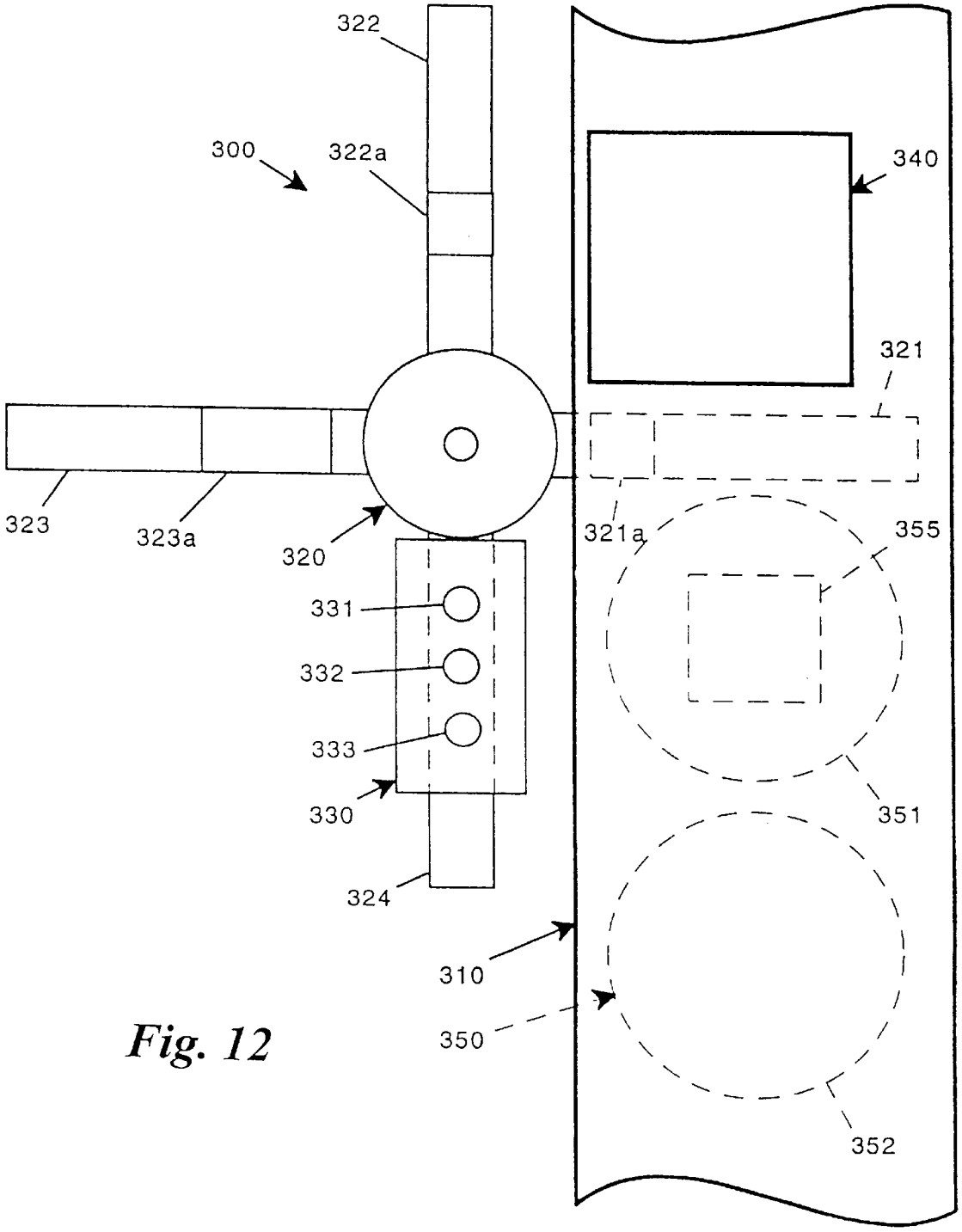
FIG. 12 is a functional top plan view of the paddlewheel, sensors and retaining rail of an alternate cart management system with enhanced fraud prevention software consistent with the invention, with a cart key shown disposed within the retaining rail.

FIG. 12 illustrates an alternate cart management system 300 for use with enhanced fraud prevention software routines consistent with the invention. In this alternate embodiment, similar mechanical and electronic hardware components are used as in the other embodiments of the invention discussed above, with a few exceptions as outlined below. Unless otherwise specified, it is to be understood that all of the components of system 300 are substantially the same as the other embodiments discussed above.

System 300 incorporates a cart identification sensor which is capable of uniquely identifying carts placed in the system. This permits the system to maintain a queue of carts retained in the system, which offers significant benefits in terms of fraud prevention, since unexpected occurrences in the queue may be monitored to allow the dispensing of rewards only in response to valid returns.

FIG. 12 functionally shows the paddlewheel, retaining rail and various sensors used in cart management system 300. System 300 includes a paddlewheel mechanism which utilizes an electromagnetic brake, a one-way clutch, a centering mechanism and a dampening mechanism (not shown in FIG. 12) that are substantially the same as disclosed for paddlewheel mechanism 60 above. The paddlewheel mechanism also includes a paddlewheel 320 which projects into an access aperture of a retaining rail 310 and which is similar to paddlewheel 80' shown in FIG. 5C.

Paddlewheel 320 includes four paddles 321–324. Paddle 321 includes a notch 321*a* at a first radius from the axis of rotation of paddlewheel 320, paddle 322 includes a notch 322*a* at a second radius, and paddle 323 includes a notch 323*a* that spans both the first radius and the second radius. Paddle 324 does not have a notch.

A paddlewheel position sensor 330 includes three proximity detectors 331, 332 and 333 arranged respectively at first, second and third radii from the axis of rotation of paddlewheel 320. The proximity detectors are preferably Inductive proximity detectors manufactured by Turck, Inc., although other manners of distinguishing between paddles, including the use of other sensors, may be used in the alternative. In this configuration, proximity detectors 331 and 332 determine which paddle is disposed below the position sensor by detecting the notches in the paddles at the first and second radii. Proximity detector 333 acts simply as a paddle centered detector, since no paddle includes a notch at the third radius. Any of the other paddle notch configurations discussed above may also be used in the alternative.

A cart or key identification sensor 340 is disposed over retaining rail 310 to detect cart keys, e.g., cart key 350 with first and second rollers 351 and 352, retained within the rail. Sensor 340 is placed such that paddlewheel 320 is interposed between the sensor and the open end of the retaining rail.

Sensor 340 functions similar to key identification sensor 120 discussed above in that it (1) confirms that a cart key for a returned cart has been inserted into rail 310 and retained by paddlewheel 320, and (2) identifies the cart key as belonging to system 300. However, sensor 340 also preferably provides an additional function of "uniquely" identifying each cart key belonging to the system—that is, sensor 340 is capable of distinguishing between different cart keys in the system. In order to distinguish between individual cart keys, each cart key, e.g., cart key 350 shown in FIG. 12, includes an electronics module or tag 355 which is disposed within first roller 351 to transmit an identifying signal to a receiver in sensor 340 when the cart key is oriented proximate the sensor.

Sensor 340 and tags 355 are preferably components of an RF/ID (Radio Frequency Identification) system such as is available from Indala Corporation of San Jose, Calif. In this system a reader (corresponding to sensor 340) includes a transmitter for generating a magnetic field proximate the reader (which acts as a tag activating signal). When a tag (corresponding to tag 355) enters the field, a magnetic coil in the tag functions as a receiver to receive the tag activating signal and generate electrical power for activating an integrated circuit chip coupled to the coil. The integrated circuit chip functions as a transmitter and transmits an identification signal with a unique code that uniquely identifies the tag. A receiver in the reader receives the identification signal, and a controller in the reader processes the signal to obtain the code, which may then be passed in a known format to a main controller (in this case the controller for cart management system 300).

The design and operation of Indala RF/ID systems are generally known in the art. Accordingly, they will not be discussed in greater detail herein. In addition, it will be appreciated that other proximity identification sensors, e.g., those available from other vendors, barcode sensors, etc., may be used in the alternative.

Various modifications may be made to system 300 consistent with the invention. For example, the carts may be retained by various key designs, or even other structure on the carts, e.g., the wheels. In addition, the tags used to identify each cart may be disposed elsewhere on a cart from the cart keys or the other components retained by the system. Also, prime moving mechanisms may be incorporated to assist in return and/or vending operations. In general, it will be appreciated that many of the other mechanical and/or electronic hardware designs and alternatives discussed above may be implemented in system 300 without departing from the spirit and scope of the invention.

Figure 13:
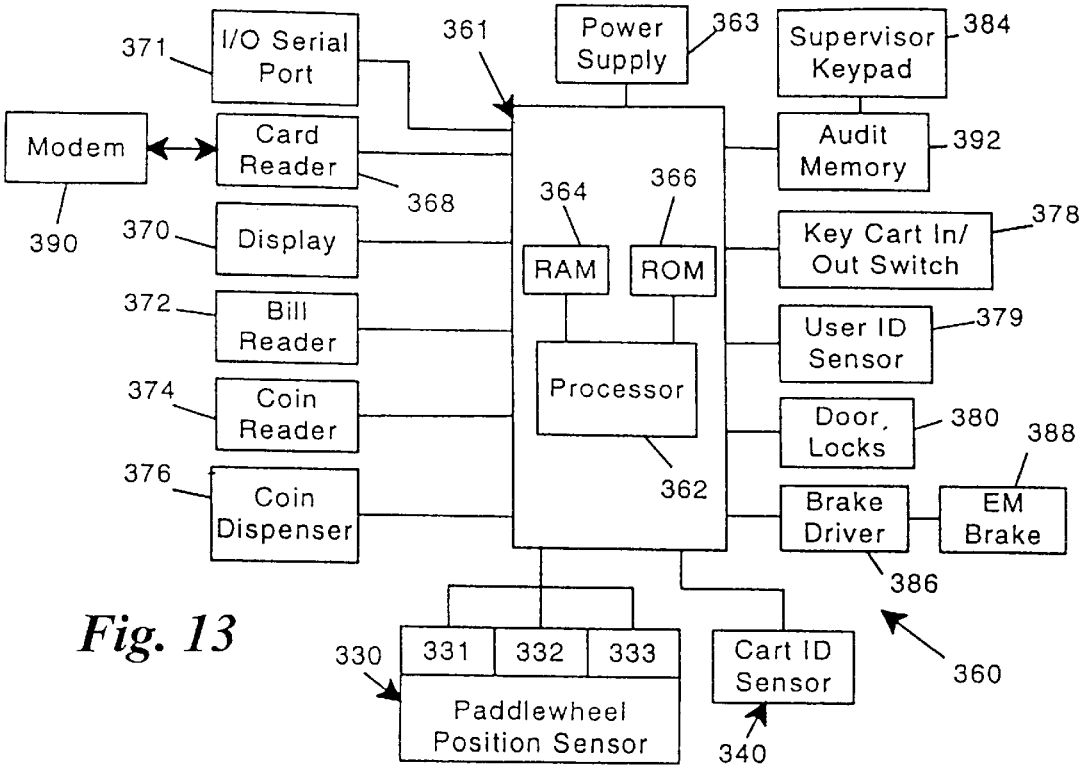
FIG. 13 is a schematic diagram of the electronic components in the controller for the system of FIG. 12.

FIG. 13 shows the primary electronic components in a controller 360 for system 300. Program code for controller 360 is executed in a processor 362, which is preferably a NEC V25 microprocessor or other suitable microprocessor or microcontroller, such as Intel 80286. The program code is stored in read only memory 366 and workspace is provided in random access memory 364. In addition, as described in greater detail below, a non-volatile audit memory 392 is coupled to processor 362 to store characterizing and statistical information for system 300. Power is provided by a power supply 363, which may include either a battery and/or converters for line power.

Processor 362 is coupled to a number of peripheral devices and components. For example, various display panel components, e.g., display 370, card reader 368 (coupled to a modem 390, which may be either a direct connection or a connection to a shared modem over a network), bill reader 372, coin reader 374, and coin dispenser 376, are coupled to the processor to provide the primary user interface. Furthermore, a supervisor keypad 384 is coupled to processor 362 through audit memory 392, and a key cart in/out switch 378 is coupled to the processor, to initiate a supervisor mode and to perform various menu-accessible functions to configure and/or receive statistical information from system 300. An I/O serial port 371 is provided to permit electronic access to the controller 360, e.g., using an external computer.

Keypad 384, switch 378, port 371, and the other internal mechanical and electrical components of system 300 are preferably hidden behind an access panel to restrict access only to authorized personnel. The access panel may be locked by mechanical means, or alternatively, as shown in FIG. 13, may include electromechanical door locks 380 which are accessed by a user ID sensor 379 that an authorized operator activates when access to the system is desired. Preferably, sensor 379 is a DS 1993 Touch Memory device available from Dallas Semiconductor, although many other known locking/security systems may also be used.

Paddlewheel position sensor 330 (including detectors 331, 332 and 333) and key or cart identification sensor 340 are also coupled to processor 362. In addition, an electromagnetic brake 388, used to selectively lock paddlewheel 320, is driven by processor 362 through a brake driver 386. However, unlike many of the above embodiments, system 300 does not include a separate cart in/out sensor. As will be discussed below, the functions of this sensor are handled using other components in system 300.

The implementation of controller 360, as well as the components and various alternatives available for its implementation, are similar to that which is described above with reference to controller 58 in FIG. 8. Additional modifications would be apparent to one skilled in the art.

Figure 14:
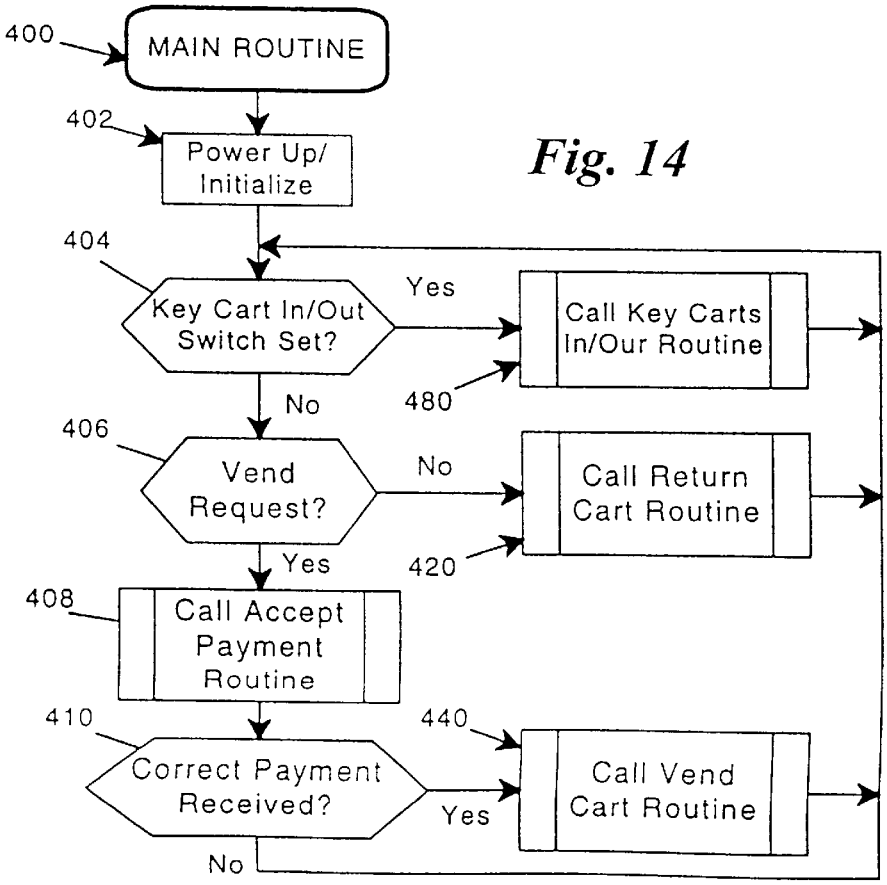
FIG. 14 is a flowchart diagram showing the operation of a main routine for the system of FIG. 12.

FIG. 14 shows the preferred program flow of a main routine 400 for the enhanced fraud prevention software for use in system 300. As discussed above, theft of rewards is a significant concern with stand-alone cart management systems. Accordingly, routine 400 requires several conditions to occur before dispensing a reward. In addition, routine 400 attempts to determine if a thief is attempting to defraud the system and/or if any of the sensors or other components in the system have failed. If so, routine 400 will either shut down the system, or fail to dispense a reward, depending upon the particular circumstances that are discussed in greater detail below.

Routine 400 begins with a power up/initialization block 402 to perform various general initialization and power-up procedures, including accessing the audit memory to characterize controller 360 (discussed below). Then, in block 404, the status of the key carts in/out switch is checked to determine if the system is in an R&M (repair and maintenance) or supervisor mode. If this switch is set, then control passes to block 480 to call a KEY CARTS IN/OUT routine 480 to handle the supervisor mode functions. Routine 480 is discussed below with reference to FIG. 17.

If the system is not in a supervisory mode, control passes to block 406 to determine if a vend request is pending from a customer. Any number of conditions may initiate a vend request, including depression of a pushbutton on the display panel, insertion of a credit or debit card into a card reader, insertion of a dollar bill into a bill reader, or insertion of a coin into a coin reader, for example.

If no vend request is received, control passes to block 420 to call a RETURN CART routine to determine whether a cart is being returned. Routine 420 is discussed below with reference to FIG. 15.

However, if a vend request is received, control passes to ACCEPT PAYMENT routine 408 to control the various payment accepting devices and determine whether sufficient finds have been inserted into the system to initiate a cart vend operation. The program flow of this routine is generally known in the art, and will be dependent upon a number of factors, e.g., the cost of a cart, the number/types of payment devices present on the system, etc.

After the ACCEPT PAYMENT routine 408 is called, control passes next to block 410 to determine whether a correct payment has been received. If the correct payment is not received, control passes back to block 404 to cycle through the main loop. In addition, any necessary additional functions, such as refunding any partial payments, would be performed at this time.

If the correct payment is received, block 410 passes control to block 440 to call the VEND CART routine. The operation of this routine is discussed below with reference to FIG. 16. After routine 440, control returns to block 404 to cycle again through the main loop of routine 400.

As shown in FIG. 15, RETURN CART routine 420 begins by checking in block 421 if the paddlewheel has moved, typically by sensing if no paddle is detected by detector 333. If no movement has been sensed, control is returned to main routine 400.

If, however, movement of the paddlewheel is detected, control passes to block 422 to wait until a paddle is again detected (e.g., using detector 333). During this period, block 423 is also executed to determine if a tag is being read by cart identification sensor 340. If no cart has been read, control returns to block 422. If a tag is read, control passes to block 424 to determine whether the tag is in a queue of carts currently retained within system 300.

If the tag is not in the queue, then control passes to block 436 to hold the tag number for further processing, and control next returns to block 421. If the tag is in the queue, then the queue may be incorrect, so the queue is adjusted in block 437 and control returns to block 421 to detect another movement of the paddlewheel.

Handling of reader/sensor 340 is preferably performed via an interrupt driven routine, whereby receipt and processing of a tag is performed independent of routine 400. Thus, reading of a tag in block 423 typically consists of determining whether a tag number has been presented to the routine by the reader/sensor interrupt routine. In general, reading of a tag may occur prior to or after a rotation of the paddlewheel to a next position. Accordingly, the primary purpose of block 423 is to hold any read tags for further processing later in the routine. Moreover, separate steps in the main routine to poll the sensor may not be required given this independent activity.

Returning to block 422, if a paddle has been detected, block 425 is executed to determine, using detectors 331 and 332, which paddle has been detected. If the same paddle as was detected prior to paddlewheel movement is detected, then no movement has actually occurred, and control returns to block 421. If the prior paddle in series is detected, representing counterclockwise movement of the paddlewheel in a return direction, control passes to block 427. If another paddle is detected, however, an error is posted and the system is shut down. For example, detection of the next sequential paddle may indicate that the brake or clutch is broken, since the brake is locked at this point to supposedly prevent clockwise rotation. Detection of another paddle, such as the opposite paddle to the previously detected paddle, may indicate that the detectors in the position sensor are bad, or that a paddle has broken off the paddlewheel. By "shutting down" or "stopping" the system, what is meant is that further customer operations, such as vending or returning carts, is prohibited. An operator or other authorized personnel may still access the system, e.g., to correct any errors causing the shut down.

Returning to a counterclockwise movement, block 428 checks is a tag has been read for the returned cart. As discussed above, the read tag may have already been processed by blocks 423, 424, 436 and 437 above, or may have occurred in the interim. Nonetheless, if no tag is read in block 427, it is assumed that no return of a valid cart has occurred, so control returns to block 421 without dispensing a reward.

If a tag was read, control passes to block 428 to determine whether the read tag corresponds to a cart already in the queue. If it is, then block 429 is executed to determine if the tag corresponds to the first (closest to the paddlewheel) cart in the system. If the tag does correspond to the first cart in the system, then it is assumed that no return actually occurred, only that the paddlewheel was rotated without a corresponding cart return. In this case, no update of the queue need occur, and no reward is dispensed. Control is returned to main routine 400.

If the tag corresponds to another cart in the queue, control passes to block 430 to post an error and return to the main routine without dispensing a reward. In this case, the queue is suspect, so an error is posted to notify an operator that all of the carts should be removed and reentered into the system to update the queue.

Returning to block 428, if the cart is not in the queue (indicating a new return), the control passes to blocks 431 and 432 to add the cart to the queue and increment the number of carts in the system and returned. Next, block 433 checks whether the system is ready to dispense a reward. If the system is not ready to dispense a reward, for example, if the system is in the middle of a vend or payment operation, if change is being dispensed, or if another reward operation is occurring, then control is passed to block 435 to post a "reward pending" message on the display and delay dispensing of the reward. When the system is ready to dispense a reward, block 434 is executed to perform this task, then the return cart routine ends and control is returned to main routine 400.

Next, as shown in FIG. 16, VEND CART routine 440 begins by releasing the electromagnetic brake in block 441. As discussed above, routine 440 is executed after valid payment is received, so the brake is released to permit a customer to remove a cart from the system.

Next, in block 442, paddlewheel movement is detected in block 442. If no movement is detected, block 443 determines whether a tag has been read. If not, control returns to block 442, otherwise control passes to block 444 to determine whether a read tag is the same as that of the first cart in the queue. If it is the same (the expected condition) control returns to block 442. Otherwise, control passes to block 445 to determine whether the tag corresponds to another cart in the queue. If it does not, then block 448 executes to post an error indicating that no paddlewheel movement was detected when expected. The RETURN CART routine 420 is also executed to determine if the new tag represents a returning cart.

If the read tag corresponds to any other tag in the queue, control passes to block 446 to adjust the queue to remove the carts ahead of the cart corresponding to the read tag. Then, an error is posted in block 447 to inform an operator that the queue is suspect, and the system is shut down until such time that the queue can be corrected by removing and replacing all carts from the system.

Returning to block 442, if movement of the paddlewheel is detected, control passes to block 449 to wait for another paddle to be detected. While waiting, blocks 450 and 451 are executed to determine (1) whether a tag has been read and (2) whether a tag, if read, corresponds to the first cart in the queue. If either condition is met, control returns to block 449, however, if a tag is read that is not the same as the first cart in the queue, control passes to block 452 to determine whether the tag corresponds to the second cart in the queue.

If the tag is not that of the second cart in the system, then control passes to block 445 (discussed above). If it is, however, then it is likely that a cart has been removed, but rotation of the paddlewheel was not detected. Thus, in block 453, the routine first checks whether this same occurrence has happened in the immediately preceding vend operation. If it has, then something is apparently wrong with the system, and block 454 is executed to adjust the queue before block 455 posts an error and stops the system.

If, however, this same occurrence is not a repeat occurrence, block 456 adjusts the paddlewheel position to reflect a one-position rotation, and block 460 is executed to lock the brake, as it is assumed that a cart has been removed.

Returning to block 449, once a paddle is detected, block 457 determines which paddle is under the sensor. If the same paddle is detected, no movement has occurred, and control returns to block 442 to await new movement. If the next paddle in series is detected, representing a clockwise rotation of the paddlewheel in a vending direction, then block 460 is executed to lock the electromagnetic brake since a cart has been removed. If a prior paddle is detected, representing a counterclockwise rotation in a return direction, it is possible that a cart is being returned. Accordingly, block 458 temporarily suspends the vend operation and calls CART RETURN routine 420 to handle the return. Any other paddle, such as the opposite paddle, results in an error being posted in block 459 and the system shutting down, possibly due to a faulty paddlewheel and/or position sensor.

Returning to block 460, it is assumed that a cart has now left the system. By this time, a tag should be read by sensor 340. In block 461, the routine checks if n (preferably two) vend operations have occurred without a tag being read. If this number of vends have occurred without a tag read, it is likely that the sensor is faulty, so an appropriate error is posted in block 462 and the system shuts down.

Otherwise, in block 463, the routine waits for m seconds (preferably six seconds) to detect new paddlewheel movement. The purpose of this function is to handle the possibility of a customer inadvertently pushing a cart back in the system immediately after it was removed (e.g., should the customer stumble). If this has occurred, block 466 waits until a paddle is again detected, and block 467 determines which paddle is detected. If the same paddle is detected, control returns to block 463. If the immediately prior paddle (indicating a counterclockwise rotation in a return direction) is detected, control passes to block 469. If another paddle is detected, an error is posted in block 468 and the system is shut down.

In the case of a prior paddle being detected, blocks 469 and 471 determine if a tag was read, and if so, if it is the same as the cart that was just rented. If this is the case, then the brake is released for k seconds (preferably six seconds) to permit a customer to remove the cart which was inadvertently returned to the system, and control returns to the main routine. If not, then it is likely that a new cart is being returned to the system, so block 470 calls the RETURN CART routine to suspend the vend operation and handle the newly returned cart.

Returning to block 463, if no paddlewheel movement is detected in the predetermined time (the typical occurrence), block 464 removes the vended cart from the queue. Block 465 then increments the number of carts out, and control is returned to the main routine.

Next, as shown in FIG. 17, KEY CARTS IN/OUT routine 480 first proceeds to block 495 to release the electromagnetic brake to permit an operator to freely insert and remove carts from the system. Next, routine 480 determines in block 481 if a paddle is located in a centered position, generally by checking detector 333 of paddlewheel position sensor 330. If a paddle is detected, then no insertion or removal is taking place, and control passes to block 496 to re-lock the electromagnetic brake and return to main routine 400 in FIG. 14.

If, however, no paddle is detected by detector 333, then an insertion or removal of a cart is taking place. Control passes to block 482 to wait until a next paddle is detected. While the system waits for a paddle to be detected, the system also periodically checks tag reader (cart identification sensor) 340 in blocks 497 and 498 to determine if a tag has been read, and if so if the tag is in the queue. If a tag is read and in the queue, block **498*b* adjusts the queue, stores the tag number, and returns control to block 481. If a tag is read and is not in the queue, then its number is stored in block 498 a and control returns to block 482. If no tag is read, control returns to block 482**.

Returning to block 482, once a paddle is detected in the normal operation of the system, control passes to block 483 to determine which paddle has been detected. It will be appreciated that detectors 331 and 332 are capable of maintaining a variable containing the number of the last paddle disposed under the paddlewheel position sensor prior to movement of the paddlewheel. Accordingly, by determining the number of the new paddle disposed under the sensor, the direction of movement of the paddlewheel may be determined.

If the same paddle is detected prior and after the movement of the paddle, it is assumed that the paddlewheel has not rotated to a new position—it has merely rotated a portion of a revolution and returned to its original position. In this case, control returns to block 481 to await another movement of the paddlewheel.

If an immediately lower numbered paddle (where paddle "3" is lower than paddle "0") is detected, a counterclockwise rotation has occurred to the next paddle position, indicating that a cart is being inserted into the system. Control passes to block 485 to handle the inserted cart, first by determining if a tag was read and stored in blocks 497, 498, **498*a* and 498*b* above, or if not, whether a valid tag has since been read by sensor 340**.

If no tag has yet been read, control passes to block 486 to check if j seconds (where j is preferably about 6 seconds) have elapsed while checking for a tag. If less than j seconds have elapsed, control passes back to block 485. However, if j seconds do elapse, then an error is posted in block 487 to inform an operator that the stored queue information is likely faulty, and control then passes back to block 481. In situations where an error is detected in the queue information, an operator will be advised to remove all carts from the system and reinsert them to ensure that the stored cart data is accurate.

Returning to block 485, if a tag was read, control passes to block 488 to add the identified cart to the first position of the queue. Then control passes to block 489 to increment the number of carts returned to the system. Then, control passes to block 499 to lock the electromagnetic brake and return to main routine 400.

Returning to block 483, if an immediately higher numbered paddle (where paddle "0" is higher than paddle "3") is detected, a clockwise rotation has occurred to the next paddle position, indicating that a cart is being removed from the system. Control passes to block 490 to handle the removed cart, first by determining if a valid tag was read. If any other paddle is detected (e.g., the opposite paddle from the last paddle), it is assumed that an error has occurred, possibly due to a defective sensor, a broken paddle, a broken brake, a broken clutch, etc. An error is then posted in block 484 and the system is shut down to prohibit further operation until appropriate service has been performed.

Returning to block 490, if a tag was not read by the sensor, control passes to block 493 to remove the cart from the queue, indicating that the first cart in the queue has been removed. Then, in block 494, the number of carts dispensed by the system is incremented. The brake is locked in block 499 and control returns to the main routine.

If a tag was read by the sensor, then it is compared to the identification of the last cart removed from the system. If the cart is different (which is the expected operation since the last cart should have been removed from the queue), control passes to block 493 to remove the cart from the queue.

If, however, the same cart is detected, an error has occurred, and an operator is notified of the faulty status of the queue in block 492. It will be appreciated that if the same cart is detected, then the information in the queue will most likely not represent the actual carts retained in the system at that time, so the operator will be advised to remove and reinstall all of the carts back into the system to correct the queue data.

In either event, however, control passes to block 499 to lock the electromagnetic brake. Next, control is returned to main routine 400.

Therefore, in normal operation routine 480 permits a supervisor or other operator to insert and remove carts from the system at will, and the queue is automatically updated to reflect the actual carts stored within the system. It will be appreciated that a multitude of other supervisory and diagnostic functions may be handled by this portion of the controller software, e.g., to test components, to view registers or other data, to determine relevant sales information, to configure the system, etc. Many of these functions are conventional in nature and accordingly will not be discussed in greater detail herein.

Routine 400 is configured to shut down customer operation in response to several conditions to ensure that vending and return of carts is permitted only when all of the sensors and other components are properly functioning and the queue is accurate. In particular, the routine posts an error and shuts down the system in response to the following conditions, among others: (1) paddle movement not sensed when expected; (2) paddle movement sensed when not expected (generally in the wrong direction); (3) several rents were executed without a tag being read; (4) paddle position error or erratic movement; and (5) when carts are sensed as having left the queue unexpectedly.

The use of the queue to maintain a list of the carts retained in the system provides enhanced error detection and protection against fraud, as well as a degree of self correction in the case of minor problems in the system.

For example, if a tag is read by sensor 340 when no movement of the paddlewheel is detected, routine 400 compares the read tag against those in the queue. If the tag corresponds to the first cart in the queue, then no action is taken since it is likely that the first cart is merely being moved back and forth in the rail behind the paddlewheel. If the tag corresponds to another cart in the queue, then all of the cart in front of the detected cart are removed from the queue, indicating that several carts have been removed without detection by the system. In this case an error will be posted to alert an operator that the queue is suspect, and that all of the carts should be removed and reinserted into the system to ensure the integrity of the queue. If the tag is not in the queue, then routine 400 assumes that the paddlewheel position sensor missed movement of the paddlewheel, and that a cart is being returned. This system may wait several seconds for a paddlewheel movement detection prior to posting an error, incrementing an error log and shutting down the system from further operation.

Routine 400 also compares a read tag to those in the queue in the case of tag being read when the paddlewheel is turned one quarter turn counterclockwise (in the return direction). If the tag corresponds to the first cart in the queue, no action is taken, and no reward is dispensed, as it is assumed that the paddlewheel was rotated without a cart being returned, or that a cart was returned with a defective tag. If the tag corresponds to another cart in the queue, no reward is dispensed and an error log counter is incremented, as it appears that one or more carts in queue were removed without detection. If the tag does not match a cart in the queue, a cart is being returned, and the routine proceeds to process the return.

Routine 400 also compares a read tag to those in the queue where the brake is released and paddlewheel movement has been detected (but a next paddle has not yet been detected). Where the tag corresponds to the first cart in the queue, a normal cart rental situation is assumed, since either the paddlewheel turned without the cart being removed, or the cart was removed but the next cart in the queue was not yet positioned under the sensor. In the case that the cart was not actually removed, the queue will self-correct in the next vend operation. If the tag corresponds to the second cart in the queue, it is assumed that the first cart has been rented and the second cart has now moved under the sensor. In this case, the brake is locked and the vend operation is completed.

If the tag corresponds to any other cart in the queue, it is assumed that one or more carts have been removed without detection. In this case, the brake is locked, the queue is adjusted to remove the carts in front of the detected cart, and an error is posted to alert an operator that the queue is suspect and that all of the carts should be removed and reinserted into the system to ensure the integrity of the queue. If the tag does not match a cart in the queue, then either a previous cart was not removed and is now being rented, or a cart was returned without being sensed. In this case, the cart is added to the queue, the brake is locked and the vend operation is completed, and an error log counter is incremented.

It will be appreciated that the various functions performed in routine 400 may be implemented via interrupts, subroutines, in parallel or event-driven processing, etc. Moreover, additional functions, and changes or modifications to the above-described functions may be made without departing from the invention.

For example, it may be desirable to provide a "sleep" mode of operation for routine 400, which would have particular benefit if the system is run off of battery (as opposed to AC line) power. In such a case, most of the functions of system 300, e.g., operating sensor 340, may be shut down until an awakening event occurs such as placing a bill, coin or card into its appropriate reader (using the appropriate reader to wake the system up), or placing a cart into the retaining rail and displacing the paddlewheel (using detector 333 to wake the system up). Other conditions may wake up the system, and other known power conservation techniques may also be used.

Universal Electronics with Audit Memory

An additional aspect of system 300 is the use of a universal control unit (generally designated at 361 in FIG. 13) that may be installed on a wide variety of cart management systems. A non-volatile audit memory 392 is electrically coupled to the universal control unit to store statistical and configuration information (i.e., "system parameters") for the system. In addition, universal control unit 361 maintains a non-volatile audit copy memory (e.g., in RAM block 364, with battery back-up (not shown)) for retaining the same type of information as the audit memory, for reasons that will be discussed in greater detail below.

As discussed above, different models of cart management systems may be available from any single provider, and individual systems may use different peripheral components. Moreover, different retaining mechanisms may be used by different cart management systems.

Thus, universal control unit 361 preferably is capable of operating with a plurality of systems and with different types of peripheral components and retaining mechanisms. This may be accomplished, in part, by using standardized interface circuitry and removable connectors to couple the control unit to different peripheral devices (e.g., the various devices shown in FIG. 13). The unit preferably includes processor 362, RAM 364, ROM 366 and associated communication/interface circuitry and is housed in an enclosure providing the necessary connectors. Further, the enclosure is removably mounted within system 300 to permit removal and replacement if necessary.

The software code for the control unit is reconfigurable to operate in different modes depending upon the particular devices to which the unit is coupled and the model or type of the cart management system into which the unit is installed. The electronic configuration and software code necessary to make a controller configurable for use with different peripheral devices or to operate in different modes is in general known in the art, and will not be discussed in greater detail herein.

Configuration data which is unique to a particular cart management system (e.g., a serial number, a model number, the peripheral components and retaining mechanisms used in the system, etc.) is preferably stored in audit memory 392. The audit memory also contains statistical information such as the number of carts in and out, the amount of money collected, etc.

The audit memory is a non-volatile memory such as a 4 Kbit touch memory device available from Dallas Semiconductor, and is mounted within system 300 such that it is in a place which is not easily accessible, possibly even to operators, and such that it is more or less permanently mounted therein. A supervisor keypad 384 is interfaced to the control unit through the audit memory, and supplemental displays, e.g., a battery status indicator for battery-driven systems, may also be included. It is desirable for audit memory 392 to be a permanent component of an individual cart management system as long as the system is in operation, thus uniquely identifying the cart management system. Other non-volatile memory devices may be used in the alternative.

The audit memory and the universal control unit both contain unique serial numbers which may be compared by the control unit to detect whether the control unit is installed into a new system (e.g., at the factory), as well as whether the control unit has been installed into a prior existing system (e.g., in the field). If the control unit is installed in a new system having an empty audit memory, then the audit memory is automatically configured by the control unit. If the control unit is installed in an existing system having information stored in the audit memory, the control unit reconfigures itself automatically using the audit memory information if the control unit does not match the audit memory (i.e., if their serial numbers do not match). Once operational and configured, the control unit then updates the audit memory periodically such that all of the information pertaining to the current status of the cart management system is permanently maintained in the audit memory.

During normal operation of system 300, the audit copy memory is updated whenever any of the statistical or configuration memory is modified, (e.g., when carts in or carts out registers are updated). Moreover, at predetermined times, e.g., whenever the system enters an idle state (when no vends or returns are occurring), or during power down procedures in battery-powered systems, then the contents of the audit copy memory are downloaded to the audit memory. In addition, a checksum is computed and stored in the audit memory and a flag is set in the audit memory indicating that a valid download of the audit copy memory occurred.

Figure 18:
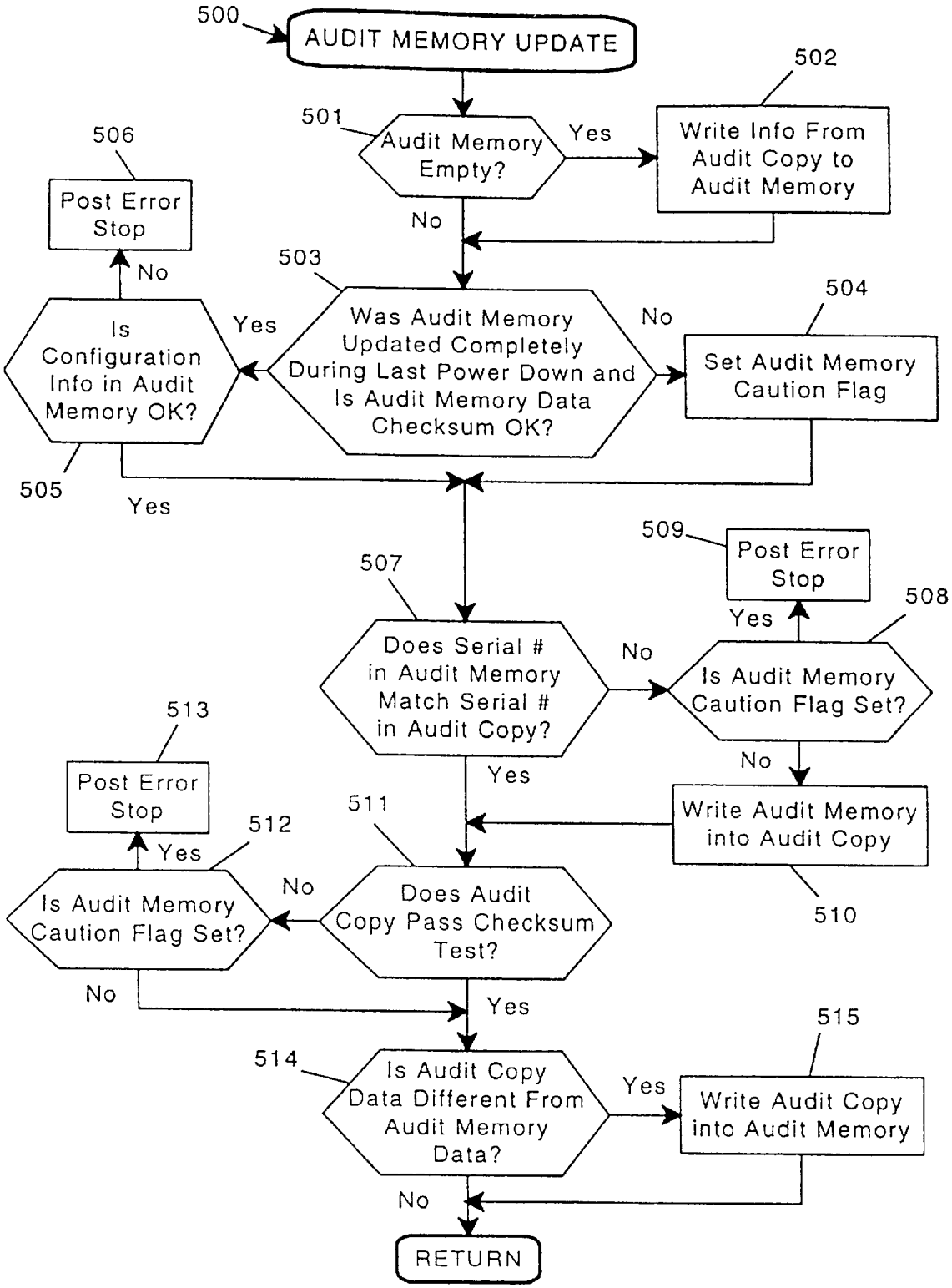
FIG. 18 is a flowchart diagram showing the operation of an AUDIT MEMORY UPDATE routine performed in the initialization/power up functions of FIG. 14.

FIG. 18 shows in greater detail the interaction of a control unit with an audit memory, specifically an AUDIT MEMORY UPDATE routine 500 which is executed as part of the initialization/power up functions executed in block 402 of routine 400 (FIG. 14). First, in block 501, the routine checks if the audit memory is empty (e.g., by checking for a null serial number), which typically indicates that system 300 is a new system that has not yet been configured. Alternatively, this could indicate that a new audit memory has been installed in the system, possibly due to failure of the old audit memory.

If the audit memory is empty, control passes to block 502 to write the information stored in the audit copy memory in the control unit into the audit memory and thereby initialize the audit memory. At this time, the serial number for the control unit is preferably stored in the audit memory such that the serial numbers of the audit memory and the control unit match.

The audit copy may be loaded with configuration information in a number of manners. Preferably, the audit copy is loaded in the factory with the information related to the particular peripheral components and model of cart management system, e.g., using an external computer which is capable of interfacing with the control unit through a direct port or through a modem. In addition, one of a plurality of configurations may be a default configuration, with other configurations being selectable using the external computer. Alternatively, different configurations may be pre-loaded in the control units and selected by DIP switches or the like, or selected from the supervisor keypad, for example. Moreover, audit memories may be preloaded in the factory such that blocks 501 and 502 need not be executed during start up.

Next, in block 503, the routine checks if (1) the audit memory was updated completely during the last power down and (2) the audit memory data checksum is valid. As discussed above, when the audit copy memory is downloaded to the audit memory during an idle state or a power down, a checksum is computed and a flag in the audit memory is set to indicate a valid update of the audit memory. Thus, block 503 generally attempts to detect if the information stored in the audit memory has somehow been corrupted.

If the audit memory was not completely updated or the checksum is not valid, control passes to block 504 to set an audit memory caution flag. Otherwise, control passes to block 505 to determine whether the configuration information in the audit memory is valid. This is checked by determining specific checksums on static configuration information which does not change during operation of the cart management system.

If the configuration information is not valid, an error is posted in block 506 and the system is shut down. Otherwise, control passes to block 507 to compare the serial numbers of the audit memory and the audit copy memory. If the serial numbers do not match, the control passes to block 508 to determine if the audit memory caution flag was set. If the flag is set, then an error is posted in block 509 and the system is shut down. Otherwise, it is assumed that a new control unit is being installed in an existing system, and block 510 is executed to upload the statistical and configuration information from the audit memory into the audit copy memory to thereby reconfigure the control unit to operate in the system.

If the serial numbers of the audit memory and the audit copy memory match, control passes instead to block 511 to perform a checksum test on the audit copy memory. If the audit copy checksum is not valid (indicating invalid information in the audit copy memory), block 512 determines if the audit memory caution flag is set. If it is, an error is posted in block 513 and the system is shut down. If not, control passes to block 514 to check if the information in the audit copy memory is at all different from the information in the audit memory. If it is, then the audit copy memory is downloaded to the audit memory in block 515 to update the audit memory. Otherwise, the routine terminates and returns to block 402 to proceed with other start-up operations.

The use of a permanent non-volatile audit memory and a removable control unit offers several advantages. First, defective control units may be removed and replaced with new working units, and the new units will automatically be reconfigured and updated with the statistical information maintained in the audit memory—essentially maintaining the cart management system in the same state as it was before the defective unit was removed. Similar advantages occur whenever new control unit designs, software routines, peripheral devices, etc. are installed.

Furthermore, a single control unit may be designed to work with innumerable models and peripheral devices, and be configured to operate correctly in several different configurations. Installation is also much easier and less labor intensive since reconfiguration generally occurs automatically. Moreover, the audit memory and audit copy memory are both checked during various operations to ensure that only valid (uncorrupted) data is transferred between the two memories. Consequently, the likelihood of the permanent configuration and statistical information maintained for an individual cart management system being corrupted is significantly reduced.

Second Alternate Embodiment With Further Enhanced Fraud Prevention

Figure 19:
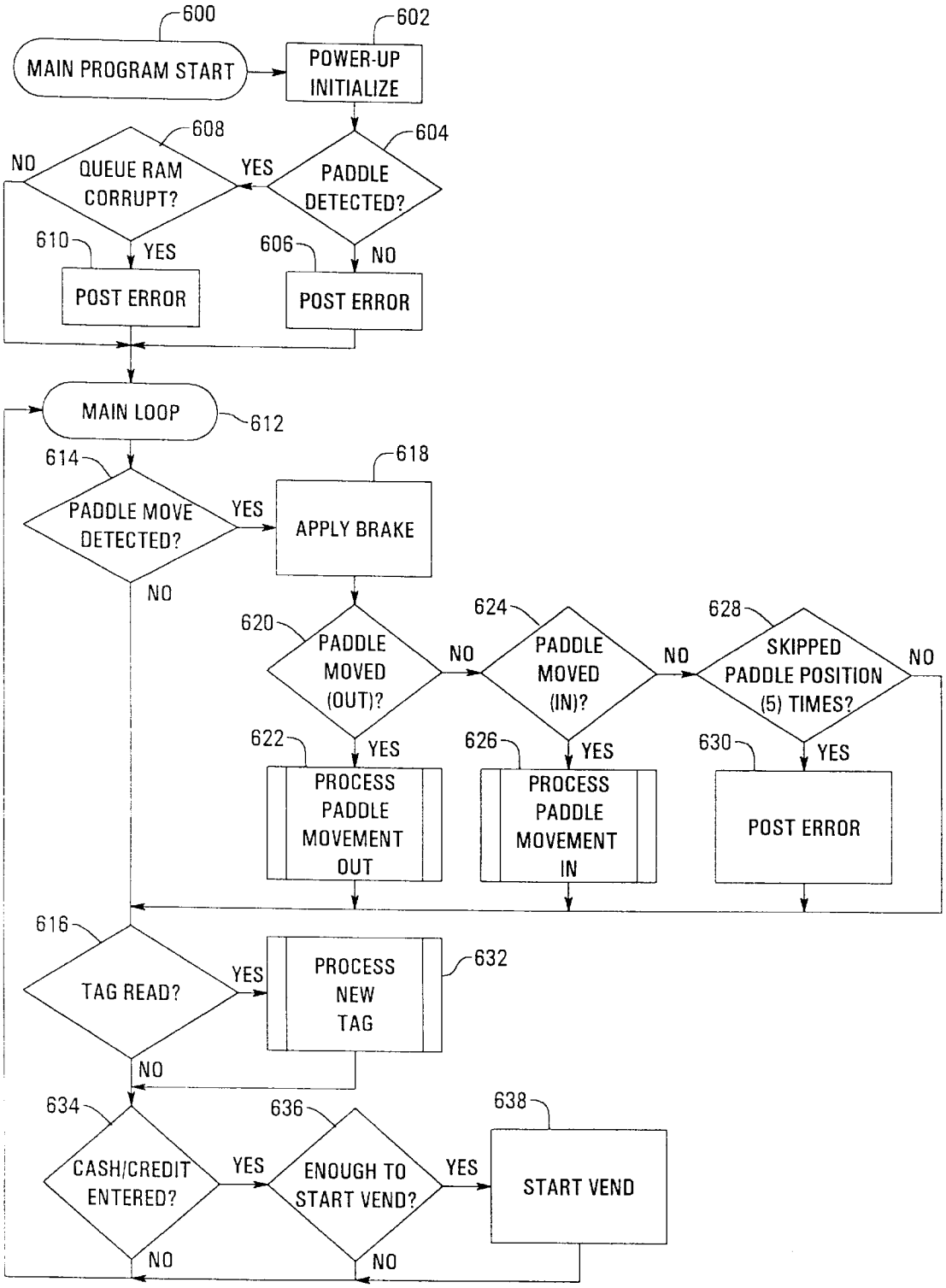
FIG. 19 is a flowchart diagram showing the operation a main routine including a MAIN PROGRAM START routine and a MAIN LOOP routine for an alternative cart management system having a pattern detector.

FIG. 19 illustrates a second alternate cart management system for use with further enhanced fraud prevention software routines generally in accordance with the invention. In this second alternate embodiment, similar mechanical and electronic hardware components are used as in the other embodiments, particularly the cart management system 300, of the invention discussed above, with a few exceptions as outlined below. Unless otherwise specified, it is to be understood that all of the components of the second alternate cart management system are substantially the same as the other embodiments discussed above.

In the second alternate cart management system, a counter is used for counting a number of times that an identification or tag of the cart is missed from the queue of carts. Once the number of times exceeds a set number, the tag of the missing cart is put on a HOT LIST™ so that the CMU will deny a reward for any future return of the tag unless the queue is maintained or cleared.

FIG. 19 shows the preferred program flow of a main routine, including a MAIN PROGRAM START routine and a MAIN LOOP routine, for the second alternative cart management system with a further enhanced fraud prevention software. As discussed above, theft of rewards is a significant concern with stand-alone cart management systems. Clever hustlers attempt to manipulate the electronics into thinking a valid cart has been returned. One of the ways that a hustler may do is that: after the hustler obtains a first reward at the first time by inserting the detached cart tag into the system, the hustler rents a cart himself by paying a rental (the hustler can always to return the rented cart to get a second reward); and then the hustler uses the prior detached cart again to obtain a third reward which the hustler will not normally get without the above renting step, because the detached tag has already been read in the queue at the first time of return. Accordingly, by renting and returning a cart before the hustler tries to use the detached tag for a second time, the CMU system queue described in the previous embodiments does not detect the fraud. To prevent this type of situations from happening, an improved fraud protection program is demanded and described below in details corresponding to the flowchart illustrations shown in FIGS. 19–23.

Again in FIG. 19, routine 600 (MAIN PROGRAM START), begins with a power up/initialization block 602 to perform various general initialization and power-up procedures such as initializing variables, setting up interrupts, etc. In block 604, the paddle sensors, such as sensor 100 as shown in FIG. 1B, are read to verify that the sensors and other components are properly functioning. If no paddle position (0, 1, 2, or 3) is read, the paddle sensors are suspect, and the routine posts an error in block 606. The system is shut down until an operator repairs the problem. In block 608, queue RAM (random access memory) in which the cart tag queue is stored is verified as to whether it has a correct checksum. If the queue RAM does not have a correct checksum, the routine posts an error in block 610.

The main operation loop (MAIN LOOP 612) begins with block 614. In block 614, the paddle sensors are read to determine if the paddles have moved from one position to another. If a "no" new paddle position has been detected, then the operation continues in block 616. If a "yes" new paddle position has been detected, then the brake is applied in block 618, whether the brake was released or not (for redundancy). The electromagnetic brake discussed above can be used. It is appreciated that other types of the brake mechanisms can be used generally in accordance with the principles of the invention.

In block 620, a paddle movement (out) is determined. If the new paddle position indicates that a cart was pulled out, the PROCESS PADDLE MOVEMENT OUT routine 622 is run. Otherwise, if the new paddle position indicates that a cart was returned (blocks 624 and 626), then the PROCESS PADDLE MOVEMENT IN routine is operated. If the new paddle position indicates the opposite paddle (i.e. a skipped paddle position in block 628), and this has happened several times, then an error is posted in block 630. As illustrated, five times of reoccurrence is set. It is appreciated that the reoccurring times can be adjusted. Once an error is posted, the system is shut down until repairs are made. In all other cases, the operation continues in block 616.

In block 616, if a cart tag is read by the sensor (and it is stored as "New Tag"), the PROCESS NEW TAG routine at block 632 is run to determine what is to be done with the newly read cart tag.

In block 634, if coins or bills or credit card is used to initiate a vend, then block 636 checks to see if sufficient funds were entered. And if so, the vending process (START VENT) is started in block 638. Once the vending process is done or there is not enough coins or bills or money in credit cards, the program continues at the beginning of the main loop in block 612.

Figures 2, 22A:
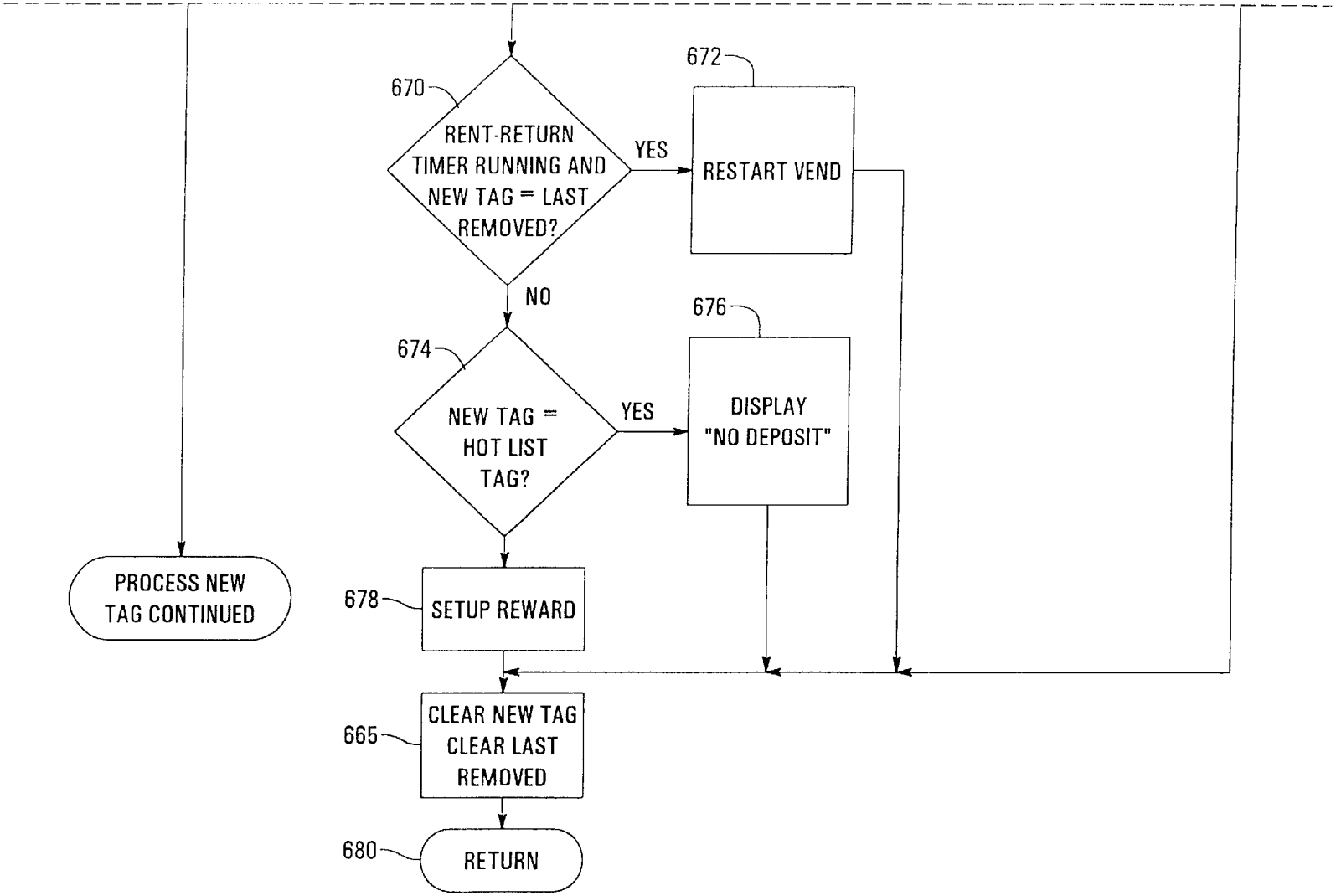

The detailed operation of the PROCESS NEW TAG routine at block 632 is shown in FIG. 22A. PROCESS NEW TAG routine is used to determine whether to add or remove a cart tag from the queue when that tag is read by the tag reader. Thus, it is called when a tag is in "New Tag." The tag reader stores the tag read in "New Tag" when "New Tag" is empty. Otherwise the reader holds the tag.

In block 640, if the new tag is the same as the first tag in the queue (cart closest to the paddle has been re-read), then in block 642, the new tag is cleared and ignored (i.e. remove the last read tag). The program returns to the main loop 612 through block 644.

In block 646, if new tag is the same as the one stored in the HOT LIST™ (which is the list that keeps track of fraud using a separated or detached tag), and a cart is being inserted while in R&M (repair & maintenance) mode or while the operator is keying carts in, then in block 648, the tag is removed from the fraud HOT LIST™ (it is now assumed to be on a valid cart).

In block 650, if the system was set up indicating that a return paddle movement was sensed (see block 780), then the new tag is associated with a returned cart, and several checks are performed on the tag starting with block 652. Otherwise, if the system has not sensed a return paddle movement, then the program continues with block 654 in FIG. 22B.

In block 652, if the tag already exists in the queue whereby the tag could be a fraud or the queue could be corrupt, the program continues with block 656. Otherwise (i.e. this tag does not exist in the queue), then the operation continues with block 658. In block 656, the system indicator for expecting a returned cart tag is cleared. In block 660 if the tag is the second tag in the queue, the check for fraud routine is run in block 662. Otherwise, the tag must exist further in the queue, so the queue must be corrupt (e.g. several carts are missing that were entered in the queue). The queue is adjusted (tags that exist up to but not including the new tag are removed from the queue), and an error is posted in block 664 indicating that he operator should re-establish the queue when time permits. The program continues with block 665.

In block 658, the expected tag does not exist in the queue. The system indicator for expecting a returned cart tag is cleared, and the tag is added to the queue.

In block 668, if the system is in the R&M mode or the operator is keying carts in or out, then the program continues with block 665.

In block 670, if the rent return timer is running and the new tag is the same as the tag on the cart that was removed in the previous vend, the vend is restarted in block 672, and the program continues with block 665. Otherwise, the program continues with block 674. In block 674, if the tag on the cart that was just returned is the same as the tag in the fraud HOT LIST™, then the reward is withheld, and a message "NO DEPOSIT" is posted in block 676. Otherwise, if the tag is not in the HOT LIST™, a reward is set up in block 678 to be dispensed when allowed.

In block 665, the new tag is clear which allows the next tag to be read and dealt with. In block 680, the program returns to the main loop 612.

As shown in FIG. 22B, in block 654, the new tag was not expected (block 650), nor was it the same as the first tag in the queue (block 640). Block 654 checks to see if the paddle is moving (e.g. between two of the four possible positions. If the tag was read while the paddle is moving, then the system waits for a short while (e.g. 6 seconds) to see whether the paddle finishes its move to the next position or the previous position. If the timer expires while the paddle is still moving, then the new tag will be assumed to be attached to a returned cart, and it will be dealt with accordingly. So, in block 654, if the tag-hold timer has not been started yet, then the program continues with block 682.

In block 684, if the tag is the same as the second tag in the queue, then the program checks for tag fraud in the CHECK FOR TAG FRAUD routine at block 686.

In block 688, if the tag does not exists in the queue, then the timer for holding on to the tag is started in block 690, and then the program returns to the main loop 612 through block 692 without clearing the new tag such that the main loop will keep rechecking this routine. Otherwise, if the tag exists farther down the queue, then the queue is corrupt, and in block 694, the queue is adjusted.

In block 696, if the operator is not keying carts in or out, then in block 698, an error is posted indicating that the queue needs to be re-established when time permits. The new tag is cleared in block 700, and the program returns to the main loop 612 through block 702.

In block 682, the paddle is not moving or the tag-hold timer is already running. If the timer is running, then the routine returns to the main loop 612 through block 704 without clearing the new tag such that the main loop 612 will keep checking this routine.

In block 706, if the paddle is still moving, and the tag-hold timer has expired, then in block 708, it is assumed that the cart was returned, and the new tag is added to the queue, and the new tag is cleared in block 700, and the routine returns to the main loop 612.

In block 710, none of the previous situations have occurred, which indicates that this tag has appeared for no apparent reason (although a user may have returned a cart so quickly that the tag reader was unable to read the tag, and therefore the cart was in the queue, but its tag was not recorded. In block 710, if this new unexpected tag is the second tag in the queue, then the check for tag fraud is run in block 712. Next, the new tag is cleared in block 700, and the program returns to the main loop 612.

In block 714, if the new unexpected tag is not in the queue, then in block 716, the new unexpected tag is added to the queue (i.e. adjusts the queue). Next, the new tag is cleared in block 700, and the program returns to the main loop 612.

In block 718, the queue is adjusted because the tag already exists in the queue. In block 720, if the operator is not keying carts in or out, then in block 722, an error is posted indicating that the operator needs to re-establish the queue when time permits. Finally, the new tag is cleared in block 700, and then the program returns to the main loop 612.

Figure 23:
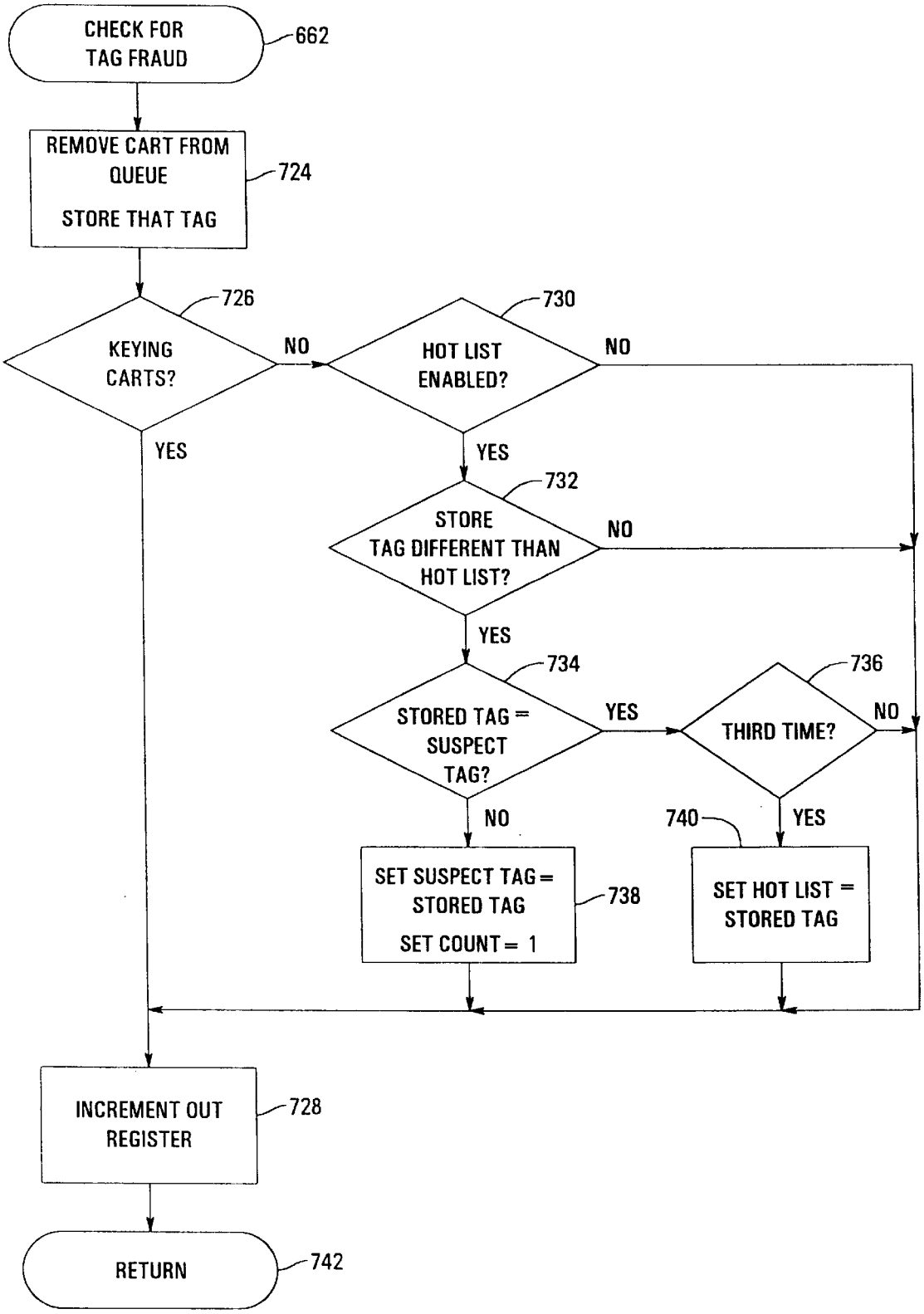
FIG. 23 is a flowchart diagram showing the operation of a CHECK FOR TAG FRAUD routine for the alternative cart management system having a pattern detector.

FIG. 23 shows routine 662 (from CHECK FOR TAG FRAUD block 662 in FIG. 22A) where the check for tag fraud is performed. In block 724, the tag is removed from the queue and stored in a temporary register.

In block 726, if the operator is keying carts in or out, then the program continues with block 728. In block 730, if the tag fraud HOT LIST™ check is not enabled, then the program continues with block 728. In block 732, if the tag just removed from the queue is the same as the one in the tag fraud HOT LIST™, then the program continues with block 728. In block 734, if the tag just removed from the queue is the same as the last one removed by this routine, then the program continues with block 736. Otherwise, in block 738, the tag just removed from the queue is stored, and the count of fraud checks is reset to 1 for the next time this routine is run. The program then continues with block 728. In block 736, if the tag just removed from the queue is the same as the last one checked in this routine for the third time or other preset time, then this tag is stored in the tag fraud HOT LIST™ in block 740, and rewards will be denied in the future.

In block 728, the register that counts the number of carts removed is incremented, and the program returns to the calling routine in block 742.

Figure 20:
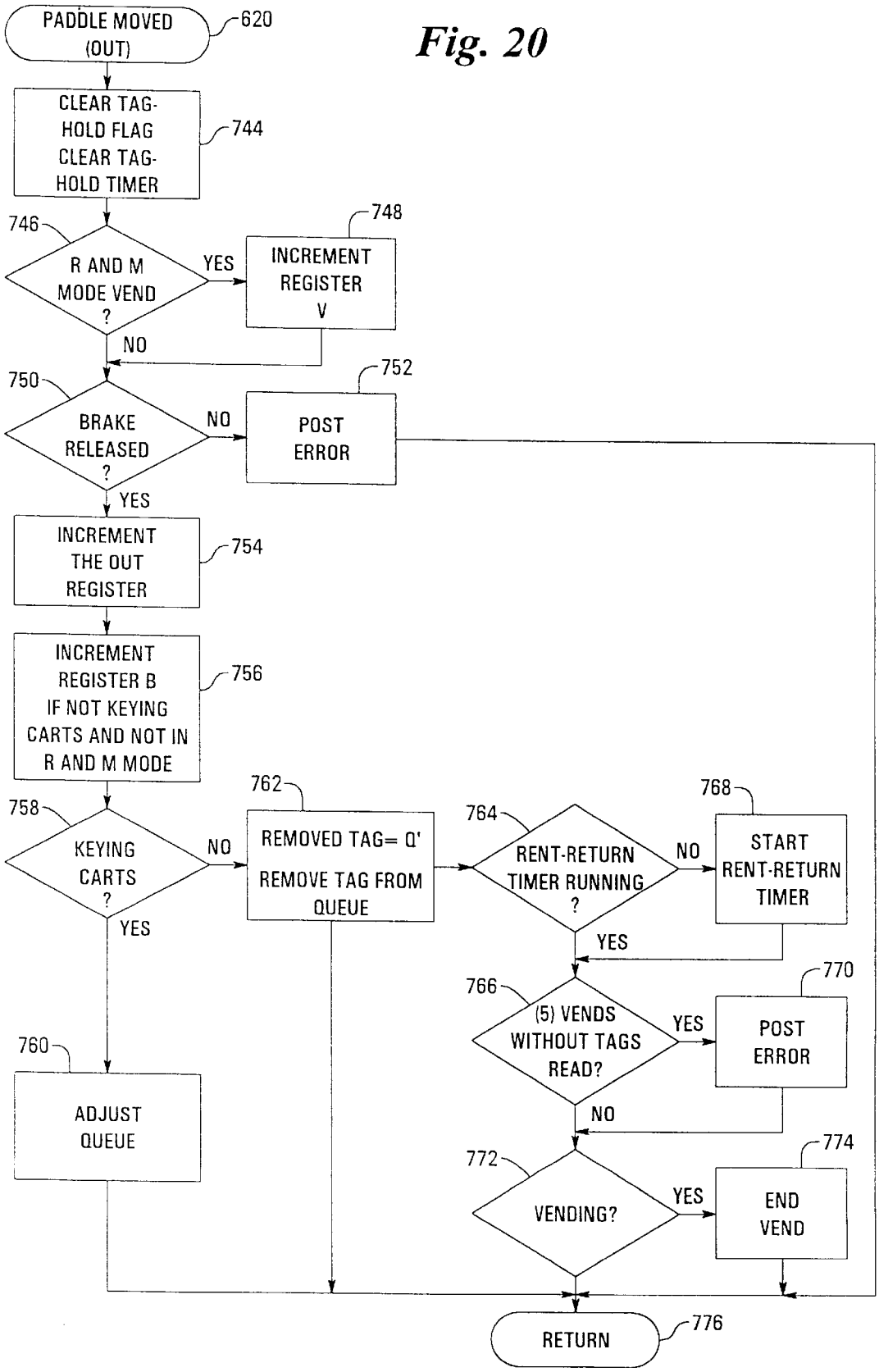
FIG. 20 is a flowchart diagram showing the operation of a PADDLE MOVED (OUT) routine for the alternative cart management system having a pattern detector.

In FIG. 20, the PADDLE MOVED (OUT) routine 620 (from block 622 in FIG. 19) is shown. Routine 620 determines what to do when the paddle has moved indicating that a cart has been taken out of the queue. In block 744, the timer used to hold on to a tag while the paddle is moving (if a tag was read while the paddle was moving) is cleared.

In block 746, if the system was not in the normal mode of operation but instead was in the R&M mode, then register V in block 748 is incremented indicating that a cart was vended in this special mode, keeping track of the number of carts removed this way.

In block 750, if the brake was not released when the paddle was moved in this direction, then a failure has occurred, and an error is posted in block 752. The system is then shut down until repairs are made. Otherwise, the program continues with block 754. In block 754, the register that keeps track of the number of carts removed is incremented. In block 756, if the system is performing a normal vend (i.e. not R&M or keying carts), then the register that contains the count of normal vends (register B) is incremented.

In block 758, if the operator is keying carts (e.g. operator uses a key to allow removal of return of carts for adjusting the number of carts held in queue, etc.), then the first tag in the queue is removed (the tag closest the paddle) in block 760. Otherwise, the program continues with block 762. In block 762, the tag that is the first one in the queue is stored for later checking, and this tag is removed from the queue.

In block 764, the rent return timer is checked to see if it is properly running. This rent return timer is used to allow a user to re-take a cart that he/she accidentally returned within a small amount of time (e.g. 6 seconds or other set time). If the rent return timer is running, then the program continues at block 766. Otherwise, the rent return timer is started in block 768 and then continues the operation in block 766.

In block 766, if a settable number of vends, e.g. five, have occurred without any tags having been read, then an error is posted in block 770. Then, the tag reader is assumed to be faulty, and the system is shut down until repairs are made.

In block 772, if the cart was removed because a valid vend was initiated, then the vending is completed in block 774. In block 776, the operation returns to the main loop 612.

Figure 21:
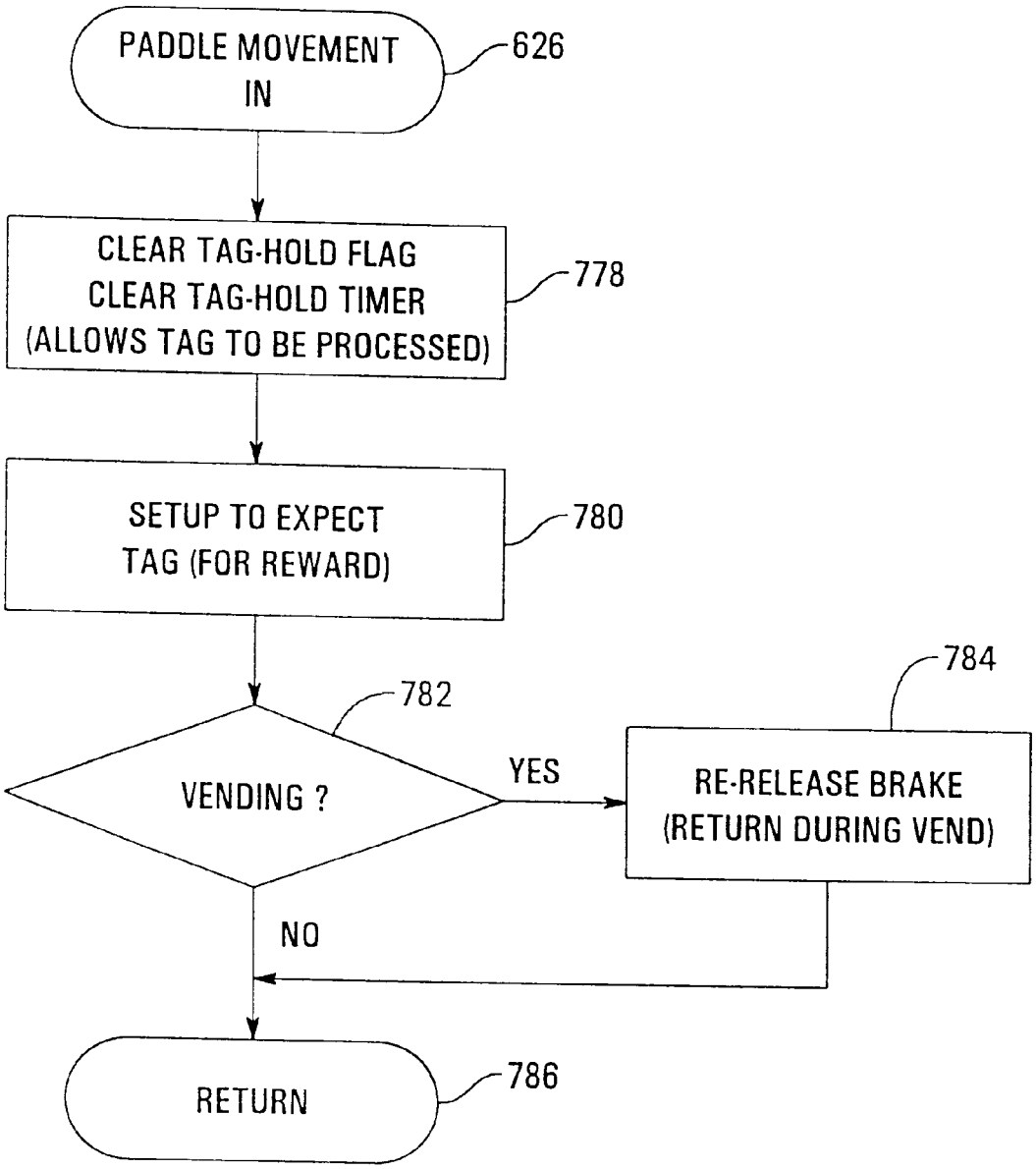
FIG. 21 is a flowchart diagram showing the operation of a PADDLE MOVED (IN) routine for the alternative cart management system having a pattern detector.

In FIG. 21, the PEDDLE MOVEMENT (IN) routine 626 (from block 626 in FIG. 19) is shown. Routine 626 is run when the paddle moves indicating that a cart has been returned. In block 778, the timer used to hold on to a tag while the paddle is moving (if a tag was read while paddle was moving) is cleared. In block 780, the system is set up to expect a tag (because the paddle was moved this way). This is used in the routine of block 632 to determine whether a valid cart with tag has been returned (a reward may be dispensed). In block 782, if the system was in the vend mode of operation, then in block 784, the brake is re-released to allow the vend. This can occur when someone returns a cart before the user who started the vend pulls a cart out. Finally, in block 786, the program returns to the main loop 612.

Therefore, it will be appreciated that the invention provides cart management systems which may be used in a variety of application with a variety of carts, and with sophisticated electronic control that is highly resistant to theft from hustling. As one skilled in the art will appreciate that various modifications may be made to the preferred embodiments without departing from the spirit and scope of the invention, the invention thus resides in the claims hereafter appended.

What is claimed is:

1. A cart management system for vending and returning carts, comprising:

(a) retaining means for selectively retaining at least one of the carts;

(b) a cart identification sensor for uniquely identifying carts retained by the retaining means;

(c) control means, coupled to the retaining means and the cart identification sensor, for controlling the vending and returning of carts, wherein the control means maintains a queue of carts identified by the cart identification sensor and retained by the retaining means;

(d) reward means, coupled to the control means, for dispensing a reward when a cart is returned to the retaining means; and (e) a counter, coupled to the control means, for counting a number of times that an identification of the cart is missed from the queue of carts so as to prevent the reward means from dispensing a reward when the number of times exceeds a predetermined value of the counter.

2. A method for vending and returning carts in a cart management system, comprising the steps of:

(a) retaining selectively at least one of the carts;

(b) identifying carts retained by a cart identification sensor;

(c) controlling the vending and returning of carts and maintaining a queue of carts identified by the cart identification sensor;

(d) dispensing a reward when a cart is returned to the cart management system; and (e) counting a number of times that an identification of the cart is missed from the queue of carts to prevent the dispensing of the reward when the number of times exceeds a predetermined value.

3. A method of claim 2, wherein the identifying step includes a step of uniquely identifying the cart to distinguish the cart from others of the carts.

4. A method of claim 2, wherein the dispensing step dispenses a reward only when the paddlewheel rotates from a starting position to an adjacent position in an insertion direction, the returned cart is identified as a valid cart, the returned cart is not in the queue of carts, and the returned cart is not the cart missing from the queue of the carts for more than the predetermined value.

5. A queue management system for managing a queue of objects, comprising:

(a) an identification sensor uniquely identifying the objects;

(b) a controller, coupled to the identification sensor, maintaining an order of the objects in the queue identified by the identification sensor; and (c) a pattern detector, coupled to the controller, determining a pattern when a number of deviations from a predetermined queue have occurred so as to prevent a regular subsequent event directed by the controller from happening.

6. A queue management system of claim 5, wherein the pattern detector prevents the subsequent event from happening when the number of deviations exceeds a predetermined value.

7. A cart management system for vending and returning carts, comprising:

(a) a retainer selectively retaining at least one of the carts;

(b) a cart identification sensor uniquely identifying carts retained by the retainer;

(c) a controller, coupled to the retainer and to the cart identification sensor, to control the vending and returning of carts, wherein the controller maintains a queue of carts identified by the cart identification sensor and retained by the retainer;

(d) a reward mechanism, coupled to the control means, operable to dispense a reward when a cart is returned to the retainer; and (e) a counter, coupled to the controller, counting a number of times that an identification of the cart is missed from the queue of carts so as to prevent the reward mechanism from dispensing a reward when the number of times exceeds a predetermined value of the counter.

8. The system of claim 7, further comprising a plurality of cart keys, each disposed on one of the carts.

9. The system of claim 8, wherein the retainer retains the cart key of each retained cart, and wherein each cart key is removably mounted to an upward support of a cart through a clamp; whereby the cart keys may be attached to different types of existing carts.

10. The system of claim 8, wherein the retainer comprises a retaining rail having an open end for receiving the cart keys, a paddlewheel rotatably mounted with a paddle projecting into an access aperture in the retaining rail, and a locking mechanism, coupled to the paddlewheel, for selectively inhibiting rotation of the paddlewheel.

11. The system of claim 10, wherein the locking mechanism comprises an electromagnetic brake.

12. The system of claim 11, wherein the paddlewheel is coupled to the electromagnetic brake through a one-way clutch.

13. The system of claim 10, wherein the cart keys each include first and second rollers rotatably mounted to rotate about vertical axes and arranged along an axis that is parallel to a longitudinal axis of the rail when the rollers are retained in the rail.

14. The system of claim 13, wherein each cart key includes a tag disposed within the cart key including a transmitter for emitting an identification signal, wherein the cart identification sensor includes a receiver disposed proximate the retaining rail with the paddlewheel interposed between the cart identification sensor and the open end of the retaining rail, such that the cart identification sensor receives the identification signal from a cart key as the cart key rotates the paddlewheel.

15. The system of claim 14, wherein the tag of each cart key is disposed in the first roller of the cart key such that when the cart key is inserted into the retaining rail beyond the paddlewheel, the tag is maintained distal from the cart identification sensor by the second roller contacting the paddlewheel.

16. The system of claim 14, wherein the cart identification sensor further includes a transmitter for emitting a tag actuating signal, wherein the tags each further include a receiver for receiving the tag actuating signal, wherein the transmitter of each tag emits the identification signal responsive to the tag actuating signal.

17. The system of claim 7, wherein the retainer comprises a rotatable paddlewheel having a plurality of paddles extending radially from a rotational axis thereof, wherein the paddlewheel is rotated by the insertion and removal of carts, and wherein the system further comprises a paddlewheel position sensor for detecting a rotational position of the paddlewheel.

18. The system of claim 7, wherein the reward mechanism dispenses a reward only when the paddlewheel rotates from a starting position to an adjacent position in an insertion direction, the returned cart is identified by the cart identification sensor, and the returned cart does not match any cart stored in the queue.

19. The system of claim 18, wherein the returned cart is not the cart missing from the queue of the carts for more than the predetermined value.

* * * * *